US012168279B2

(12) United States Patent
Eriksson et al.

(10) Patent No.: US 12,168,279 B2
(45) Date of Patent: Dec. 17, 2024

(54) SKATE BLADE AND APPARATUS FOR REMOVING MATERIAL FROM A SKATE BLADE

(71) Applicant: BAUER HOCKEY LTD., Blainville (CA)

(72) Inventors: Magnus Eriksson, Njurunda (SE); Linus Berglund, Sundsvall (SE)

(73) Assignee: BAUER HOCKEY LTD., Blainville (CA)

( * ) Notice: Subject to any disclaimer, the term of this patent is extended or adjusted under 35 U.S.C. 154(b) by 55 days.

(21) Appl. No.: 17/508,199

(22) Filed: Oct. 22, 2021

(65) Prior Publication Data

US 2022/0040812 A1 Feb. 10, 2022

Related U.S. Application Data

(63) Continuation of application No. 16/988,610, filed on Aug. 8, 2020, now Pat. No. 11,806,826, which is a continuation-in-part of application No. 16/854,433, filed on Apr. 21, 2020, now Pat. No. 11,878,386.

(60) Provisional application No. 62/898,989, filed on Sep. 11, 2019.

(51) Int. Cl.

| | |
|---|---|
| ***B24B 21/00*** | (2006.01) |
| ***A63C 1/02*** | (2006.01) |
| ***A63C 1/32*** | (2006.01) |
| ***B24B 3/00*** | (2006.01) |
| ***B24B 3/36*** | (2006.01) |
| ***B24B 9/04*** | (2006.01) |
| ***B24D 15/06*** | (2006.01) |

(52) U.S. Cl.

CPC ..... *B24B 21/006* (2013.01); *A63C 1/02* (2013.01); *A63C 1/32* (2013.01); *B24B 3/003* (2013.01); *B24B 3/36* (2013.01); *B24B 9/04* (2013.01); *B24B 21/002* (2013.01); *B24D 15/066* (2013.01)

(58) Field of Classification Search

CPC ..... A63C 1/02; A63C 1/30; A63C 1/32

See application file for complete search history.

(56) References Cited

U.S. PATENT DOCUMENTS

| | | | |
|---|---|---|---|
| 3,650,073 | A | 3/1972 | Weisman |
| 3,956,857 | A | 5/1976 | Weisman |
| 3,988,865 | A | 11/1976 | Weisman |

(Continued)

FOREIGN PATENT DOCUMENTS

| | | |
|---|---|---|
| CA | 2217783 A1 | 6/1999 |
| CA | 207327 | 8/2023 |

(Continued)

OTHER PUBLICATIONS

Non-Final Office Action issued on Mar. 16, 2023 in connection with United States U.S. Appl. No. 16/854,433, 25 pages.

(Continued)

*Primary Examiner* — Brian L Swenson

(57) ABSTRACT

A blade for a skate for skating on ice. The blade includes ice-contacting material with an ice-contacting surface for contacting the ice. The ice-contacting surface has a machined longitudinal profile with a radius of curvature that varies smoothly over a majority of the length of the blade. Such a radius of curvature may, in some cases, be an elliptical arc.

21 Claims, 59 Drawing Sheets

(56) References Cited

U.S. PATENT DOCUMENTS

| | | | | |
|---|---|---|---|---|
| 4,088,335 | A * | 5/1978 | Norton | A43B 5/1641 280/11.18 |
| 4,993,725 | A | 2/1991 | Barnes | |
| 5,103,597 | A | 4/1992 | Courchesne | |
| 5,127,194 | A | 7/1992 | Jobin | |
| 5,167,170 | A | 12/1992 | Croteau | |
| 5,189,845 | A | 3/1993 | Courchesne | |
| 5,195,277 | A | 3/1993 | Courchesne | |
| 5,197,232 | A | 3/1993 | Ellestad | |
| 5,239,785 | A | 8/1993 | Allen | |
| 5,287,657 | A | 2/1994 | Tschida et al. | |
| 5,345,688 | A | 9/1994 | Allen | |
| D352,880 | S | 11/1994 | Anderson | |
| 5,381,629 | A | 1/1995 | Salvail | |
| 5,383,307 | A | 1/1995 | Anderson | |
| 5,431,597 | A | 7/1995 | Anderson | |
| 5,445,050 | A | 8/1995 | Owens | |
| 5,492,037 | A | 2/1996 | Graham | |
| 5,499,556 | A | 3/1996 | Exner et al. | |
| 5,547,416 | A | 8/1996 | Timms | |
| 5,564,973 | A | 10/1996 | Salvail | |
| 5,569,064 | A | 10/1996 | Gleadall | |
| 5,582,535 | A | 12/1996 | Friel | |
| 5,591,069 | A | 1/1997 | Wurthman | |
| 5,601,473 | A | 2/1997 | Strain et al. | |
| 5,607,347 | A | 3/1997 | Schoen et al. | |
| 5,704,829 | A | 1/1998 | Long | |
| D390,084 | S | 2/1998 | McCabe | |
| D392,536 | S | 3/1998 | Anderson | |
| D394,196 | S | 5/1998 | Richardson | |
| 5,791,974 | A | 8/1998 | Sakcriska | |
| 5,826,890 | A * | 10/1998 | Swande | A63C 1/32 280/11.18 |
| 5,879,229 | A | 3/1999 | Anderson | |
| 5,897,428 | A | 4/1999 | Sakcriska | |
| 5,916,018 | A | 6/1999 | Watt | |
| 6,030,283 | A | 2/2000 | Anderson | |
| 6,067,880 | A | 5/2000 | Arrigoni | |
| 6,116,989 | A | 9/2000 | Balastik | |
| 6,218,639 | B1 | 4/2001 | Bulle | |
| 6,312,017 | B1 | 11/2001 | Hardwick et al. | |
| 6,422,934 | B1 | 7/2002 | Blach et al. | |
| 6,443,819 | B2 | 9/2002 | Sakcriska | |
| 6,481,113 | B1 | 11/2002 | Brenner et al. | |
| 6,579,163 | B1 | 6/2003 | Ross et al. | |
| 6,594,914 | B1 | 7/2003 | Babcock | |
| 6,726,543 | B1 | 4/2004 | Klosterman | |
| 6,761,363 | B2 | 7/2004 | Fask et al. | |
| 7,097,547 | B2 | 8/2006 | McCroary | |
| D529,361 | S | 10/2006 | Brookman | |
| 7,191,539 | B2 | 3/2007 | Zukerman | |
| 7,220,161 | B2 | 5/2007 | Eriksson | |
| 7,434,324 | B2 | 10/2008 | McKenna | |
| 7,473,164 | B2 | 1/2009 | Sunnen | |
| 7,547,022 | B2 | 6/2009 | Broadbent | |
| D603,432 | S | 11/2009 | Wilson et al. | |
| 7,748,130 | B2 | 7/2010 | McKenna | |
| 7,918,035 | B1 | 4/2011 | Jarczewski | |
| 7,934,978 | B2 | 5/2011 | Wilson et al. | |
| 8,047,552 | B2 | 11/2011 | Julien | |
| 8,277,284 | B2 | 10/2012 | Wilson et al. | |
| 8,430,723 | B2 | 4/2013 | Moon | |
| 8,574,030 | B2 | 11/2013 | Wilson et al. | |
| 8,827,768 | B2 | 9/2014 | Allen | |
| 8,851,961 | B2 | 10/2014 | Frommer et al. | |
| 8,888,567 | B2 | 11/2014 | Allen et al. | |
| 8,944,889 | B2 | 2/2015 | Frommer et al. | |
| D725,453 | S | 3/2015 | Lodato et al. | |
| 9,114,498 | B1 | 8/2015 | Layton et al. | |
| 9,242,330 | B1 | 1/2016 | Layton et al. | |
| 9,259,637 | B2 | 2/2016 | Wilson et al. | |
| 9,308,613 | B2 | 4/2016 | Eriksson | |
| 9,339,911 | B2 | 5/2016 | Eriksson | |
| 9,352,437 | B2 | 5/2016 | Layton et al. | |
| 9,352,444 | B2 | 5/2016 | Layton et al. | |
| 9,475,175 | B2 | 10/2016 | Layton et al. | |
| 9,480,903 | B2 | 11/2016 | Wilson et al. | |
| 9,517,543 | B2 | 12/2016 | Proulx | |
| 9,566,682 | B2 | 2/2017 | Layton et al. | |
| 9,573,236 | B2 | 2/2017 | Layton et al. | |
| 9,651,466 | B2 | 5/2017 | Brown et al. | |
| 9,669,508 | B2 | 6/2017 | Layton et al. | |
| D793,830 | S | 8/2017 | Layton et al. | |
| 9,895,786 | B2 | 2/2018 | Frommer et al. | |
| 9,895,791 | B2 | 2/2018 | Bleier | |
| 9,897,430 | B2 | 2/2018 | Layton et al. | |
| 9,902,035 | B2 | 2/2018 | Layton et al. | |
| 10,065,282 | B2 | 9/2018 | Layton et al. | |
| D845,793 | S | 4/2019 | Di Nardo et al. | |
| 10,300,574 | B2 | 5/2019 | Layton et al. | |
| 10,335,925 | B2 | 7/2019 | Layton et al. | |
| 10,384,329 | B2 | 8/2019 | Downen | |
| 10,406,647 | B2 | 9/2019 | Tatomir | |
| 10,500,463 | B2 | 12/2019 | Stastny et al. | |
| 10,533,834 | B2 | 1/2020 | Di Nardo et al. | |
| 10,583,347 | B2 | 3/2020 | Proulx | |
| 10,926,379 | B2 | 2/2021 | Bleier | |
| 11,103,974 | B2 | 8/2021 | Chan et al. | |
| 11,148,035 | B2 | 10/2021 | Shaffer | |
| 11,806,826 | B2 | 11/2023 | Berglund et al. | |
| 11,878,386 | B2 | 1/2024 | Eriksson et al. | |
| 2003/0015848 | A1* | 1/2003 | Pham | A63C 1/32 280/11.12 |
| 2003/0148716 | A1 | 8/2003 | Lyons | |
| 2004/0244538 | A1 | 12/2004 | Franzen et al. | |
| 2005/0029755 | A1 | 2/2005 | Fask et al. | |
| 2005/0130571 | A1 | 6/2005 | Sunnen | |
| 2006/0065076 | A1 | 3/2006 | Friol | |
| 2006/0103084 | A1 | 5/2006 | Dahlo et al. | |
| 2006/0183411 | A1 | 8/2006 | Moon | |
| 2006/0208436 | A1* | 9/2006 | Tatomir | A63C 1/42 280/11.12 |
| 2006/0223419 | A1 | 10/2006 | Moon | |
| 2007/0068022 | A1 | 3/2007 | McKenna | |
| 2009/0206562 | A1 | 8/2009 | Podolsky | |
| 2009/0206563 | A1 | 8/2009 | Ferras | |
| 2010/0201088 | A1 | 8/2010 | Newman et al. | |
| 2011/0203416 | A1 | 8/2011 | Grodin | |
| 2012/0104705 | A1 | 5/2012 | Swist | |
| 2012/0108151 | A1 | 5/2012 | Swist | |
| 2012/0227204 | A1 | 9/2012 | Maye | |
| 2014/0090445 | A1 | 4/2014 | Norman | |
| 2014/0225337 | A1 | 8/2014 | Olson | |
| 2015/0140901 | A1 | 5/2015 | Eriksson | |
| 2015/0140902 | A1 | 5/2015 | Eriksson | |
| 2015/0367224 | A1 | 12/2015 | Schatz | |
| 2016/0059107 | A1 | 3/2016 | Finley | |
| 2016/0096252 | A1 | 4/2016 | Layton et al. | |
| 2016/0250732 | A1 | 9/2016 | Layton et al. | |
| 2017/0165558 | A1* | 6/2017 | Makai | A63C 1/30 |
| 2017/0320184 | A1 | 11/2017 | Tatomir | |
| 2018/0126250 | A1 | 5/2018 | Proulx | |
| 2019/0038957 | A1 | 2/2019 | Histed et al. | |
| 2019/0076718 | A1* | 3/2019 | Lee | A63C 1/36 |
| 2019/0176292 | A1 | 6/2019 | Chan et al. | |
| 2020/0139219 | A1* | 5/2020 | Van Horne | A63C 1/06 |
| 2020/0206878 | A1 | 7/2020 | Downen | |
| 2020/0309499 | A1 | 10/2020 | Hauer | |
| 2020/0316745 | A1 | 10/2020 | Maxwell | |
| 2020/0338691 | A1 | 10/2020 | Downen | |
| 2021/0069850 | A1 | 3/2021 | Eriksson et al. | |
| 2021/0069853 | A1 | 3/2021 | Berglund et al. | |
| 2021/0162561 | A1 | 6/2021 | Chan et al. | |
| 2021/0308835 | A1 | 10/2021 | Bleier | |
| 2021/0346783 | A1 | 11/2021 | Stuhr et al. | |
| 2022/0040812 | A1 | 2/2022 | Eriksson et al. | |
| 2022/0212308 | A1 | 7/2022 | Berglund et al. | |
| 2024/0042568 | A1 | 2/2024 | Berglund et al. | |
| 2024/0109160 | A1 | 4/2024 | Eriksson et al. | |

FOREIGN PATENT DOCUMENTS

| | | |
|---|---|---|
| CA | 223320 | 8/2023 |
| CA | 223321 | 8/2023 |

(56) References Cited

FOREIGN PATENT DOCUMENTS

| | | | |
|---|---|---|---|
| DE | 112020003834 | | 4/2022 |
| DE | 112020003835 | | 4/2022 |
| EP | 0035939 | B1 | 5/1983 |
| EP | 0128430 | | 8/1988 |
| EP | 1584410 | | 10/2005 |
| EP | 3071367 | | 11/2022 |
| GB | 608207 | | 9/1948 |
| SE | 443315 | | 2/1986 |
| SE | 527015 | | 12/2005 |
| SE | 545052 | C2 | 3/2023 |
| SE | 645053 | C2 | 3/2023 |
| WO | 2016183663 | A1 | 11/2016 |
| WO | 2021050349 | | 3/2021 |
| WO | 2021050351 | | 3/2021 |

OTHER PUBLICATIONS

Restriction requirement issued on Mar. 23, 2023 in connection with United States U.S. Appl. No. 16/988,610, 6 pages.
International Search Report and Written Opinion issued on Nov. 17, 2020 in connection with International Patent Application No. PCT/US2020/049172, 5 pages.
International Search Report and Written Opinion issued on Nov. 19, 2020 in connection with International Patent Application No. PCT/US2020/049166, 5 pages.
Excerpt from Marinescu et al., Tribology and Fundamentals of Abrasive Machining Processes, 2nd edition, 2013, Chapter 9.9.4, consulted on Jun. 12, 2023 https://www.sciencedirect.com/topics/engineering/abrasive-belts.
Notice of Allowance issued on Jun. 28, 2023 in connection with U.S. Appl. No. 16/988,610, 12 pages.
International Preliminary Report on Patentability issued Mar. 15, 2022 in connection with International Patent Application No. PCT/US2020/049172, 4 pages.
International Preliminary Report on Patentability issued Mar. 15, 2022 in connection with International Patent Application No. PCT/US2020/049166, 4 pages.
Notice of Allowance (Final Notice) issued by the Swedish Patent Office on Oct. 14, 2022 in connection with Swedish Patent Application No. 2250329-6, 3 pages.
Notice of Allowance (Final Notice) issued by the Swedish Patent Office on Oct. 14, 2022 in connection with Swedish Patent Application No. 2250328-8, 3 pages.
Swedish Search Report issued by the Swedish Patent Office on Oct. 14, 2022 in connection with Swedish Patent Application No. 2250329-6, 2 pages.
Swedish Search Report issued by the Swedish Patent Office on Oct. 14, 2022 in connection with Swedish Patent Application No. 2250328-8, 3 pages.
Notice of Allowance issued by the European Patent Office on May 30, 2022 in connection with European Patent Application No. 14864954.4, 7 pages.
Examiner's Report issued on Nov. 29, 2023 in connection with Canadian Patent Application No. 3,154,282, 4 pages.
Examiner's Report issued on Nov. 29, 2023 in connection with Canadian Patent Application No. 3, 154,378, 5 pages.
Notice of Allowance issued on Sep. 13, 2023 in connection with U.S. Appl. No. 16/854,433, 9 pages.
Corrected Notice of Allowance issued on Oct. 2, 2023 in connection with U.S. Appl. No. 16/854,433, 2 pages.
Examiner's Report issued by the Canadian Intellectual Property Office on Jan. 18, 2024 in connection with Canadian Patent Application No. 3135705, 5 pages.
Skate Blade Profile / Rocker Explained. What is a Profile / Rocker? [online]. Wissota Skate Sharpeners, May 11, 2018 [retrieved on Sep. 23, 2021]. Retrieved from the Internet: <URL: https://wissota.com/skate-blade-profile-rocker-explained/>.

* cited by examiner

400

| a [mm] | b [mm] | $L_R$[mm] | $S_{eff_min}$ | $S_{max_max}$ |
|---|---|---|---|---|
| 266.18 | 22.36 | 283.6 | 5.53 | 17.14 |
| 332.25 | 50.90 | 283.6 | 2.49 | 8.16 |
| 205.84 | 83.93 | 283.6 | 1.18 | 3.36 |
| 266.18 | 22.36 | 266.3 | 5.39 | 16.75 |
| 332.25 | 50.90 | 266.3 | 2.41 | 2.19 |
| 205.84 | 83.93 | 266.3 | 1.15 | 3.35 |

FIG. 4D

1306A

| Acceleration Time – Holding Mechanism [s] | | | | | | | |
|---|---|---|---|---|---|---|---|
| Acceleration Time – Material Removal device [s] | | | | | | | |
| X position | Y position | Grinding Pressure | Translation speed (X) [cm/s] | Translation speed (Y) [cm/s] | Rotation Speed [rpm] | Initial point of contact? | Final Point of contact? |
| $x_1$ | $y_1$ | ... | ... | ... | ... | No | No |
| $x_2$ | $y_2$ | ... | ... | ... | ... | No | No |
| $x_3$ | $y_3$ | ... | ... | ... | ... | Yes | Yes |
| ... | ... | ... | ... | ... | ... | ... | ... |

FIG. 13C

SKATE BLADE AND APPARATUS FOR REMOVING MATERIAL FROM A SKATE BLADE

CROSS-REFERENCE TO RELATED APPLICATIONS

The present patent application is a continuation-in-part of U.S. patent application Ser. No. 16/988,610 filed Aug. 8, 2020, which is a continuation-in-part of U.S. patent application Ser. No. 16/854,433 filed Apr. 21, 2020, which claims the benefit of U.S. provisional patent application Ser. No. 62/898,989, filed Sep. 11, 2019. The aforementioned applications are hereby incorporated by reference herein.

FIELD

The present application relates generally to blades or runners for ice skates and, in particular, to the design of an ice-contacting surface of such blades or runners as well as methods and apparatuses for removing material from such an ice-contacting surface.

BACKGROUND

An ice skate has a blade (or "runner") with an ice-contacting surface that comes into contact with the ice. The ice-contacting surface of the blade is not flat, but rather is curved. This allows the skate to tilt forward or backward with respect to the ice, which gives the skater agility when taking off or changing directions. The shape of the ice-contacting surface can be an arc of a circle of a certain radius, such as 5 feet, 7 feet, 11 feet, 15 feet or 21 feet, for instance. In some advanced skate designs, the shape of the ice-contacting surface is comprised of three or four connected segments, each being an arc of a circle of a different radius. With a front arc having a smaller radius of curvature and a rear arc having a larger radius of curvature, the blade provides the skater with improved agility when tilting onto the balls of their feet as well as improved power when taking strides, since the region of contact with the ice is greater where pushing occurs.

However, a disadvantage with existing multi-radius designs is the transition from one circular arc to the next, which advanced skaters can feel and often find unnatural and inconvenient. As such, a different skate blade profile would be desirable.

SUMMARY

In accordance with an aspect of the disclosure, there is provided a blade for a skate for skating on ice. The skate comprises a skate boot configured to receive a foot of a user, the skate further comprising a blade holder disposed below the skate boot and configured to hold the blade, the blade being elongate and having a length. The blade comprises an ice-contacting material with an ice-contacting surface for contacting the ice, the ice-contacting surface having a machined longitudinal profile with a radius of curvature that varies smoothly over a region of interest of the blade, the region of interest occupying a majority of the length of the blade.

In accordance with another aspect, there is provided a blade for a skate for skating on ice. The skate comprises a skate boot configured to receive a foot of a user, the skate further comprising a blade holder disposed below the skate boot and configured to hold the blade, the blade being elongate and having a length. The blade comprises an ice-contacting material with an ice-contacting surface for contacting the ice, the ice-contacting surface defining a longitudinal profile corresponding to an elliptical arc over at least part of the length of the blade.

In accordance with a further aspect, there is provided a blade for a skate for skating on ice. The skate comprises a skate boot configured to receive a foot of a user, the skate further comprising a blade holder disposed below the skate boot and configured to hold the blade, the blade having a length. The blade comprises an ice-contacting material with an ice-contacting surface for contacting the ice, the ice-contacting surface defining a longitudinal profile along the length of the blade and a transverse profile along a cross-section of the blade taken at a mid-point along the length of the blade. The longitudinal profile has a radius of curvature that varies smoothly over a majority of the length of the blade. The transverse profile has a radius of curvature that varies by no more than 10% over the entire cross-section of the blade.

In accordance with yet another aspect, there is provided a blade for a skate for skating on ice. The skate comprises a skate boot configured to receive a foot of a user, the skate further comprising a blade holder disposed below the skate boot and configured to hold the blade, the blade having a length and a thickness. The blade comprises an ice-contacting material with an ice-contacting surface for contacting the ice, the ice-contacting surface defining a longitudinal profile along the length of the blade and a transverse profile along a cross-section of the blade taken at a mid-point along the length of the blade. The longitudinal profile has a radius of curvature that varies smoothly over a majority of the length of the blade. The transverse profile is symmetric about a thickness-wise midpoint of the cross-section of the blade.

In accordance with another aspect, there is provided a template for profiling a blade for a skate, the template being elongate and having a length, the blade comprising ice-contacting material. The template comprises template material with a longitudinal profile to be imparted to the ice-contacting material of the blade, the longitudinal profile having a radius of curvature that varies smoothly over a majority of the length of the template.

In accordance with another aspect, there is provided a method of removing material from a blade, the blade having ice-contacting material with an ice-contacting surface. The method comprises inserting the blade into a profiling apparatus. The method also comprises profiling the blade with the profiling apparatus to impart a predetermined longitudinal profile to the ice-contacting surface of the blade, the predetermined longitudinal profile having a radius of curvature that varies smoothly over a majority of the length of the blade.

In accordance with another aspect, there is provided a non-transitory computer-readable medium comprising instructions which, when executed by a processor, cause the processor to carry out a method that comprises profiling a blade of a skate, the blade comprising ice-contacting material, so as to impart to the ice-contacting material a longitudinal profile having a radius of curvature that varies smoothly over a majority of the length of the blade.

In accordance with a further aspect, there is provided a blade for a skate for skating on ice. The skate comprises a skate boot configured to receive a foot of a user. The skate further comprises a blade holder disposed below the skate boot and configured to hold the blade. The blade is elongate and having a length that is divisible into five fifths of equal size. The blade comprises ice-contacting material with an ice-contacting surface for contacting the ice, the ice-contacting surface being longitudinally profiled to have a first radius of curvature at a first point in the second fifth of the blade and a second radius of curvature at a second point in the fourth fifth of the blade, with the second radius of curvature being greater than the first radius of curvature by at least 10%, and with the blade being transition-zone-free between the first points and the second point.

According to a further broad aspect, there is provided a profiling apparatus for removing material from a blade, the profiling apparatus comprising: a holding device for holding a blade; a material removal device coupled to the holding device, for contacting an ice-contacting surface of the blade; a moving device coupled to the holding device and the material removal device, for allowing relative movement between the holding device and the material removal device; and a processor coupled to at least the material removal device and the moving device, for controlling operation of the moving device and the material removal device to impart a longitudinal profile of a selected digital template to the ice-contacting surface of the blade, wherein the selected digital template has a surface with a radius of curvature that varies smoothly over a length that corresponds to a majority of the length of the blade.

These and other aspects will now become apparent to those of ordinary skill in the art upon review of the following description of embodiments in conjunction with the accompanying drawings.

BRIEF DESCRIPTION OF DRAWINGS

A detailed description of embodiments is provided below, by way of example only, with reference to drawings annexed hereto, in which:

FIG. 4D shows a table of values associate with suitable profile functions other than p(X);

FIG. 13C is a table of parameters for the grinding control sequence;

Figure 1A:
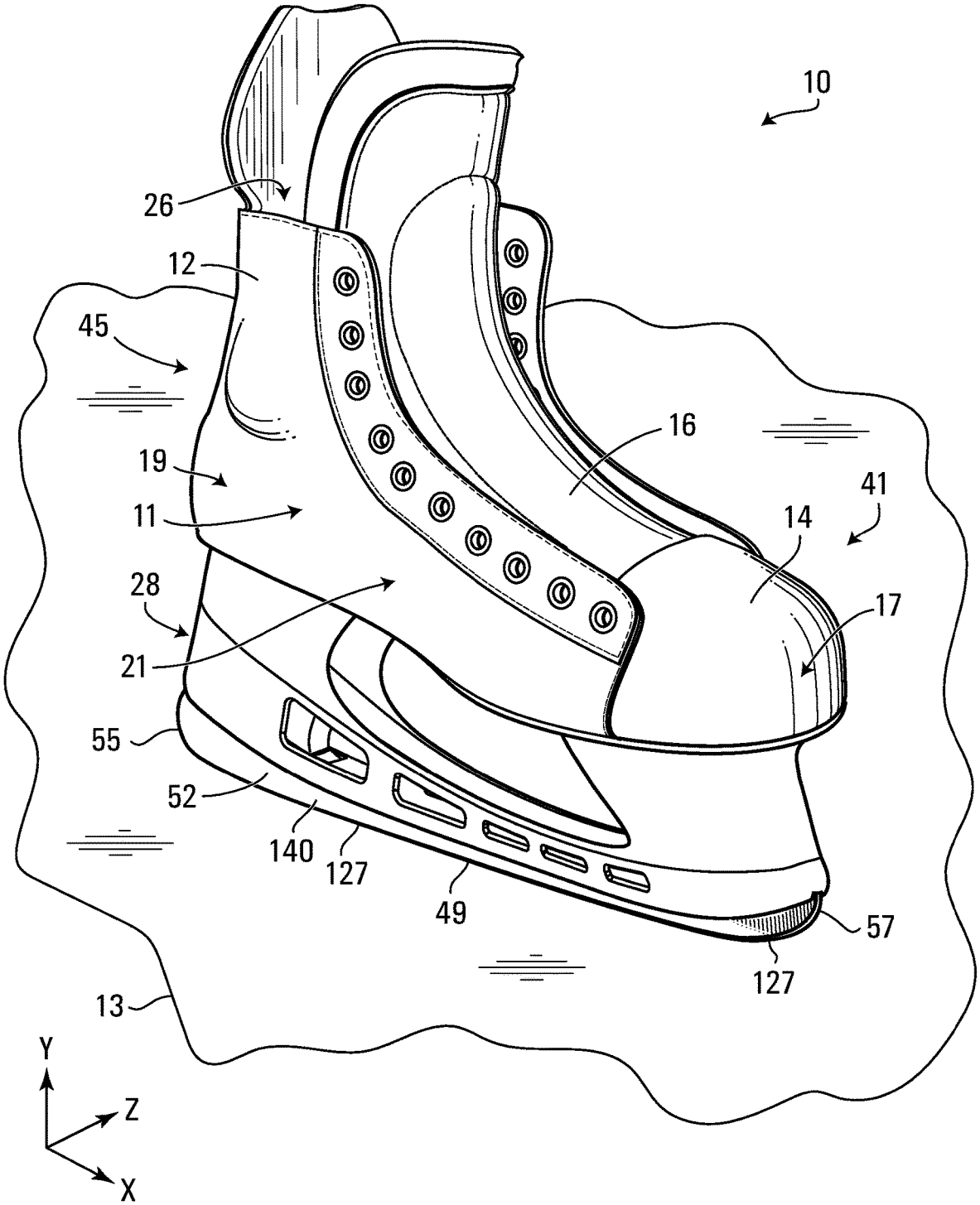
FIG. 1A is an embodiment of a skate for a hockey user in accordance with a non-limiting embodiment of the present disclosure.

In the drawings, embodiments are illustrated by way of example. It is to be expressly understood that the description and drawings are only for purposes of illustration and as an aid to understanding and are not intended to be and should not be limitative.

DETAILED DESCRIPTION

Skate

Figure 1B:
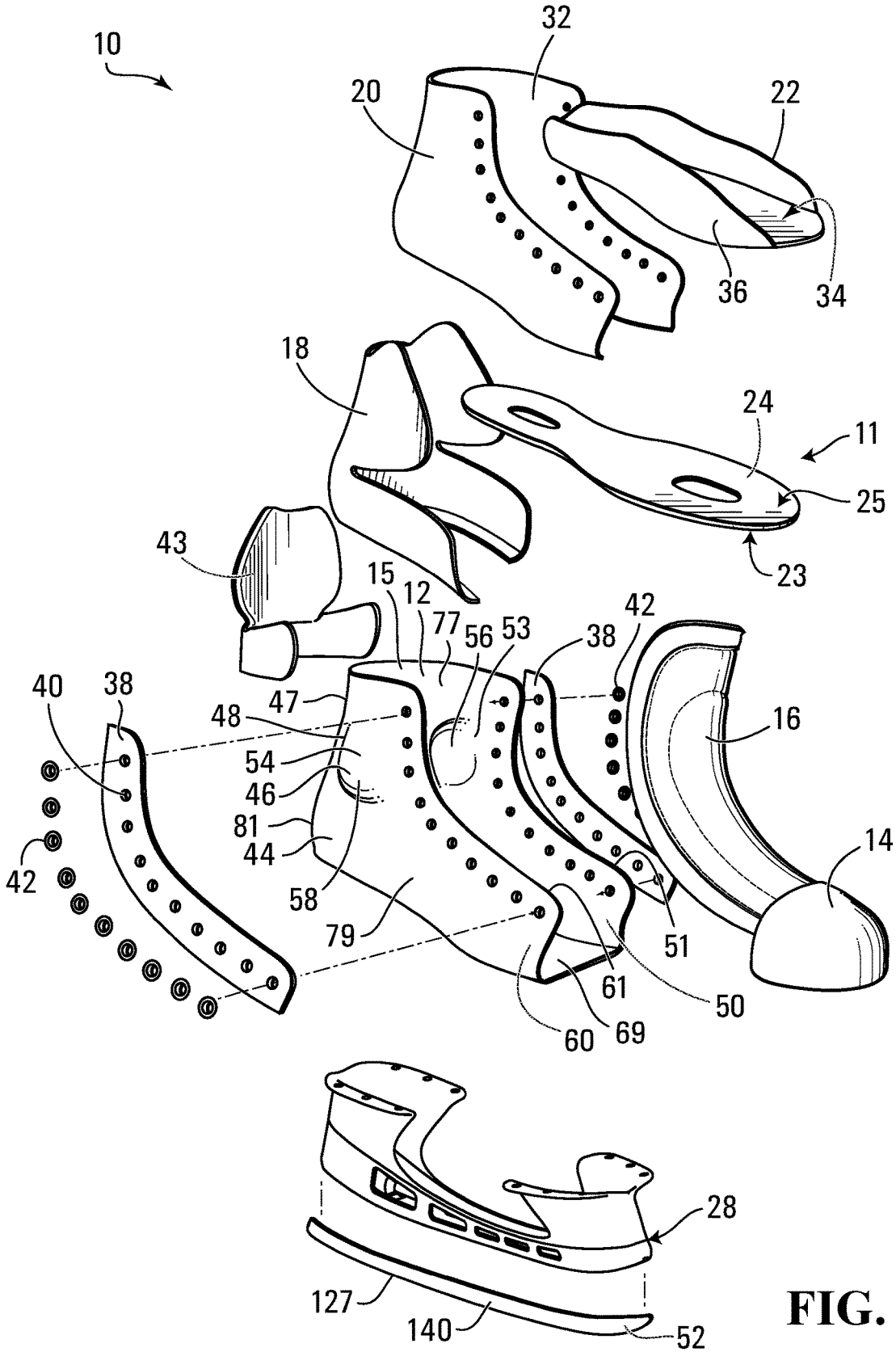
FIG. 1B is an exploded view of the skate of FIG. 1A including a skate boot, a blade holder, and a blade of the skate.
Figure 1C:
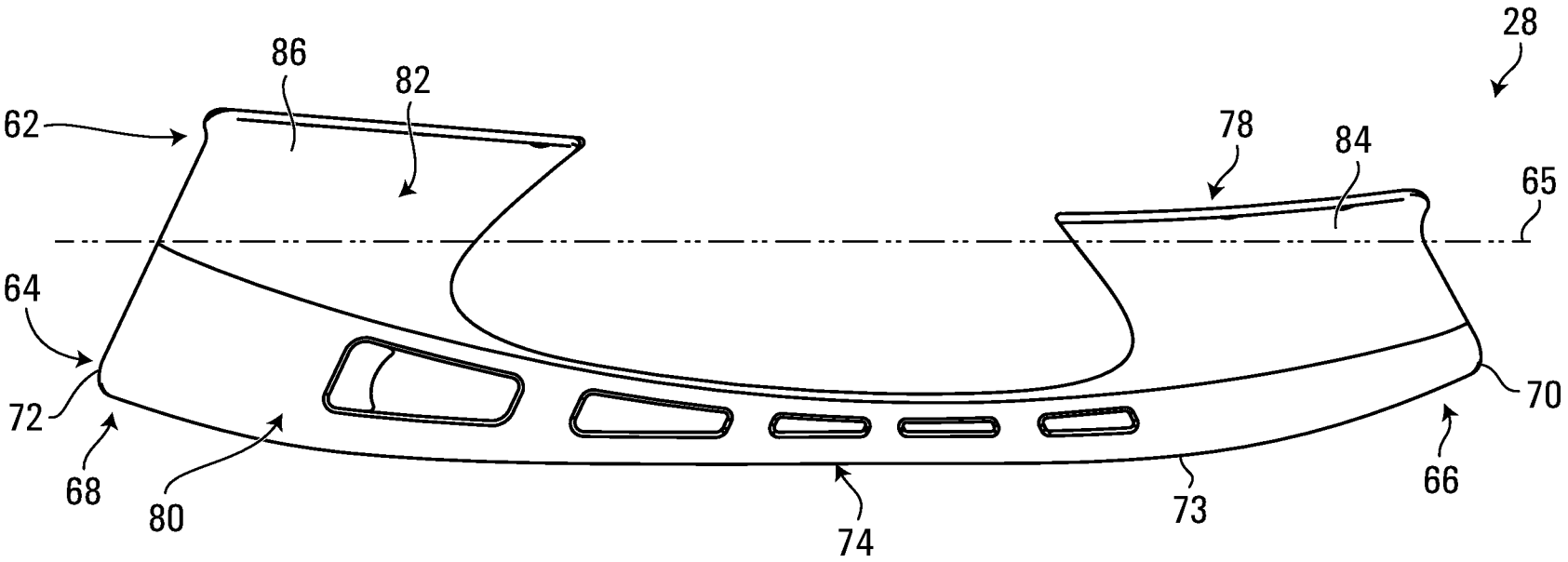
FIG. 1C is a side view of the blade holder of FIG. 1B.
Figure 1D:
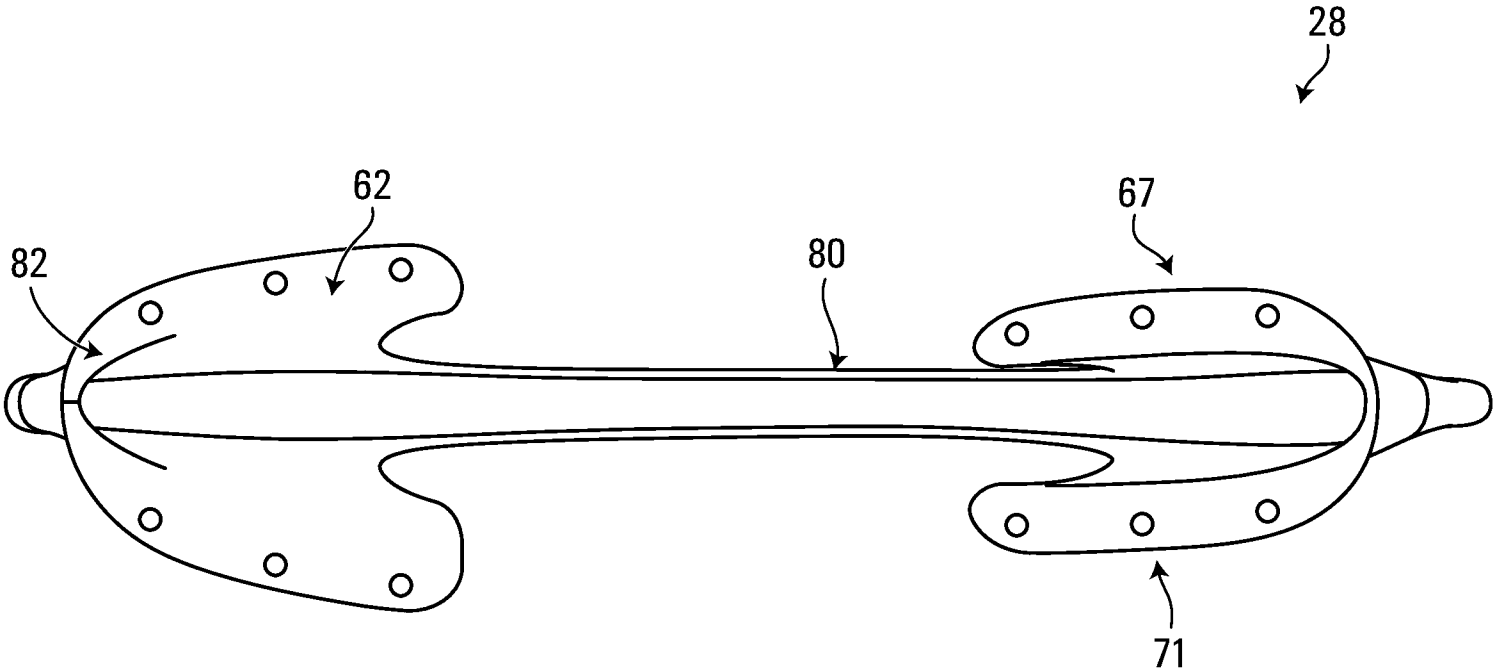
FIG. 1D is a top view of the blade holder of FIG. 1B.
Figure 1E:
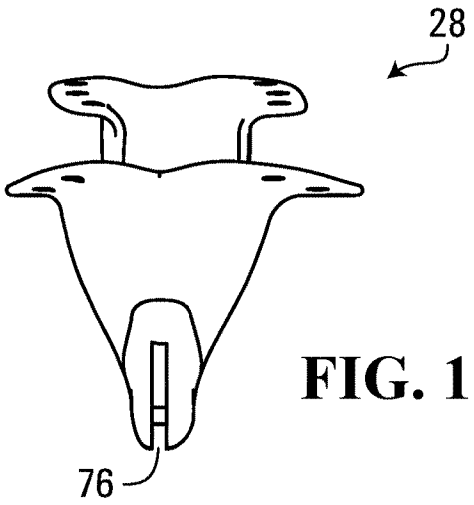
FIG. 1E is a front view of the blade holder of FIG. 1B.
Figure 1F:
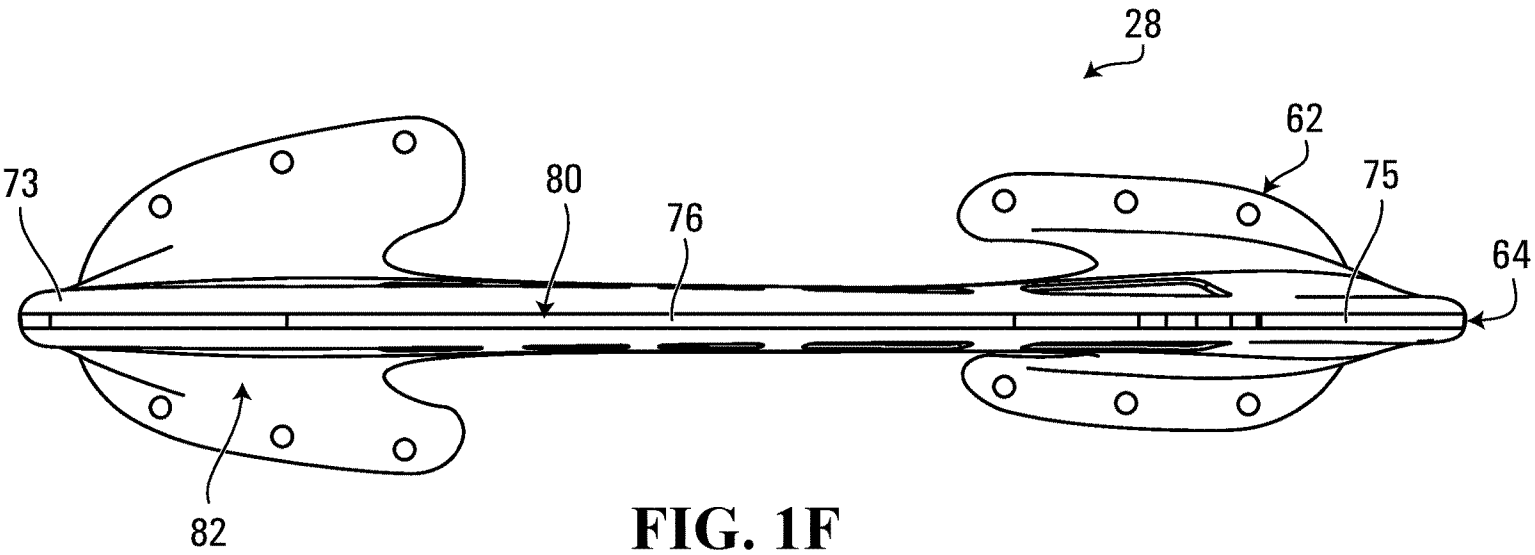
FIG. 1F is a bottom view of the blade holder of FIG. 1B.
Figure 18:
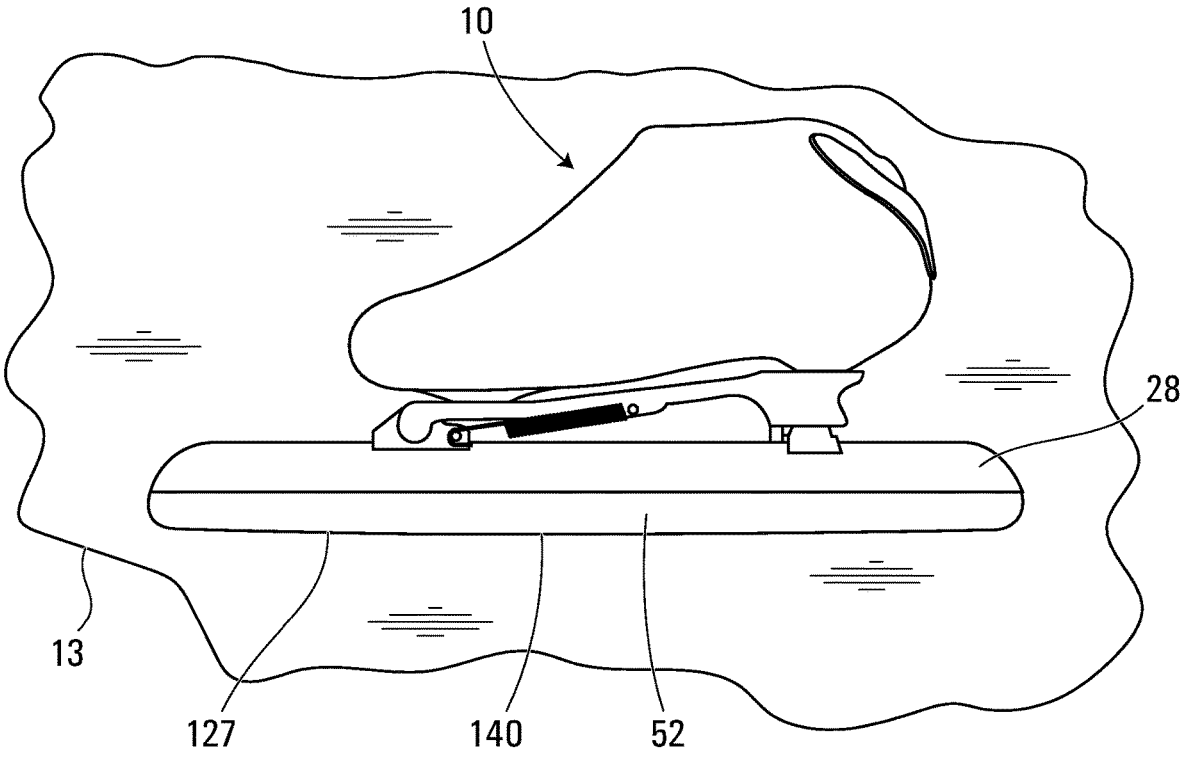
FIG. 18 is an embodiment of a skate for a speed skate user in accordance with a non-limiting embodiment of the present disclosure.

FIGS. 1A and 1B show an embodiment of a skate 10 for a user to skate on ice 13. In this embodiment, the skate 10 is a hockey skate for the user who is a hockey user playing hockey on the ice 13. In other embodiments, as shown in FIG. 18, the skate 10 may be a speed skate for the user who is a speed skater skating on the ice 13. In other embodiments, the skate 10 may be a figure skate, a bandy skate, a touring skate or any other skate for skating on the ice 13.

The skate 10 comprises a skate boot 11 for receiving a foot F of the user, a blade 52 (or "runner") for contacting the ice 13, and a blade holder 28 between the skate boot 11 and the blade 52 for holding the blade 52. The skate 10 has a longitudinal direction, a lateral (i.e., widthwise) direction, and a heightwise direction, so that each of the skate boot 11, the blade 52, and the blade holder 28 similarly has a longitudinal direction, a lateral direction, and a heightwise direction.

The blade holder 28 is configured to hold the blade 52 and transfer forces exerted by the user's foot F in the skate boot 11 towards the blade 52 and the ice 13. In this embodiment, with additional reference to FIGS. 1C, 1D,1E and 1F, the blade holder 28 comprises a body 78 including a lower portion 64 comprising a blade-retaining base 80 that retains the blade 52 and an upper portion 62 comprising a support 82 that extends upwardly from the blade-retaining base 80 towards the skate boot 11 to interconnect the blade holder 28 and the skate boot 11. A front portion 66 of the blade holder 28 and a rear portion 68 of the blade holder 28 define a longitudinal axis 65 of the blade holder 28. The front portion 66 of the blade holder 28 includes a frontmost point 70 of the blade holder 28 and extends beneath and along the user's forefoot in use, while the rear portion 68 of the blade holder 28 includes a rearmost point 72 of the blade holder 28 and extends beneath and along the user's hindfoot in use. An intermediate portion 74 of the blade holder 28 is located between the front and rear portions 66, 68 of the blade holder 28 and extends beneath and along the user's midfoot in use. The blade holder 28 comprises a medial side 71 and a lateral side 67 that are opposite one another.

Profile

Figure 1G:
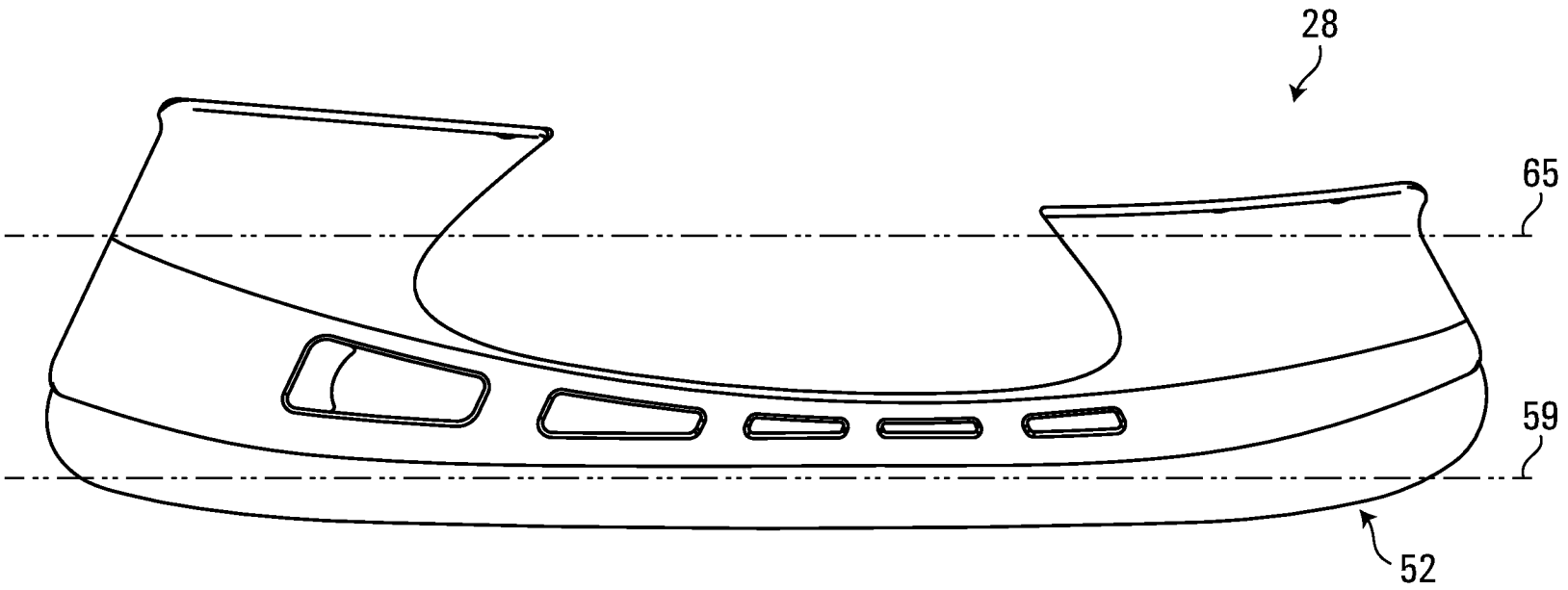
FIG. 1G is a side view of the blade held by the blade holder of FIG. 1B.
Figure 2A:
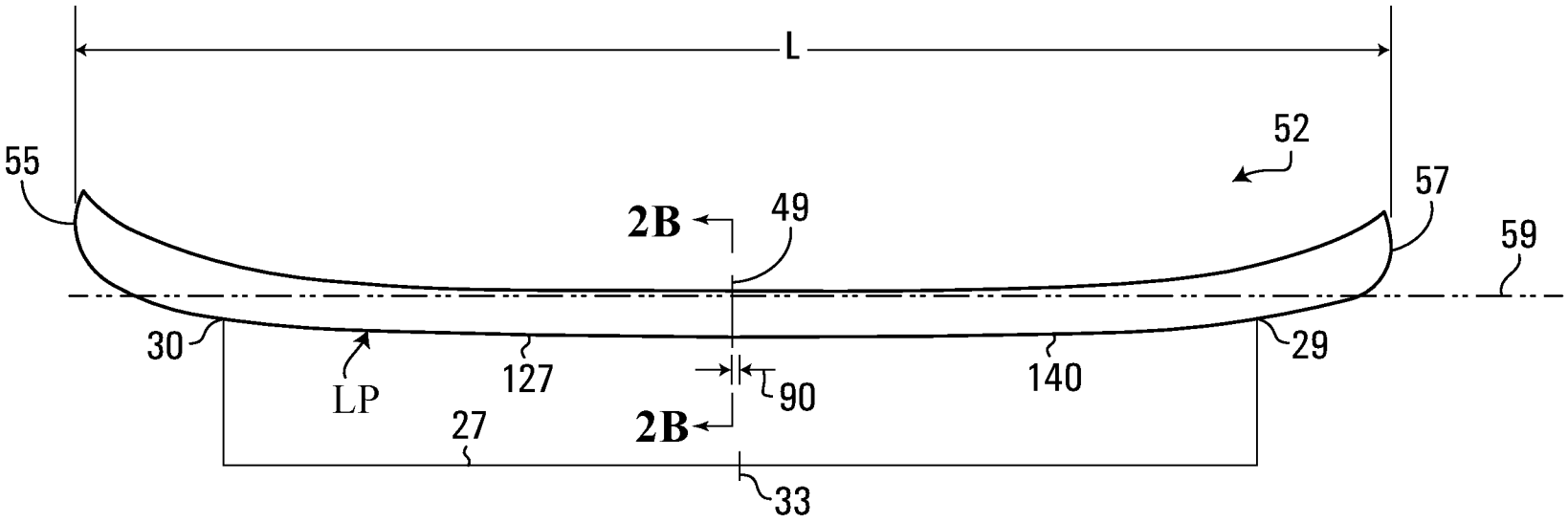
FIG. 2A is a side view of the blade of FIG. 1B.

Referring now to FIG. 2A, which shows a side view of the blade 52, the blade 52 is elongate along a longitudinal axis 59. As shown in FIG. 1G, when held by the blade holder 28, the longitudinal axis 59 of the blade 52 is parallel to the longitudinal axis 65 of the blade holder 28. The blade 52 has a front end 57 at the front 41 of the skate 10 (the front end 57 may also be referred to as a "toe end" of the blade 52) and a rear end 55 at the rear 45 of the skate 10 (the rear end 55 may also be referred to as a "heel end" of the blade 52); the distance between the front and rear ends 57, 55 of the blade 52 can be referred to as the length of the blade 52, denoted L. A longitudinal mid-point 49 of the blade 52 can also be defined as being half-way between the front and rear ends 57, 55 of the blade 52. In some cases, the longitudinal mid-point 49 of the blade 52 may be identified by a mark on the blade 52.

Figure 2B:
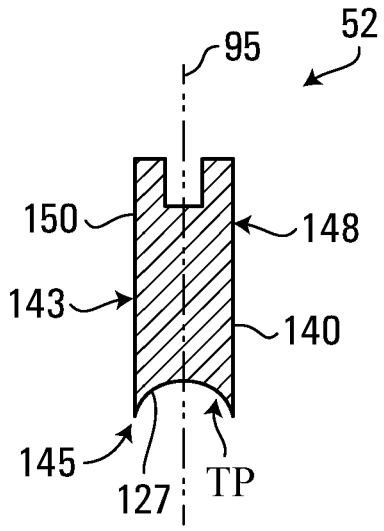
FIG. 2B is a cross-sectional view of the blade taken at a longitudinal mid-point of the blade, along line 2B-2B of FIG. 2A.

With continued reference to FIG. 2A (which shows a side view of the blade 52) and FIG. 2B (which shows a cross-sectional view at the longitudinal mid-point 49 of the blade 52), the blade 52 includes ice-contacting material 140 which defines a lateral surface 148 and an opposite lateral surface 143 (that is not visible in FIG. 2A). In this embodiment, the ice-contacting material 140 is a metallic material (e.g., stainless steel, titanium etc.), but the ice-contacting material 140 may be any other suitable material in other embodiments. The blade 52 also has an ice-contacting surface 127 that lies in a plane with a normal that is perpendicular to the normal of the lateral surfaces 148, 143 of the blade 52.

The ice-contacting surface 127 is used for sliding on the ice while the user skates, as well as for digging into the ice 13 to provide traction when the user accelerates, decelerates or changes directions. The ice-contacting surface 127 defines a contour of the ice-contacting material 140 when viewed from the side as in FIG. 2A; such contour is referred to as a "longitudinal profile" LP of the blade 52. When viewed in cross-section as in FIG. 2B, the ice-contacting surface 127 also defines a contour referred to as a "transverse profile" TP of the blade 52.

The longitudinal profile LP may have a generally convex shape and the transverse profile TP may have a generally concave shape.

Referring back to FIG. 2A, the blade 52 has a region of interest 27, which can generally be thought of as the subset of all sub-portions of the blade that would be in contact with the ice under a range of user positions and stances likely to be exhibited during use. The region of interest 27 has a beginning 29 (towards the front end 57 of the blade 52) and an end 30 (towards the rear end 55 of the blade 52). In most cases, the region of interest 27 spans a majority of the entire length L of the blade 52. For example, the region of interest may span between 60% and 90% of the length L of the blade 52. However, the region of interest 27 may span more than 90% of the length L of the blade, even up to the entire length L of the blade 52 (in which case the beginning 29 of the region of interest 27 coincides with the front end 57 of the blade 52 and the end 30 of the region of interest 27 coincides with the rear end 55 of the blade 52). In other cases, the region of interest 27 may span less than 60% of the length L of the blade 52, anywhere down to, e.g., 25% of the length L of the blade 52 or less.

The region of interest 27 may, but need not, be symmetrically disposed about the longitudinal mid-point 49 of the blade 52, in the longitudinal direction. The amount by which the longitudinal mid-point 33 of the region of interest 27 is offset from the longitudinal mid-point 49 of the blade 52 can be referred to as the "pitch" 90 of the longitudinal profile LP, as shown in FIG. 2A. In other cases, the pitch may refer to the amount by which the peak of curvature of the region of interest 27 is offset from the longitudinal mid-point 49 of the blade 52. In accordance with either definition, the pitch may, in various embodiments, be less than 5 mm, between 5 mm and 10 mm, less than 20 mm or even greater than 20 mm.

Figure 2C:
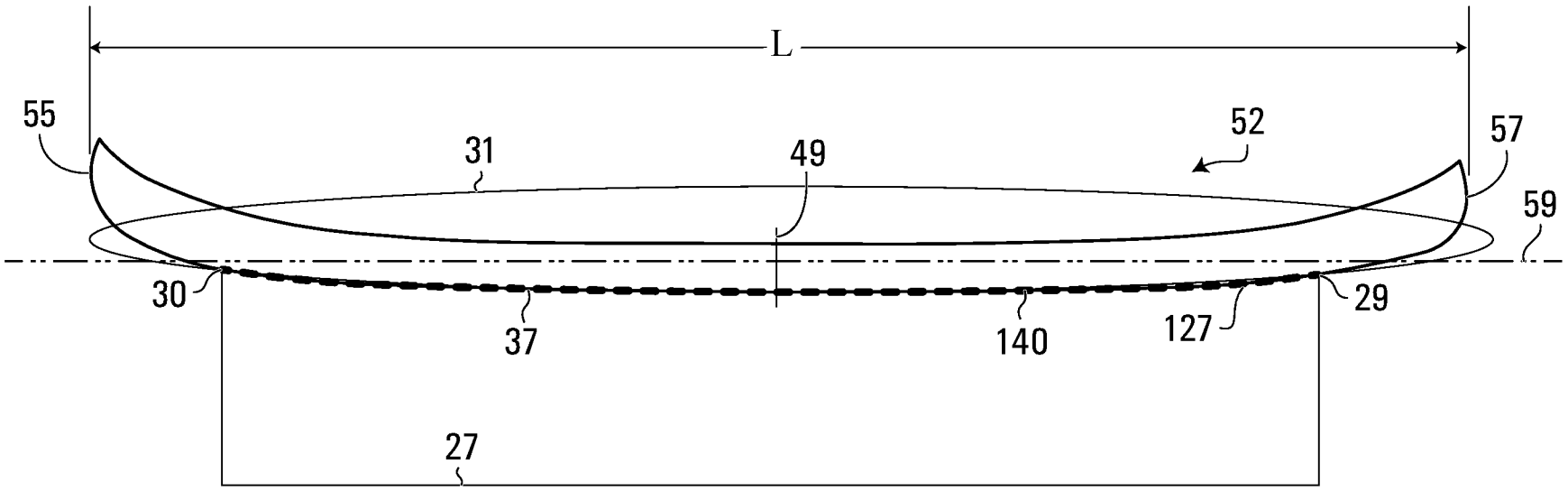
FIG. 2C is the blade with a profile in a region of interest defining an elliptical arc in accordance with a non-limiting embodiment of the present disclosure.
Figure 2D:
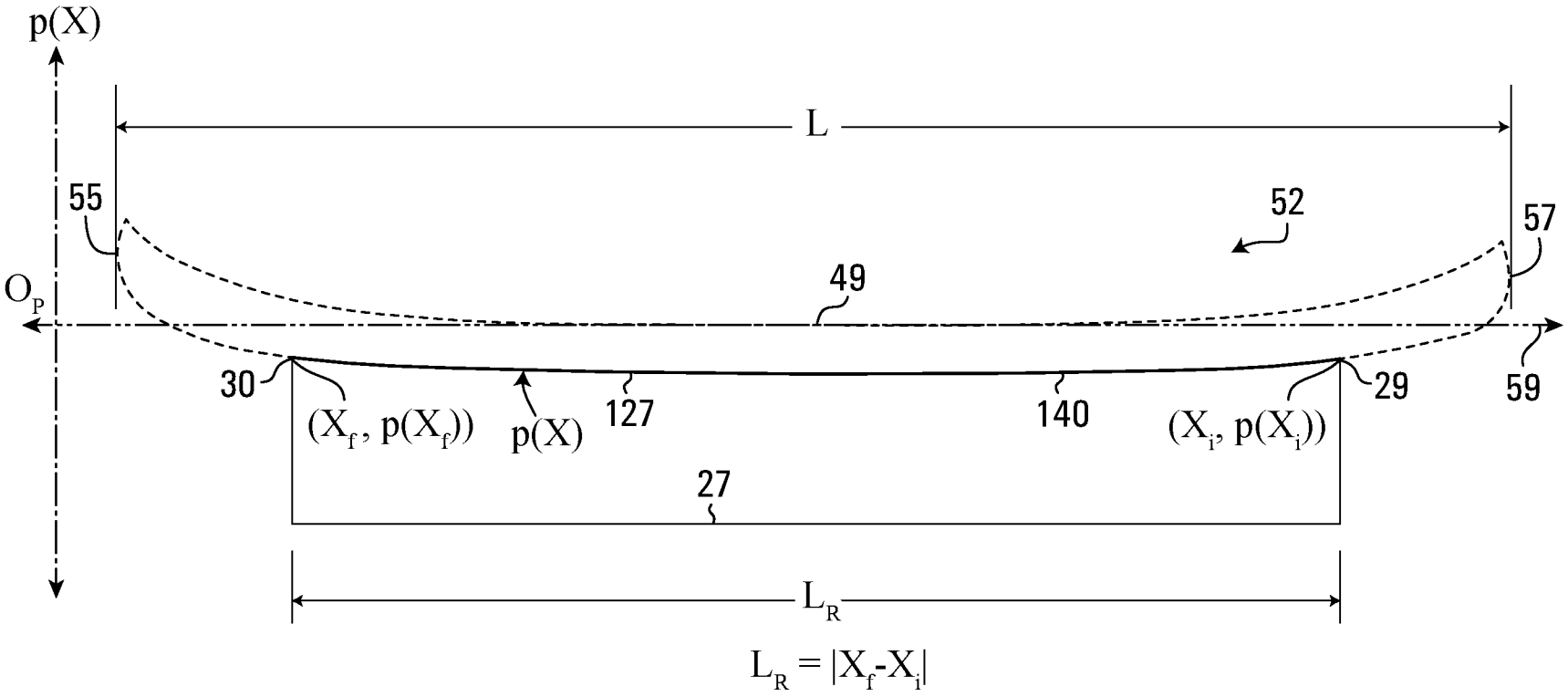
FIGS. 2D and 2E are representations of the profile of the blade in the region of interest of the blade as a profile function p(X)

Referring now to FIG. 2D, the longitudinal profile LP of the blade 52 in the region of interest 27 can be represented by a profile function p(X), where the X-axis is the longitudinal axis 59 of the blade 52. The initial value of X (i.e., $X_i$) represents the beginning 29 of the region of interest 27 and the final value of X (i.e., $X_f$) represents the end 30 of the region of interest 27. As such, the length of the region of interest 27 (denoted $L_R$) can be defined by $L_R=|X_f-X_i|$. The initial value of the profile function (i.e., $p(X_i)$) is arbitrarily set for convenience of illustration and $p(X_f)$ is the value of the profile function p(X) at the final value $X_f$ of the region of interest 27.

Figure 3:
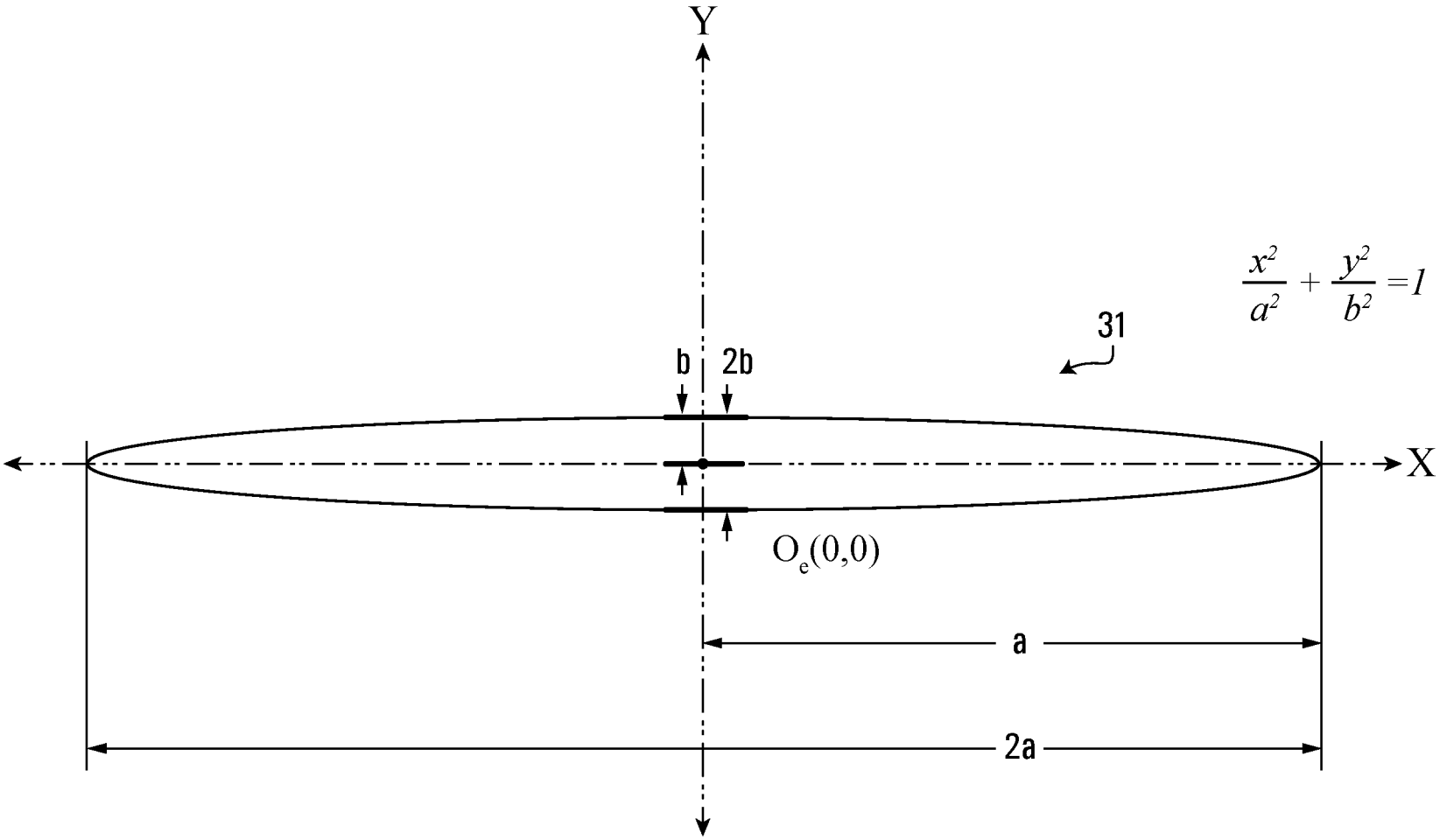
FIG. 3 is a diagram showing an ellipse centered at the origin of a Cartesian plane.

In a specific non-limiting embodiment, the longitudinal profile LP of the blade 52 in the region of interest 27 may define an elliptical arc 37, that is to say, an arc of an ellipse 31, as shown in FIG. 2C. Referring now to FIG. 3, the ellipse 31 is shown centered at the origin $O_e$ of a Cartesian plane ((x,y)=(0,0)) and can be analytically defined by the following equation:

$$\frac{x^2}{a^2}+\frac{y^2}{b^2}=1$$

where 2a is the length of the major axis and 2b is the length of the minor axis. An elliptical arc 37 corresponding to a certain length along the X-axis can thus be defined by the values of a and b, as well as an initial X-value of the arc 37 and a final X-value of the arc 37.

Figure 2E:
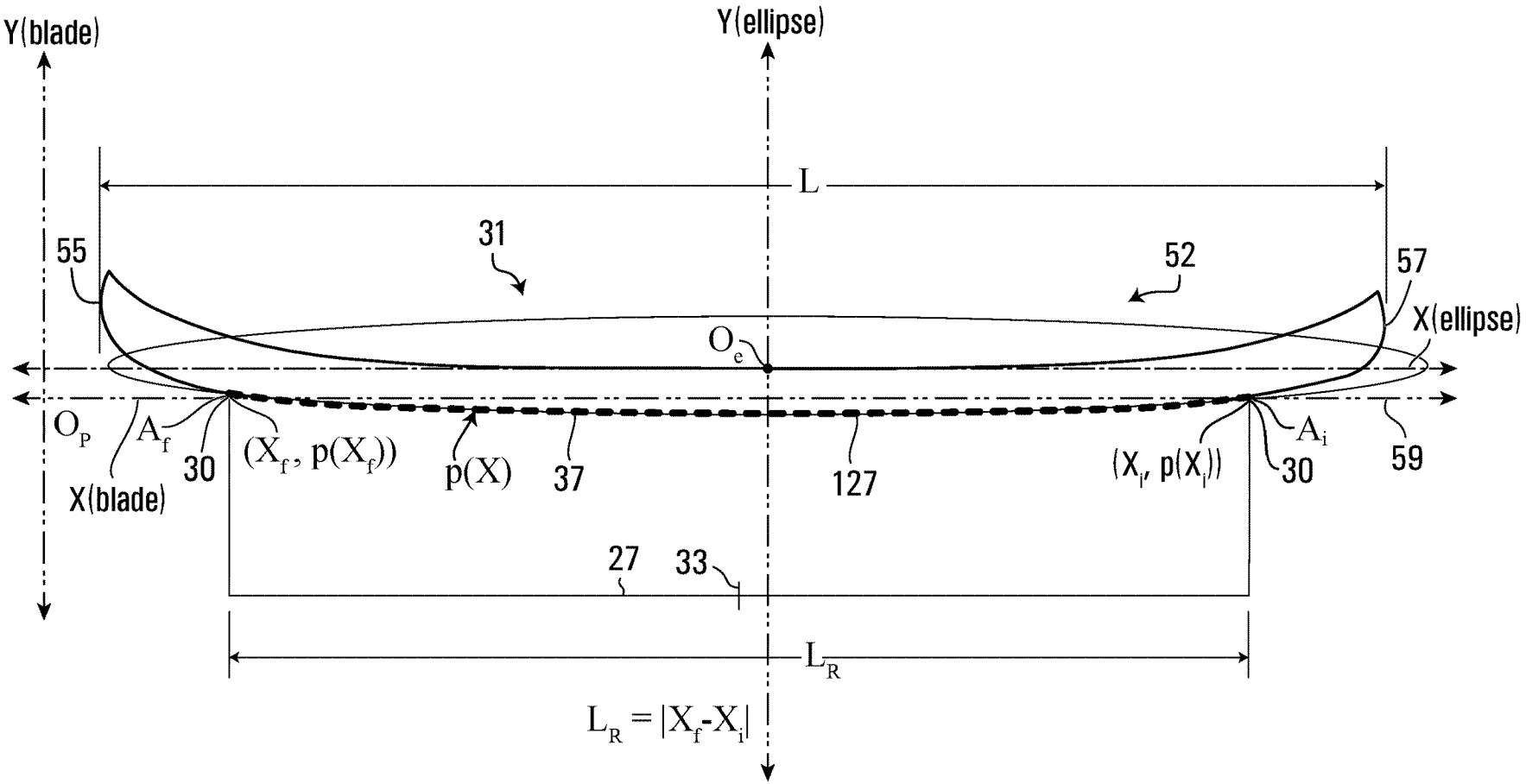

Referring now to FIG. 2E, there is shown an elliptical arc 37 that corresponds to the longitudinal profile LP in the region of interest 27 of FIG. 2D, wherein it is recalled that the region of interest 27 has a length $L_R=|X_f-X_i|$. The elliptical arc 37 is part of an ellipse 31 with major axis of length 2a and minor axis of length 2b. The initial X-value of the elliptical arc 37 is $A_i$ and the final X-value of the elliptical arc 37 is defined by $A_f$. Of course, $A_f$ is related to $A_i$ by $A_f=A_i+L_R$. In other words, $A_f-A_i=X_f-X_i=L_R$. Although the origin $O_p$ of the graph of the profile function p(X) is not the origin $O_e$ of the ellipse, this is simply an arbitrary offset and is inconsequential.

By designing the longitudinal profile LP of the blade 52 to follow an elliptical arc (such as the elliptical arc 37) in the region of interest 27, the resulting skate 10 allows the user to transition back and forth between a first skating mode in which the user swiftly accelerates or changes directions when leaning forward, and a second skating mode in which the user takes power strides, in a seamless manner without feeling any transitions underfoot.

Those skilled in the art will appreciate that when designing the longitudinal profile LP of a given blade 52, $A_i$ and $A_f$ can be selected from the same quadrant of the ellipse or from different quadrants (with the center of the ellipse being at the origin). Also, the region of interest 27 (bounded by $X_i$ and $X_f$) may be symmetrically disposed about the mid-point 49 of the blade 52, or it may not be. Additionally, the elliptical arc 37 may, but need not be symmetrical about a midpoint between $A_i$ and $A_f$. The interplay between $A_i$, $A_f$, $X_i$ and $X_f$ (with the above-mentioned constraint that $A_f-A_i=X_f-X_i=L_R$), combined with the previously described pitch 90 (the offset between the longitudinal mid-point 49 of the blade 52 and the longitudinal mid-point 33 of the region of interest 27) causes the wearer (in a given stance) to perceive more of a tilt forward or backward, as the case may be.

Radius of Curvature

The longitudinal profile LP of the blade 52 in the region of interest 27, as represented by the profile function (denoted p(X)), can be characterized as having a "radius of curvature" at each point along the X-axis. The radius of curvature at a given point of the longitudinal profile LP along the length L of the blade 52 (denoted c(X)) can be defined as the radius of a circular arc which best approximates the longitudinal profile LP at the given point.

In the case of an ellipse centered at the origin of the Cartesian plane, the radius of curvature c(X) is analytically defined by the following function:

$$c(X)=\frac{1}{a^4b^4}\sqrt{(a^4y^2+b^4x^2)^3}$$

where $y^2=b^2(1-x^2/a^2)$. The minimum radius of curvature of such ellipse occurs along the major axis and is given by $b^2/a$, and the maximum radius of curvature of the ellipse occurs along the minor axis and is given by $a^2/b$.

Figure 4A:
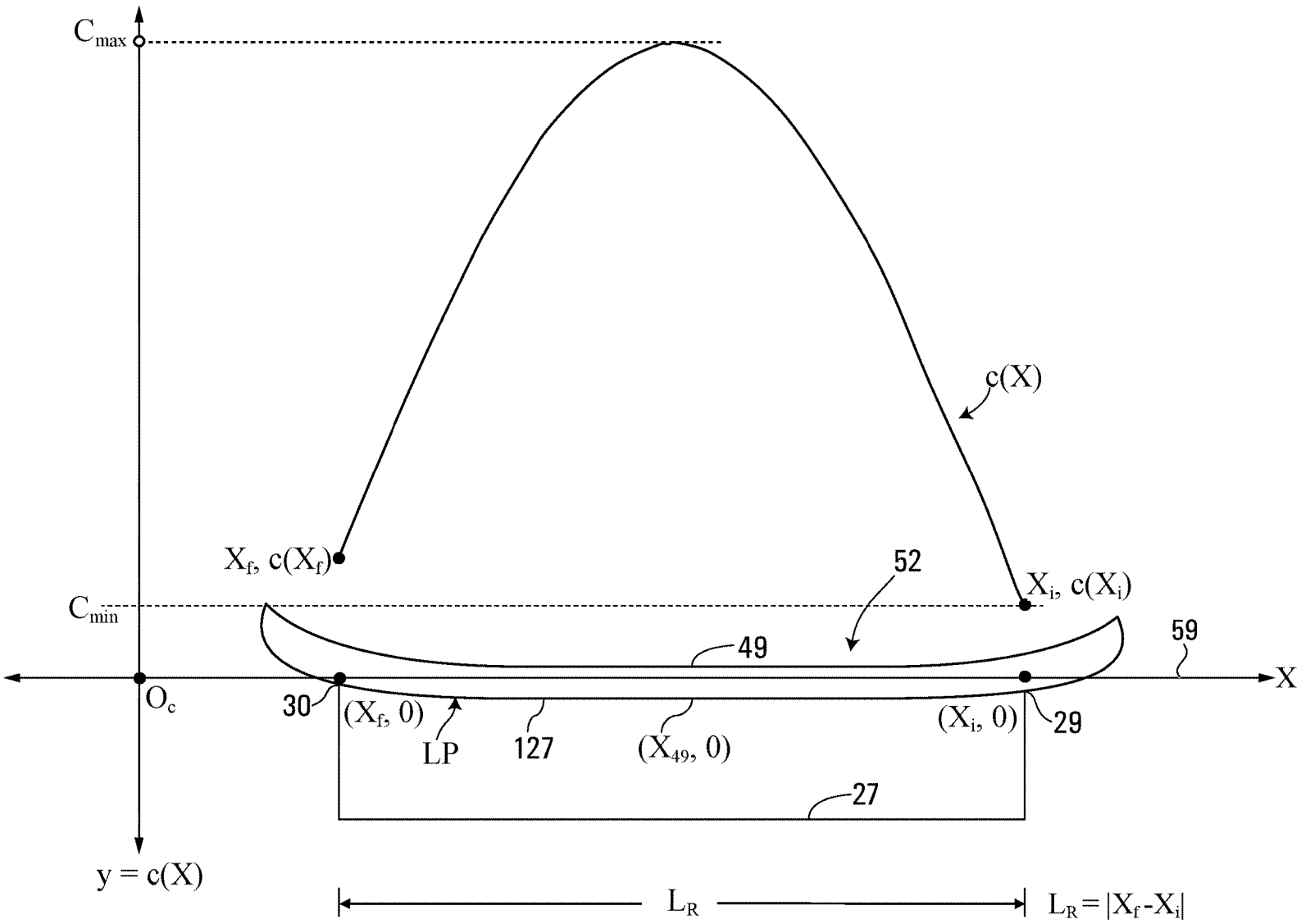
FIG. 4A is a plot of the radius of curvature of the profile function p(X) in the region of interest of the blade.

FIG. 4A conceptually shows a plot of c(X), which is the radius of curvature c(X) of the profile function p(X), between $X_i$ and $X_f$. As can be seen, the radius of curvature c(X) varies between a minimum value $C_{min}$ and a maximum value $C_{max}$. The spread between $C_{min}$ and $C_{max}$ divided by the length of the region of interest 27 ($L_R=X_f-X_i$) can be referred to as the effective slope (denoted $S_{eff}$) of the longitudinal profile LP. Therefore, the greater the spread and/or the shorter the length of the region of interest 27, the greater the effective slope $S_{eff}$.

It should be appreciated that if both $A_i$ and $A_f$ appear in the same quadrant (e.g., the third quadrant), the radius of curvature c(X) varies (e.g., increases, for example from a front 57 of the blade 52 to a rear 55 of the blade 52) monotonically, and $C_{min}$ and $C_{max}$ will represent the radii of curvature of p(X) at $X_i$ and $X_f$. However, if $A_i$ and $A_f$ appear in different quadrants, the radius of curvature c(X) does not vary monotonically, in which case $C_{min}$ and $C_{max}$ will not necessarily represent the radii of curvature of p(X) at $X_i$ and $X_f$.

Figure 4B:
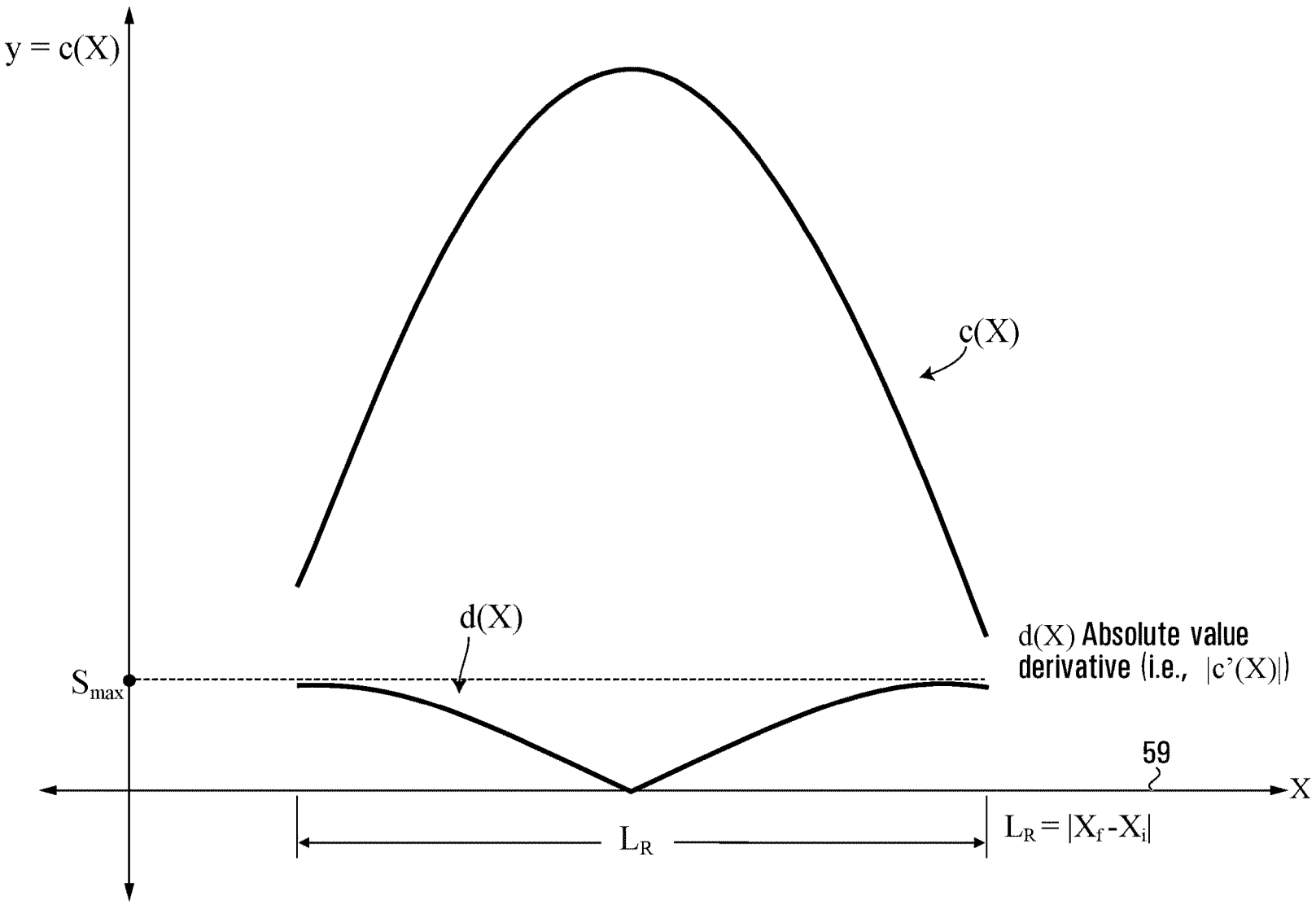
FIG. 4B is a plot of the absolute value of the first derivative of the radius of curvature of the function p(X) shown in FIG. 4A.

In addition to being varying, the radius of curvature c(X) is smoothly varying. For ease of understanding, and referring now to FIG. 4B, one may plot d(x), which is the absolute value of the first derivative of c(X). It is seen that d(X) is continuous, meaning that the radius of curvature c(X) is continuously differentiable. The radius of curvature c(X) therefore smoothly varies, i.e., is continuously differentiable, over the length $L_R$ of the region of interest 27. In addition, d(X), the absolute value of the first derivative of the radius of curvature c(X) of the profile function p(X), has a maximum value $S_{max}$, which is therefore the maximum slope of the radius of curvature.

Although the above description has focused on an embodiment wherein the longitudinal profile LP of the region of interest 27 is an elliptical arc 37, other embodiments of the present disclosure contemplate the longitudinal profile LP of the region of interest 27 being shaped differently, such as a parabolic arc and a hyperbolic arc, to name a few non-limiting possibilities, as well as other non-conical profile functions. In each of these relevant cases, a suitable profile function may provide a certain minimum amount of change in the radius of curvature over the region of interest 27 (determined through its effective slope $S_{eff}$) and a certain smoothness over the region of interest 27 (determined through its maximum slope $S_{max}$). Accordingly, the radius of curvature of a suitable profile function has an effective slope $S_{eff}$ (which can be given in, e.g., units of radius per unit of blade length) that is bounded from below by a threshold minimum value $S_{eff_min}$, and a maximum slope $S_{max}$ (which can also be given in, e.g., units of radius per unit of blade length) that is bounded from above by a threshold maximum value $S_{max_max}$. For example, in various non-limiting embodiments, the effective slope $S_{eff}$ of the radius of curvature c(X) over the region of interest 27 may be at least as great as $S_{eff_min}$=1.18, and in other cases it may be at least as great as $S_{eff_min}$=1.25, whereas the maximum slope $S_{max}$ of the radius of curvature c(X) over the region of interest 27 may be less than $S_{max_max}$=17.14, and in other cases it may be less than $S_{max_max}$=16.75. With reference to FIG. 4D, there is shown a table 400 including values for $S_{eff_min}$, $S_{max_max}$, for regions of interest 27 of different lengths $L_R$ and for ellipses of different major and minor axes values a, b.

Figure 4C:
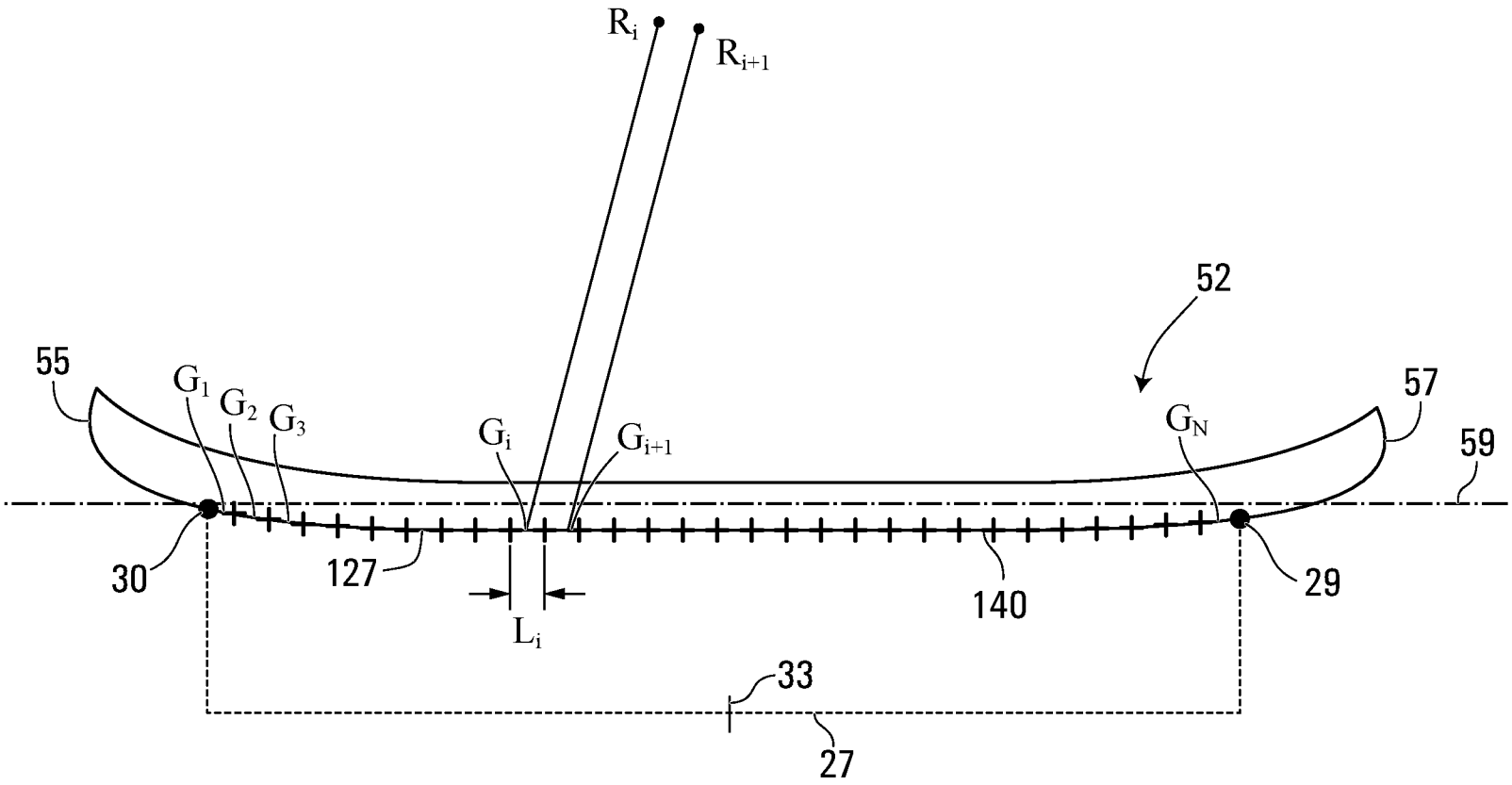
FIG. 4C is a representation of the profile of the blade in the region of interest as a number of short segments.
Figure 4E:
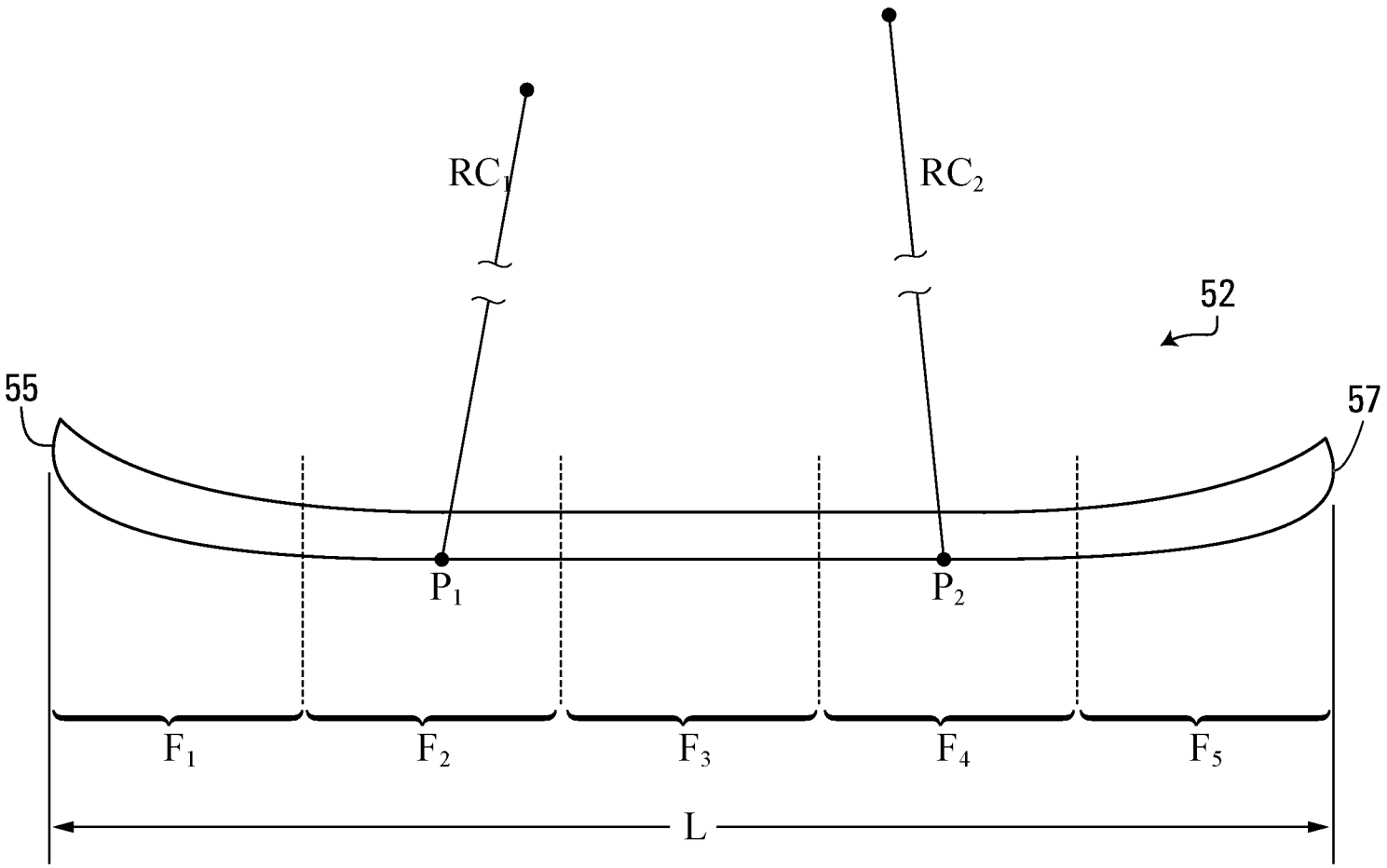
FIG. 4E is another embodiment of a profile of the blade.

Referring now to FIG. 4E, in accordance with another non-limiting embodiment, the length L of the blade 52 is shown to be divisible into five fifths $F_1$ of equal size ($F_1$, $F_2$, $F_3$, $F_4$, $F_5$). In this embodiment, the ice-contacting surface 127 of the blade 52 is longitudinally profiled to have a first radius of curvature $RC_1$ at a first point $P_1$ in the second fifth $F_2$ of the blade 52 and a second radius of curvature $RC_2$ at a second point $P_2$ in the fourth fifth $F_4$ of the blade 52. In this case, the second radius of curvature $RC_2$ is greater than the first radius of curvature $RC_1$. For example, the second radius of curvature $RC_2$ is greater than the first radius of curvature $RC_1$ by at least 10%. (It is to be understood that in other cases it is the second radius of curvature $RC_2$ that is less than the first radius of curvature $RC_1$.)

In the illustrated embodiment, the blade 52 is transition-zone-free between the first point $P_1$ and the second point $P_2$. The enables the user to imperceptibly shift between a position in which the user leans slightly more forward (and where more pressure is applied at the first point $P_1$ than the second point $P_2$) is to a second position in which the user leans slightly towards the rear (and where more pressure is applied at the second point $P_2$ than at the first point $P_2$).

Referring now to FIG. 4C, in another embodiment, the longitudinal profile LP may, over the region of interest 27 of length $L_R$, be made up of a large number N of short segments $G_i$ ($G_1, G_2, \ldots, G_N$) of length $L_i$ ($L_1, L_2, \ldots, L_N$) of constant but different radii of curvature $R_i$ ($R_1, R_2, \ldots, R_N$) whereby the ratio of radii of curvature $R_i$ of all pairs of adjacent segments (i.e., for $G_i$ and $G_{i+1}$ where i is in 1 to N−1, within the region of interest 27) is within a narrow band, such as +/−20%, in some cases +/−10% and in some cases +/−5%. The ratio of the radius of curvature $R_i$ of each of the segments $G_i$ in the region of interest 27 to the radius of curvature $R_{i+1}$ of each adjacent one of the segments $G_{i+1}$ is between 0.9 and 1.1. Suitable examples of N include an integer greater than or equal to 8, 10, 12 or 20, to name a few non-limiting possibilities. In addition, each of $L_1$, $L_2$, $L_N$ (i.e., the length of each segment) may be of length no greater than $L_R$/N or L/N.

Profiling

In order to impart a suitable longitudinal profile LP to a subject blade 99 (i.e., a blade 99 having a contour 103 to be profiled so as to yield the longitudinal profile LP of the blade 52), a profiling apparatus 500 may be used. Accordingly, the subject blade 99 may be machined by the profiling apparatus 500 to have a desired longitudinal profile LP with the aforementioned features in a region of interest 27 of the blade 52. For ease of reference, previously-defined features of the blade 52 that are common to the subject blade 99 will be ascribed the same reference numeral when referencing subject blade 99.

Figure 5A:
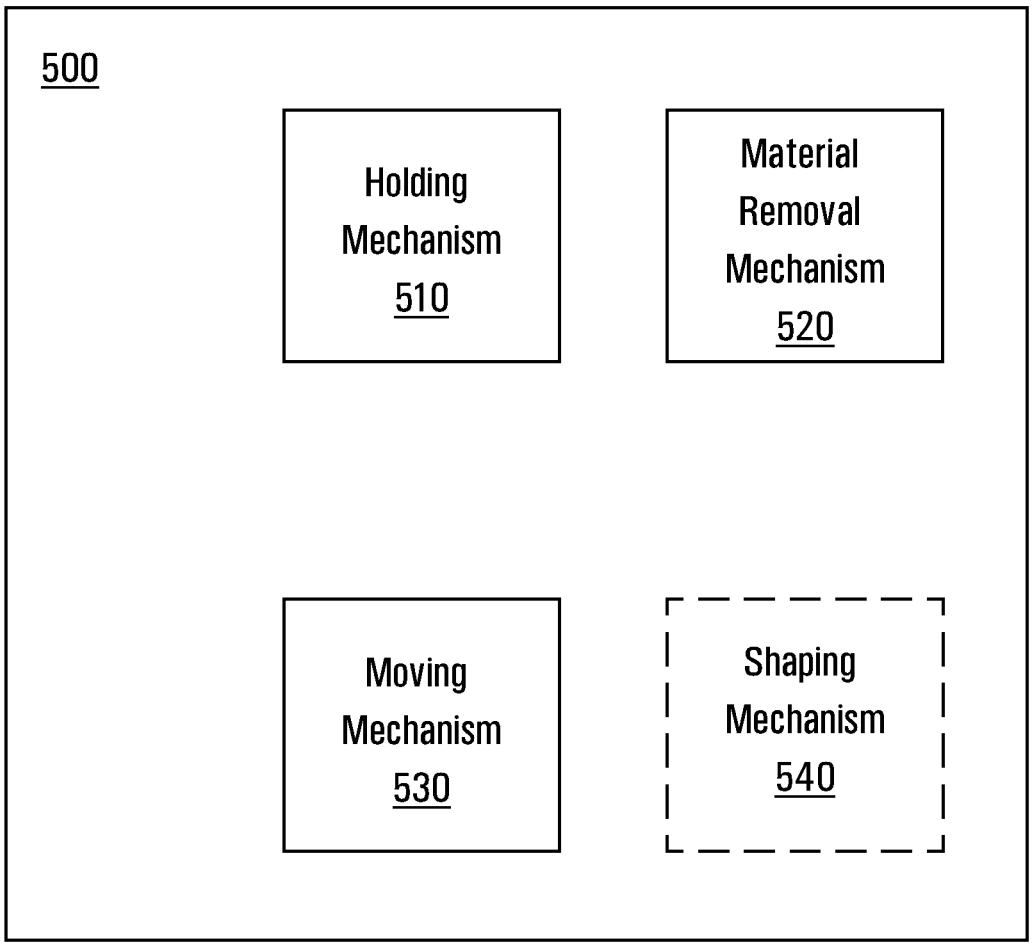
FIG. 5A is a block diagram showing various functional components of a profiling apparatus in accordance with a non-limiting embodiment of the present disclosure.

Referring to FIG. 5A, there is shown a block diagram including various functional components of a profiling apparatus 500 for machining one or more subject blades 99 simultaneously. The profiling apparatus 500 includes a holding mechanism 510 for holding one or more subject blades 99 and a material removal mechanism 520, which can be wheel- or belt-based. Removal of ice-contacting material 140 from the subject blade 99 is achieved when the material removal mechanism 520 contacts the ice-contacting surface 127 of the subject blade 99. As such, the profiling apparatus 500 includes a moving mechanism 530 for allowing relative movement between the holding mechanism 510 (which holds the one or more subject blades 99) and the material removal mechanism 520.

To ensure that the subject blade 99 acquires a desired longitudinal profile LP over a certain linear distance of the subject blade 99 (i.e., the region of interest 27), the profiling apparatus 500 uses a physical template or a digital template.

Physical Template Option

Figure 5B:
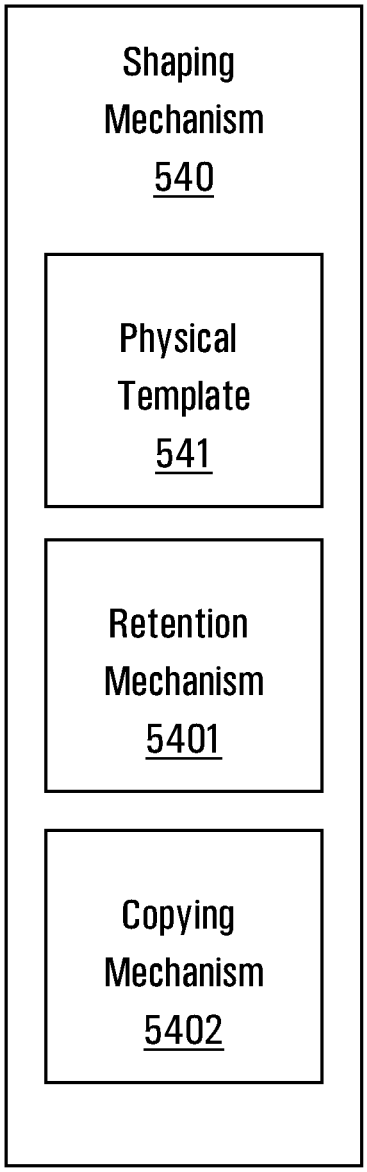
FIG. 5B is a block diagram showing components of a shaping mechanism of the profiling apparatus in accordance with a non-limiting embodiment of the present disclosure.
Figure 6:
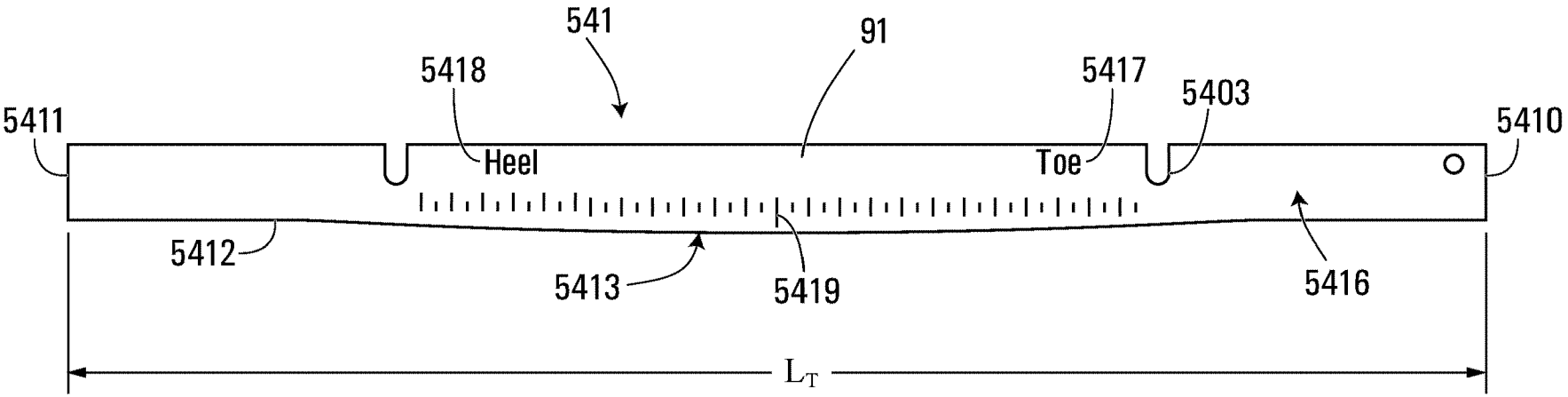
FIG. 6 shows a non-limiting embodiment of a physical template for profiling a subject blade blade.

The physical template option is described first with additional reference to FIGS. 5B and 6, whereby a shaping mechanism 540 is provided. The shaping mechanism 540 includes a physical template 541 for insertion into the profiling apparatus 500 adjacent the blade 52. The physical template 541 chosen for insertion is one having the desired longitudinal profile LP. The material removal mechanism 520 removes excess material 39 from the subject blade 99 that extends beyond the limits of the desired longitudinal profile LP to be imparted to the subject blade 99 based on the selected physical template 541.

Specifically, the physical template 541 has a first end 5410, a second end 5411 and a profiling side 5412 extending between the first and second ends 5410, 5411 of the physical template 541. The profiling side 5412 has a profile 5413 that is equivalent to a portion of an ellipse 31 such the profile 5413 has the shape of an elliptical arc 37. The physical template 541 can be seen to include a lateral surface 5416.

In some embodiments, the physical template 541 may include markings 5417 to assist the user profiling the subject blade 99. For example, the physical template 541 may include orientation marks 5418 on one or more surfaces of the physical template 541 (e.g., the lateral surface 5416 of the physical template 541) to assist the user of the profiling apparatus 500 in correctly placing the physical template 541 with respect to the profiling apparatus 500 and/or the subject blade 99 such that the physical template 541 is properly oriented with respect to the front and rear ends 57, 55 of the subject blade 99. For instance, the lateral surface 5416 of the physical template 541 near the first end 5410 may include the orientation mark 5418 "Front" or "Toe" and the lateral surface 5416 of the physical template 541 near the second end 5411 may be include the orientation mark 5418 "Rear" or "Heel". Additionally or alternatively, the physical template 541 may include graduation marks 5419 on the lateral surface 5416 of the physical template 541 used to position the physical template 541 with respect to the subject blade 99 such that the user of the profiling apparatus 500 may obtain repeatable results when profiling the subject blade 99.

Other markings 5417 for other purposes may also be included on the physical template 541. The markings 5417 may be produced in any suitable fashion. For example, the markings 5417 may be etched, printed or machined onto the lateral surface 5416 of the physical template 541. Though the markings 5417 are shown to be on the lateral surface 5416 of the physical template 541 in the illustrated embodiment shown in FIG. 6, it is understood that the markings 5417 may appear on any surface of the physical template 541, the markings 5417 may be of any shape and the markings 5417 may be omitted.

A length LT of the physical template 541 between the first and second ends 5410, 5411 of the physical template 541 may be about 400 millimeters, in some cases about 425 millimeters, in some cases about 450 millimeters, in some cases about 500 millimeters or any other suitable length. The length LT of the physical template 541 may be greater than the length L of the blade 52.

The length L of the subject blade 99 and the length $L_R$ of the region of interest 27 of the subject blade 99 may vary according to the size of the skate 10 or the type of skate 10 to which the subject blade 99 is to be used with. Accordingly, the profile 5413 of the profiling side 5412 of one physical template 541 may vary from one physical template 541 to another to accommodate a variety of skate sizes or types.

For example, the length L of a subject blade 99 for a child-sized skate may differ from the length L of a subject blade 99 for an adult-sized skate. In yet another example, the length L of a subject blade 99 for a hockey skate may differ from the length L of subject blade 99 for a speed skate. Moreover, the length L of a subject blade 99 for a short-track speed skate may differ from the length L of a subject blade 99 for a long-track speed skate.

Additionally or alternatively, the length $L_R$ of the region of interest 27 of a subject blade 99 may for a child-sized skate may differ from the length $L_R$ of the region of interest 27 of a subject blade 99 for an adult-sized skate. Similarly, the length $L_R$ of the region of interest 27 of a subject blade 99 for a hockey skate may differ from the length $L_R$ of the region of interest 27 of a subject blade 99 for a speed skate. Moreover, the length $L_R$ of the region of interest 27 of a subject blade 99 for a short-track speed skate may differ from the length $L_R$ of the region of interest 27 of a subject blade 99 for a long-track speed skate.

Accordingly, a bank of physical templates 541 each having a variety of lengths LT and/or a variety of profiles 5413 of the profiling side 5412 may be provided to accommodate a variety of subject blades 99.

The physical template 541 comprises a template material 91. In some embodiments, the template material 91 may comprise a metallic material (e.g., steel such as carbon steel, alloy steel, stainless steel; iron such as cast iron, wrought iron, to name a few non-limiting examples). In other embodiments, the template material 91 may comprise a non-metallic material. One example could be a plastic material (e.g., acrylonitrile butadiene styrene (ABS), polypropylene, polyethylene such as high-density polyethylene (HDPE), polycarbonate (PC) materials, polyvinyl chloride materials). In yet other embodiments, the template material 91 may comprise a ceramic material (e.g., oxides such as alumina, beryllia, ceria, and zirconia; non-oxides such as carbides, borides, nitrides, and silicides). In yet other embodiments, the template material 91 may comprise composite materials (e.g., a particulate reinforced material, a fiber reinforced material). The template material 91 of the physical template 541 may comprise any other suitable material.

The physical template 541 may be manufactured using any suitable manufacturing techniques known in the art. For example, the physical template 541 may be manufactured using computer numerical control (CNC) machining techniques such as CNC milling. The physical template 541 may be manufactured using cutting techniques such as die cutting techniques, cutting with the use of electric, gas, plasma, laser or water ablation. The physical template 541 may be manufactured using casting techniques such as die casting, investment casting, polymer casting. The physical template 541 may be manufactured using molding techniques such as metal injection molding. The physical template 541 may be manufactured using die stamping or forging techniques. The physical template 541 may be manufactured using three-dimensional printing (3D printing) techniques such as fused deposition modeling (FDM), selective laser sintering (SLS), direct metal laser sintering (DMLS), metal binder jetting.

Figure 7A:
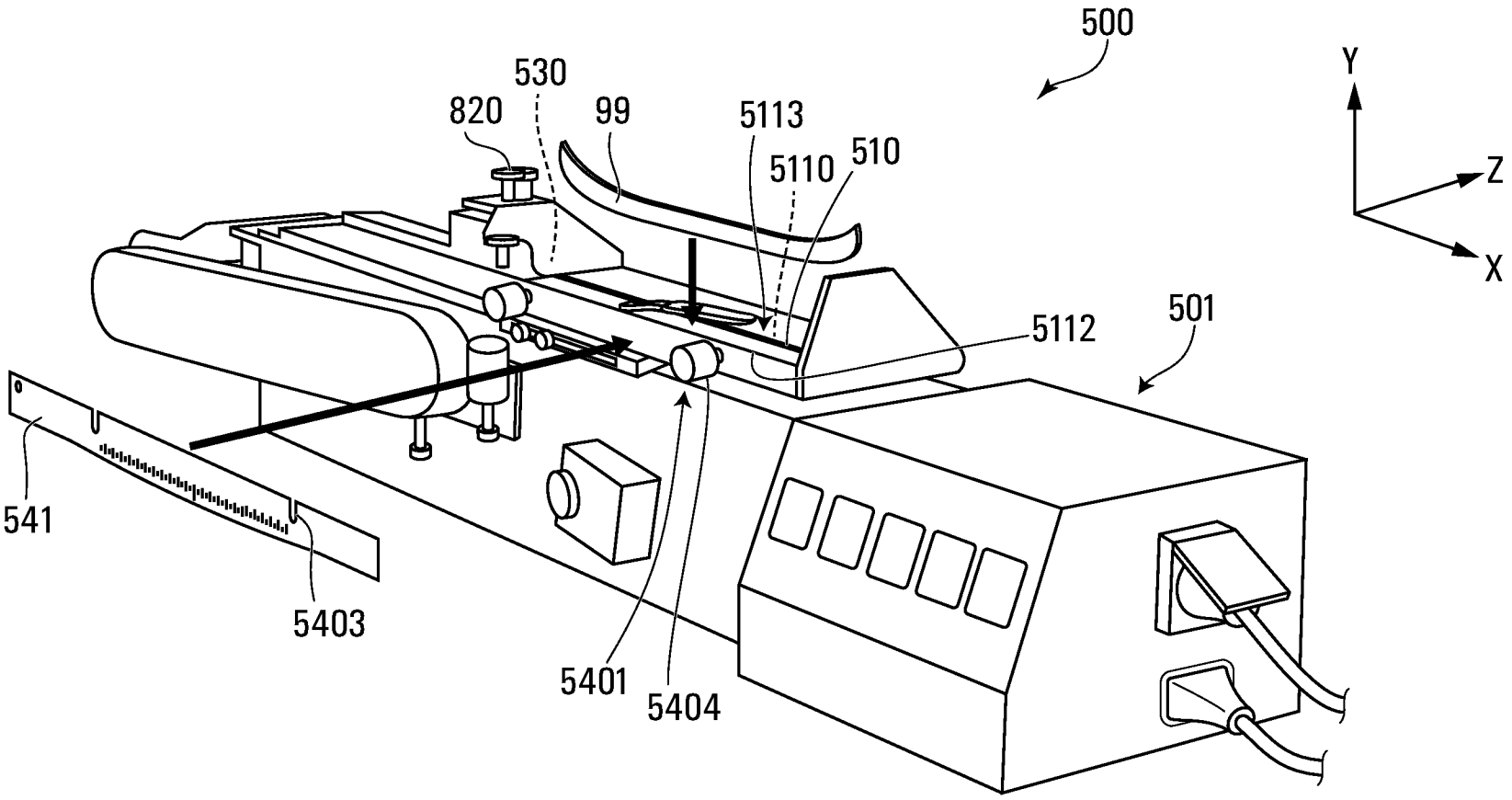
FIG. 7A is an exploded view of a physical template, the profiling apparatus and the subject blade.
Figure 7B:
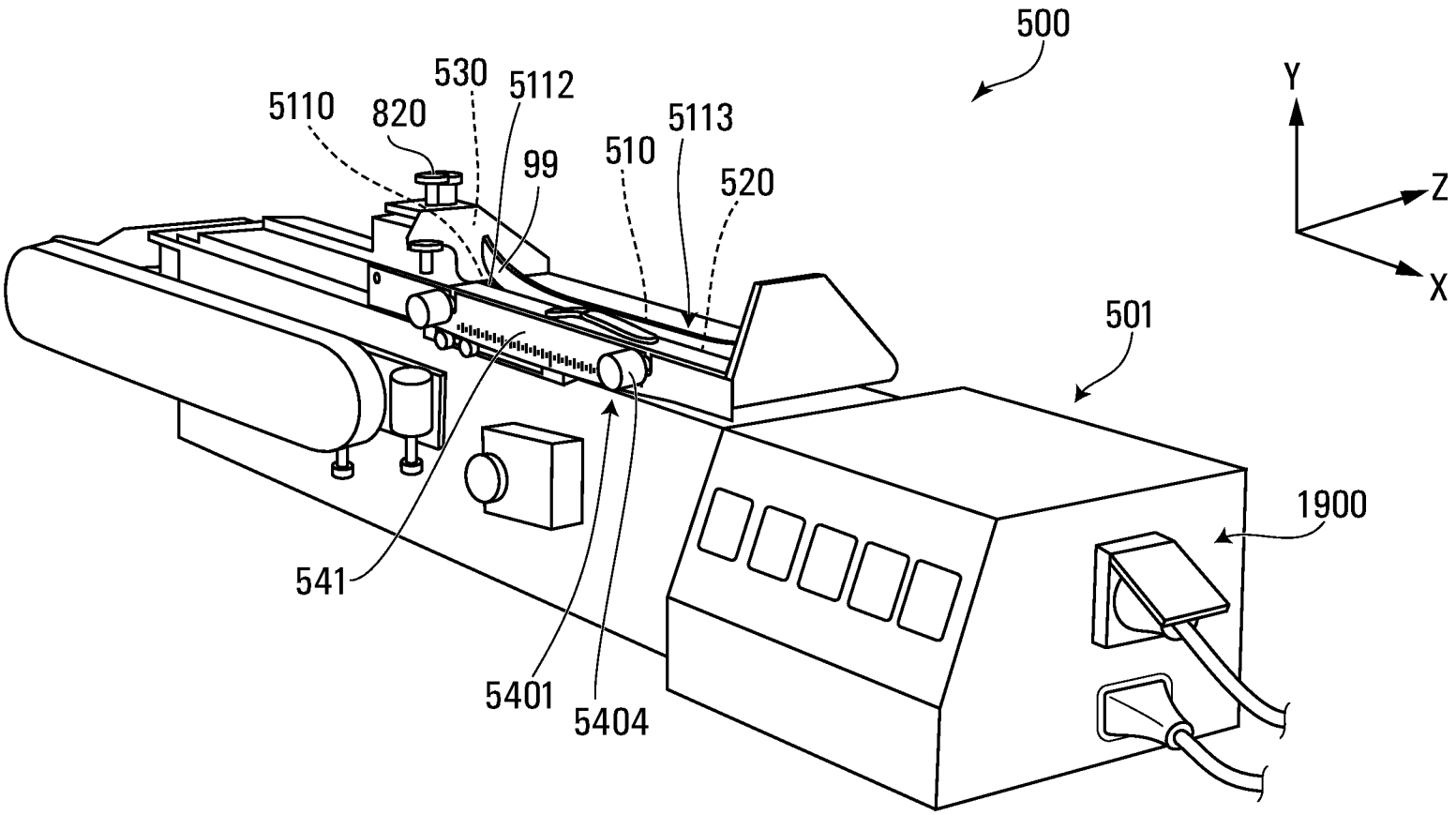
FIG. 7B is a view of the physical template mounted to the profiling apparatus and the subject blade inserted in the profiling apparatus.

With reference to FIGS. 7A and 7B, the physical template 541 is shown to be mounted to the profiling apparatus 500 in view of profiling the subject blade 99 which is inserted in the holding mechanism 510 of the profiling apparatus 500.

The shaping mechanism 540 includes a retention mechanism 5401 to removably mount (i.e., removably secure, hold or affix) the physical template 541 to the profiling apparatus 500.

Figure 7C:
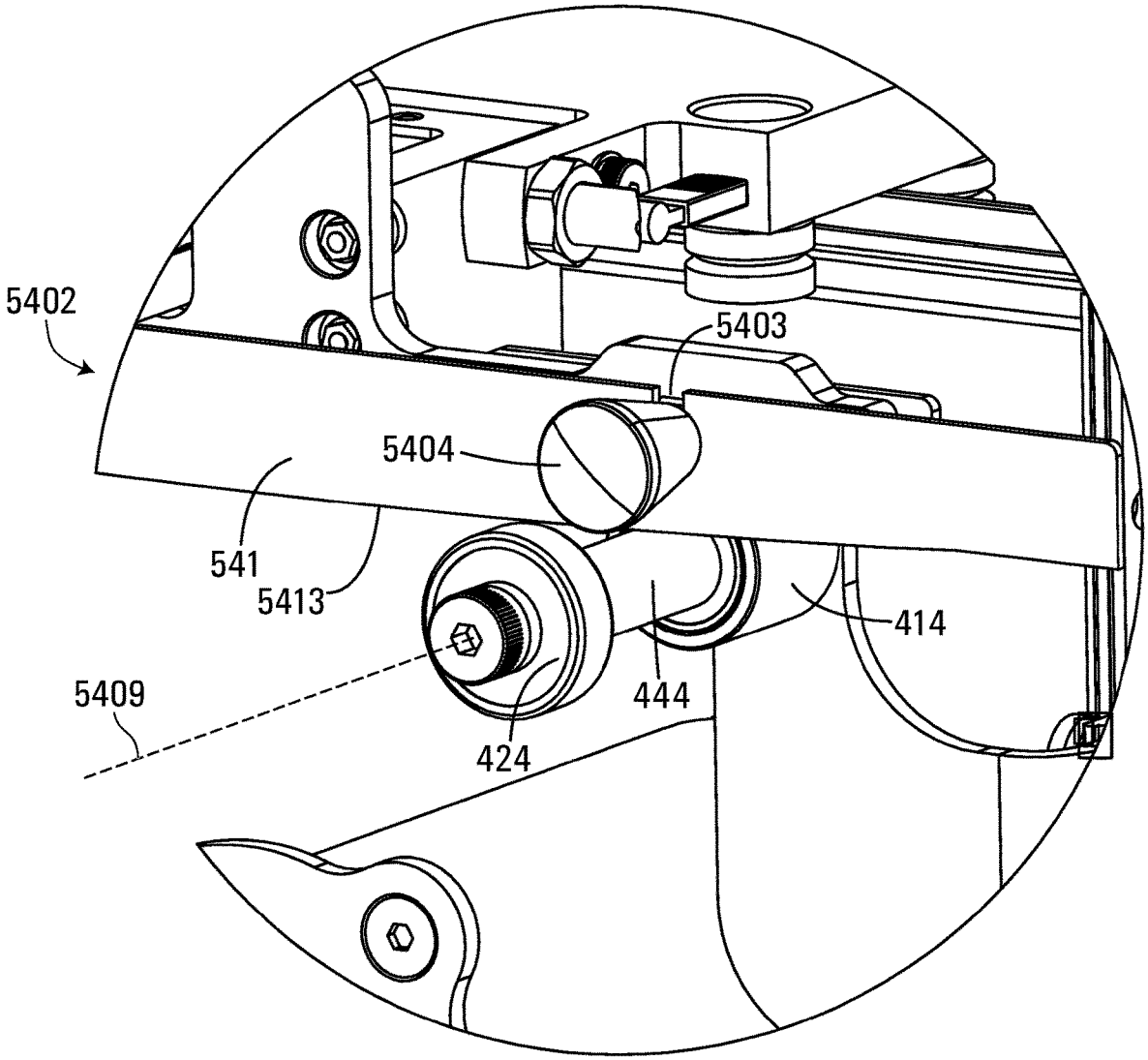
FIG. 7C is a view of a retention mechanism and a copying mechanism of the profiling apparatus in accordance with a non-limiting embodiment of the present disclosure.

In the illustrated embodiment of FIGS. 7A, 7B and 7C, the retention mechanism 5401 is configured to removably mount the physical template 541 to the holding mechanism 510 of the profiling apparatus 500. In this embodiment, the retention mechanism 5401 comprises knobs 5404 which may be tightened to secure the physical template 541 to the holding mechanism 510 of the profiling apparatus 500. In one example of implementation of this embodiment, a threaded elongate portion (not shown) of the knobs 5404 extends through recesses 5403 in the physical template 541 and rest at the bottom of the recesses 5403. The physical template 541 may be adjusted into position by turning an adjustment knob 448, mounted on the holding mechanism 510, to raise or lower the physical template 541 relative to the subject blade 99 (i.e., to adjust the physical template 541 in the y-direction in FIG. 7B). It is also possible to adjust the physical template 541 sideways (i.e., to adjust the physical template 541 in the x-direction in FIG. 7B).

Where an alternate longitudinal profile LP is desired on the subject blade 99, the physical template 541 is removed by turning the knobs 5404 and it may be replaced with a physical template 541 of the appropriate profile 5413.

In another embodiment, the retention mechanism 5401 comprises a magnetic coupling to secure the physical template 541 to the holding mechanism 510 of the profiling apparatus 500. In this case, the physical template 541 may be configured without the recesses 5403. In this example, the template material 91 of the physical template 541 is a ferromagnetic material and a portion of the holding mechanism 510 comprises one or more magnets configured to retain the physical template 541 via magnetic force.

It is to be understood that, in other embodiments, the retention mechanism 5401 may be configured to removably mount the physical template 541 to another portion of the profiling apparatus 500, for example a housing 501 of the profiling apparatus 500.

Figure 7D:
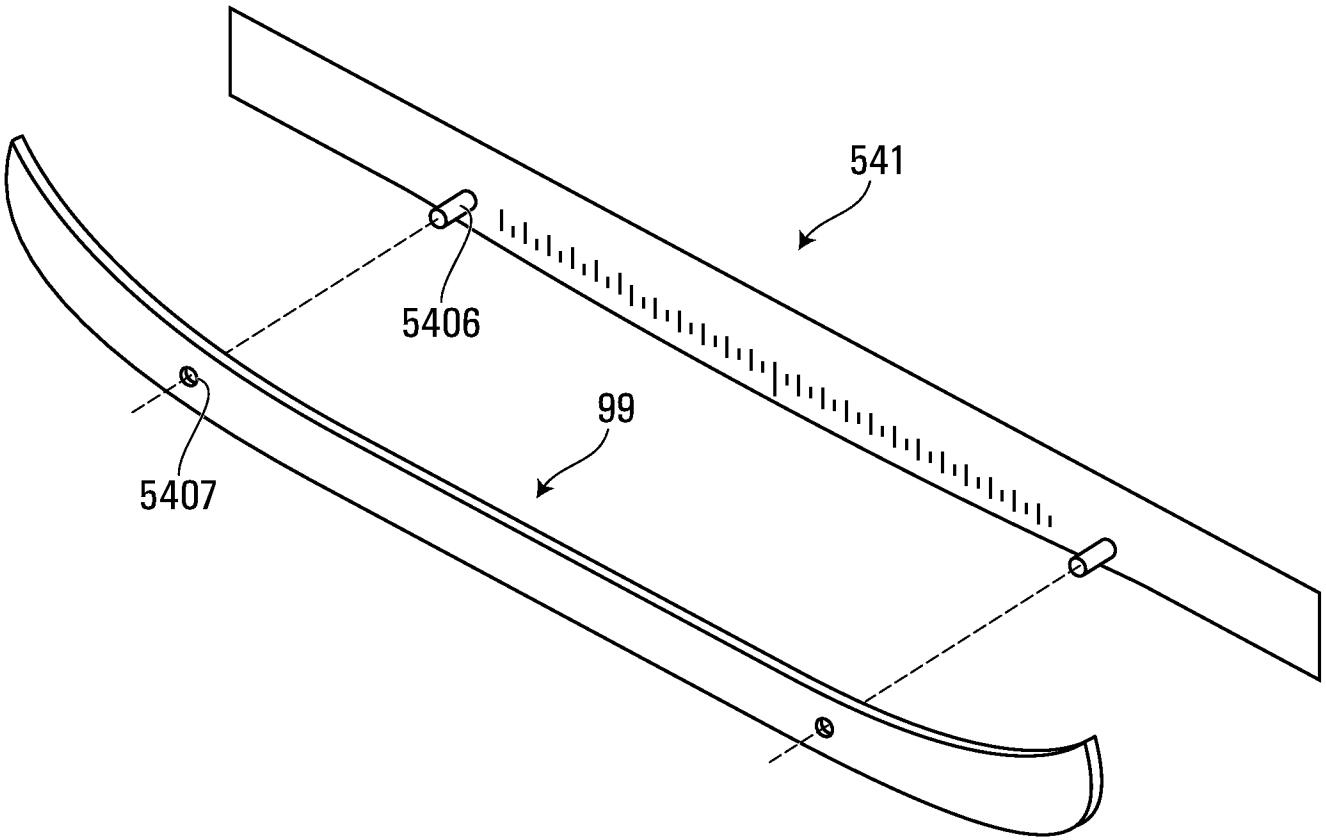
FIG. 7D is a view of the physical template affixed to the subject blade via a magnetic coupling in accordance with a non-limiting embodiment of the present disclosure.
Figure 7E:
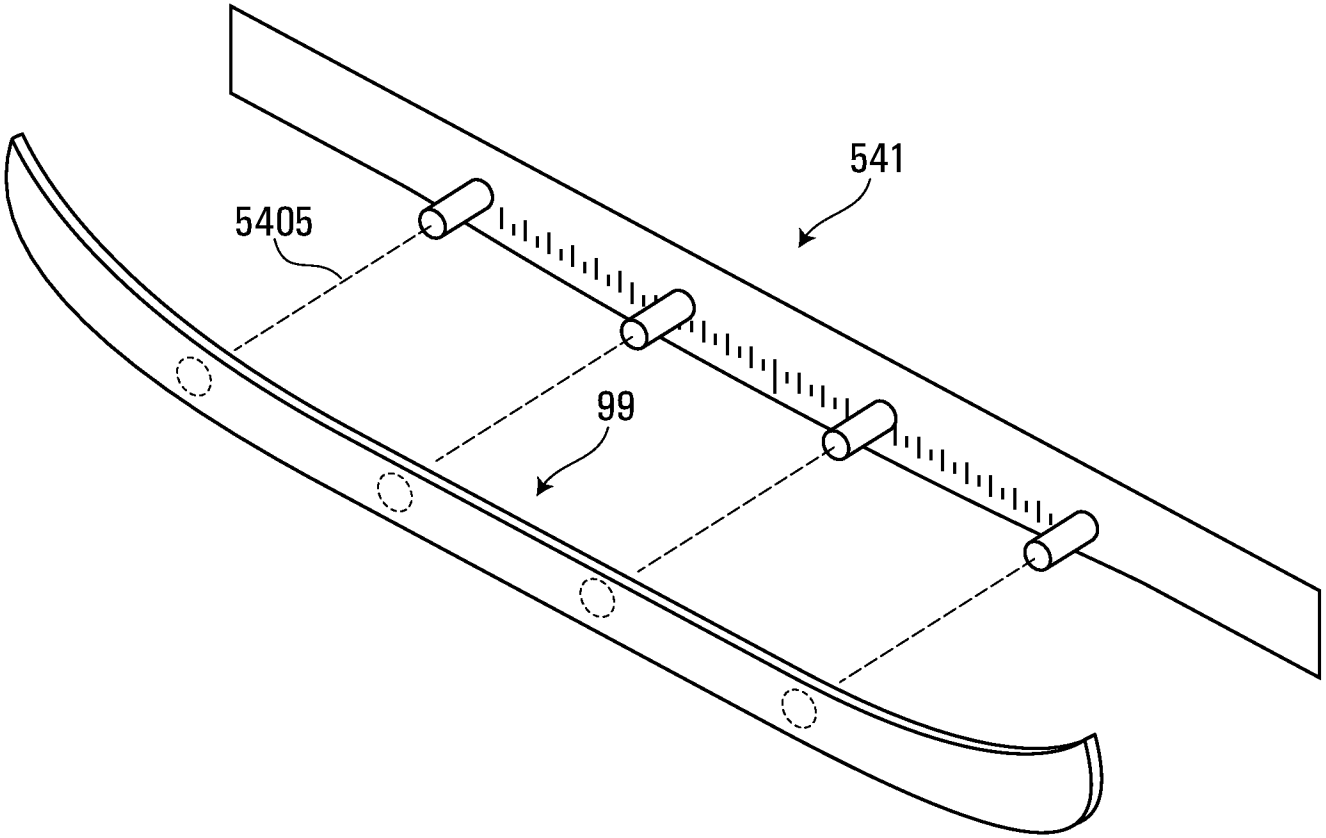
FIG. 7E is a view of the physical template affixed to the subject blade via a connection between recesses of the subject blade and protrusions of the physical template in accordance with a non-limiting embodiment of the present disclosure.

In yet other embodiments, the physical template 541 may be removably mounted to the subject blade 99 rather than the holding mechanism 510. In one example of implementation of this embodiment, the physical template 541 may be coupled to the subject blade 99 via a magnetic coupling 5405, as shown in FIG. 7E. In yet another example, the physical template 541 may include protrusions 5406 configured to engage with recesses 5407 in the subject blade 99 to couple the physical template 541 to the subject blade 99, as shown in FIG. 7D. It is understood that in other embodiments, the subject blade 99 may include the protrusions 5406 and the physical template 541 may include the recesses 5407 and the protrusions 5406 are configured to engage with the recesses 5407 to couple the physical template 541 to the subject blade 99.

Figure 7F:
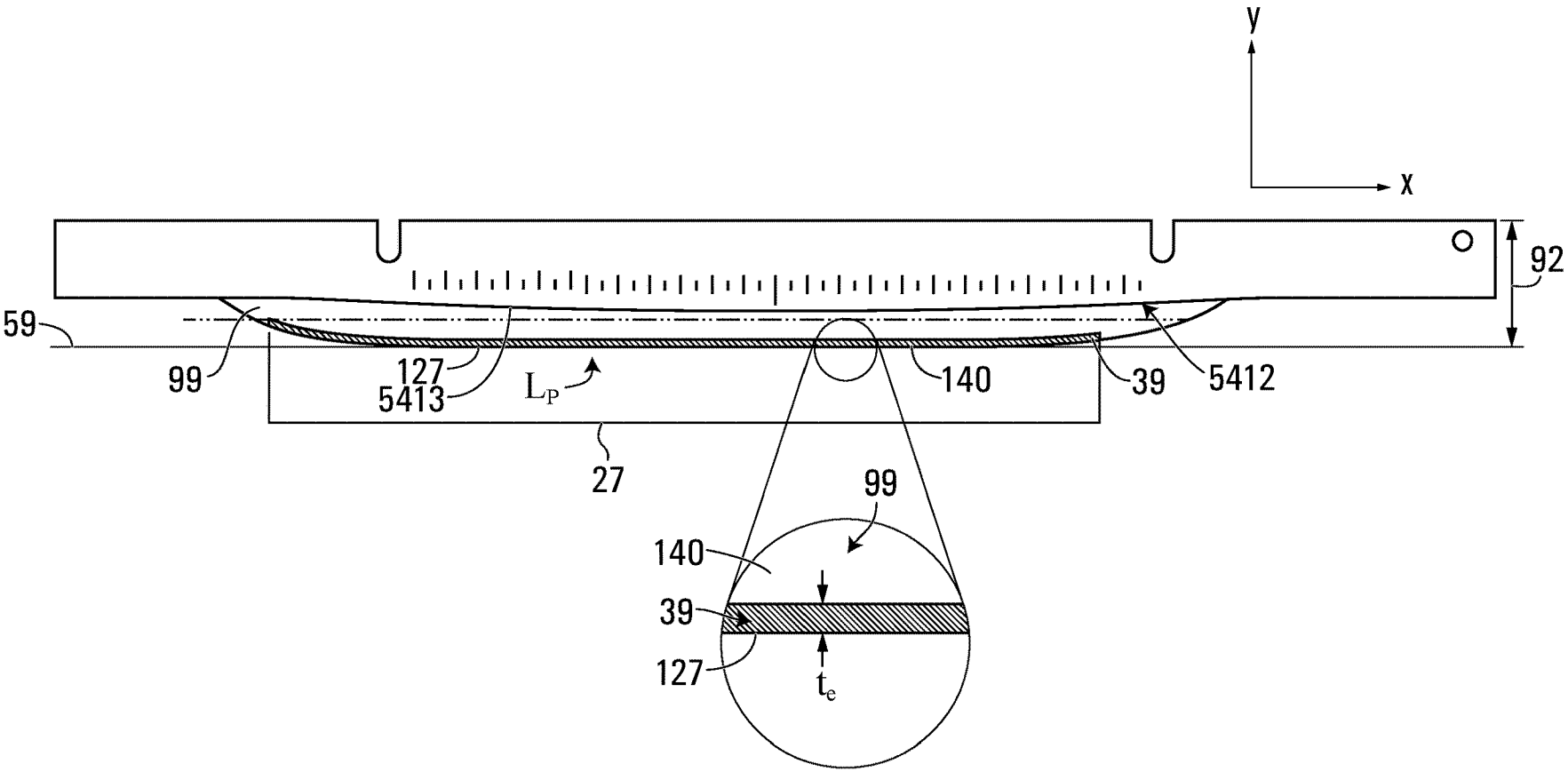
FIG. 7F is a view of the subject blade showing excess material to be removed from the subject blade based on a profile of the physical template.

With reference to FIG. 7F, there is shown a band of excess material 39 of the ice-contacting material 140 of the subject blade 99. The band of excess material 39 is the material to be removed from the subject blade 99 such that the profile 5413 of the physical template 541 is imparted to the contour 103 of the subject blade 99 to yield the blade 52 with a desired longitudinal profile LP. With further reference to FIG. 7F, the physical template 541 is shown in front of the subject blade 99 and is positioned vertically (in the y-direction, or heightwise direction) with respect to the subject blade 99. This vertical position of the physical template 541 with respect to the front of the subject blade 99 may be defined as a parameter referred to as a "vertical offset" 92. As can be appreciated, the vertical offset 92 and a maximum thickness to of the band of excess material 39 (in the y-direction) are related. For example, for some vertical offsets 92, the maximum thickness $t_e$ of the band of excess material 39 of the subject blade 99 may be greater than for other vertical offsets 92. It is to be appreciated that the maximum thickness $t_e$ of the band of excess material 39 may vary along the longitudinal axis 59 of the subject blade 99. It is also to be appreciated that the representation of the maximum thickness $t_e$ of the band of excess material 39 is exaggerated in FIG. 7F for clarity.

The vertical offset 92 is a parameter that may in some cases be controllable by the user of the profiling apparatus 500. For example, in some embodiments, the vertical offset 92 can be manually set when mounting the physical template 541 within the retention mechanism 5401. In some cases, the vertical offset 92 may be adjusted electronically through settings of the profiling apparatus 500. In yet other embodiments, the vertical offset 92 may be adjusted via the adjustment knob 448. In yet other embodiments, the vertical offset 92 can also be set automatically by the profiling apparatus 500 by comparing the maximum thickness $t_e$ of the band of excess material 39 and reducing (i.e., minimizing) this maximum thickness $t_e$ such that an optimal relative vertical position of the subject blade 99 and the physical template 541 is achieved. This optimal relative vertical position of the subject blade 99 and the physical template 541 is such that the maximum thickness $t_e$ band of excess material 39 is minimized.

To remove the band of excess material 39, the subject blade 99 is inserted in the holding mechanism 510 and brought into contact with a material removal device 5201 of the material removal mechanism 520 driven by a drive mechanism 5203 such that the material removal device 5201 removes material from the ice-contacting surface 127 of the subject blade 99.

Figure 7G:
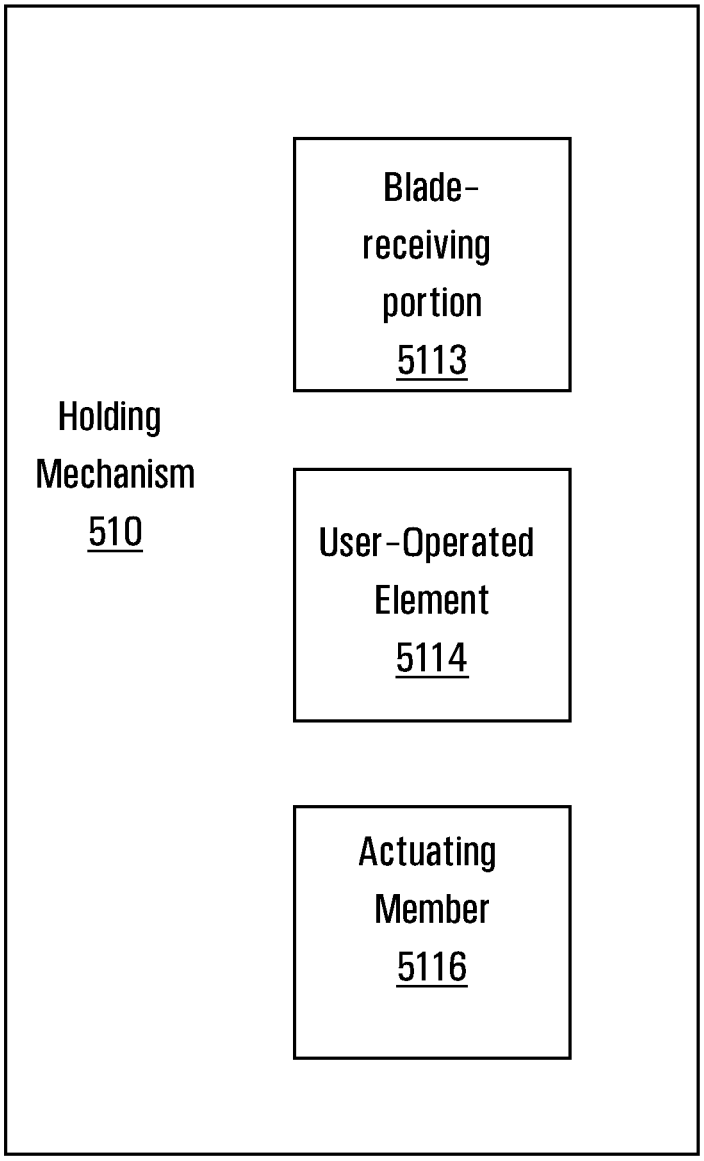
FIG. 7G is a block diagram including various functional components of a holding mechanism of the profiling apparatus.

Referring to FIG. 7G, there is shown a block diagram including various functional components of the holding mechanism 510 including a blade-receiving portion 5113, amongst other components to be discussed below. In some embodiments, the blade-receiving portion 5113 of the holding mechanism 510 is configured as a slot 5112 which provides access to the material removal mechanism 520 and the subject blade 99 is received in the slot 5112 of the holding mechanism 510.

The blade-receiving portion 5113 of the holding mechanism 510 may be configured such that it reduces access to the moving parts of the profiling apparatus 500 and, thus, reduces incidences of injury to a user of the profiling apparatus 500. The blade-receiving portion 5113 may be covered by a protective element (e.g., covers, shield) to block dust and/or debris generated during the profiling operation from hitting the user or to prevent the user from reaching into the profiling apparatus 500 through the blade-receiving portion 5113 with their hands during the profiling operation.

Figure 7H:
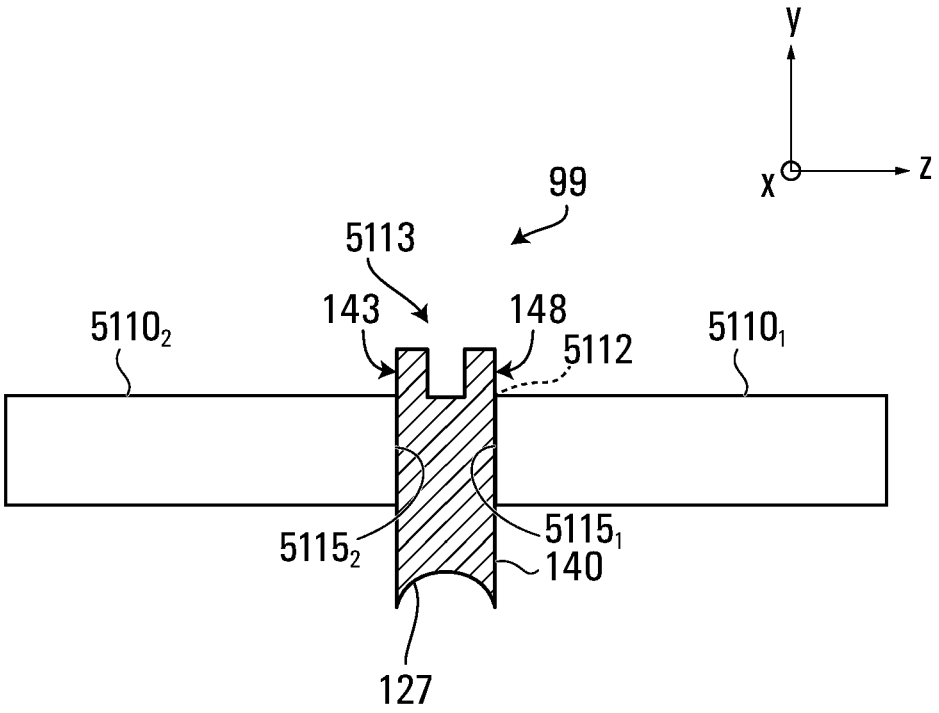
FIG. 7H is a view of a holding mechanism of the profiling apparatus in accordance with a non-limiting embodiment of the present disclosure.

In this embodiment, as shown in FIG. 7H, the holding mechanism 510 comprises retaining elements 5110 (in this example, two retaining elements 51101 and 51102) configured to contact the lateral surfaces 148, 143 of the subject blade 99 to secure the subject blade 99 (or subject blades 99) within the holding mechanism 510. Additionally or alternatively, in other embodiments, the retaining elements 5110 may be configured to contact the front and/or rear ends 57, 55 of the subject blade 99 to secure the subject blade 99 within the holding mechanism 510.

The retaining elements 5110 are configured to longitudinally and/or laterally center the subject blade 99 within the holding mechanism 510 with respect to the blade-receiving portion 5113 of the holding mechanism 510.

The retaining elements 5110 may be configured in any suitable fashion. For example, in the present embodiment, the retaining elements 5110 comprise two plates configured to contact the lateral surfaces 148, 143 of the subject blade 99. In this case, the retaining elements 5110 comprise a first blade contacting surface 51151 and a second blade contacting surface 51152 each configured to contact the lateral surfaces 148, 143 of the subject blade 99 and to retain the subject blade 99 by applying pressure to the lateral surfaces 148, 143 of the subject blade 99. In yet other embodiments, the pressure applied to the lateral surfaces 148, 143 of the subject blade 99 may be provided by spring force to secure the subject blade 99 within the blade-retaining portion 5113 of the holding mechanism 5110. In yet other embodiments, the first and second blade contacting surfaces 51151, 51152 may comprise material configured to increase their frictional engagement with the lateral surfaces 148, 143 of the subject blade 99 when contacting the lateral surfaces 148, 143 of the subject blade 99. The retaining elements 5110 may comprise any suitable material (e.g., a metallic material, a polymeric material, etc.).

The retaining elements 5110 may be adjustable to accommodate a variety of subject blades 99 (e.g., a variety of blade thicknesses $t_b$, a variety of blade lengths L, one subject blade 99 or a plurality of subject blades 99). For example, the retaining elements 5110 may be movable with respect to each other or with respect to the subject blade 99 to accommodate a variety of subject blades 99. In one embodiment, a first retaining elements 51101 may be fixed with respect to the profiling apparatus 500 and a second retaining element 51102 may be movable towards the first retaining elements 51101 to retain the subject blade 99 (or vice-versa) within the blade-receiving portion 5113 of the holding mechanism 510. In yet other embodiments, both the first and second retaining elements 51101, 51102 may be movable towards each other to retain the subject blade 99 within the blade-receiving portion 5113 of the holding mechanism 510.

In some embodiments, the holding mechanism 510 may include a user-operated element 5114 (e.g., a lever, a knob, or a handle etc.) which may be operated by a user of the profiling apparatus 500 to manually move the retaining elements 5110 towards or away from the subject blade 99.

In other embodiments, the retaining elements 5110 may be moved towards or away from the subject blade 99 semi-automatically. In one example of implementation of this embodiment, the holding mechanism 510 comprises an actuating member 5116 configured to move the retaining elements 5110. For instance, the actuating member 5116 may be a linear actuator, a hydraulic actuator, a pneumatic actuator, a mechanical actuator, a spring actuator or any other suitable actuator. In this case, the user-operated element 5114 (e.g., a button, a lever, a knob, or a handle etc.) may be operated by the user of the profiling apparatus 500 to cause the actuating member 5116 to move the retaining elements 5110 towards or away from the blade 52.

As will be described later on, the profiling apparatus 500 comprises a controller, which may be configured to detect operation of the user-operated element 5114 and to cause the actuating member 5116 to move the retaining elements 5110 in response to detecting operation of the user-operated element 5114.

In yet another example of implementation of this embodiment, the holding mechanism 510 may comprise a sensor to detect the presence of the blade 52 within the blade receiving portion 5113 of the holding mechanism 510 and the controller may be configured to cause the actuating member 5116 to move the retaining elements 5110 in response to detecting the subject blade 99 in the blade-receiving portion 5113.

The retaining elements 5110 may also be configured to straighten the subject blade 99 prior to the profiling operation of the subject blade 99.

The profiling operation of the subject blade 99 involves relative movement of the material removal device 5201 and the subject blade 99 to remove the band of excess material 39 from the subject blade 99.

In some embodiments, the material removal device 5201 is fixed or partially fixed within the profiling apparatus 500 and the moving mechanism 530 is configured to translate the subject blade 99 longitudinally (in the x-direction of FIG. 7A) as the material removal device 5201 is operative to remove the band of excess material 39 of the subject blade 99. Thus, in this example of implementation, the moving mechanism 530 is configured to translate the holding mechanism 510.

The holding mechanism 510 may in some embodiments be configured to move in a plurality of directions (i.e., x-direction, y-direction, z-direction).

In other embodiments, the holding mechanism 510 is fixed or partially fixed with respect to the profiling apparatus 500 such that the subject blade 99 is fixed with respect to the profiling apparatus 500. In this example, the moving mechanism 530 is configured to translate the material removal device 5201 longitudinally (in the x-direction of FIG. 7A) to remove the band of excess material 39 of the subject blade 99.

The material removal device 5201 may in some embodiments be configured to move in a plurality of directions (i.e., x-direction, y-direction, z-direction).

In yet other embodiments, the moving mechanism 530 is configured to translate both the holding mechanism 510 and the material removal device 5201 such that the band of excess material 39 is removed from the subject blade 99. Thus, in this example of implementation, the moving mechanism 530 is configured to translate the subject blade 99.

The moving mechanism 530 may be configured in any suitable fashion.

Figure 9A:
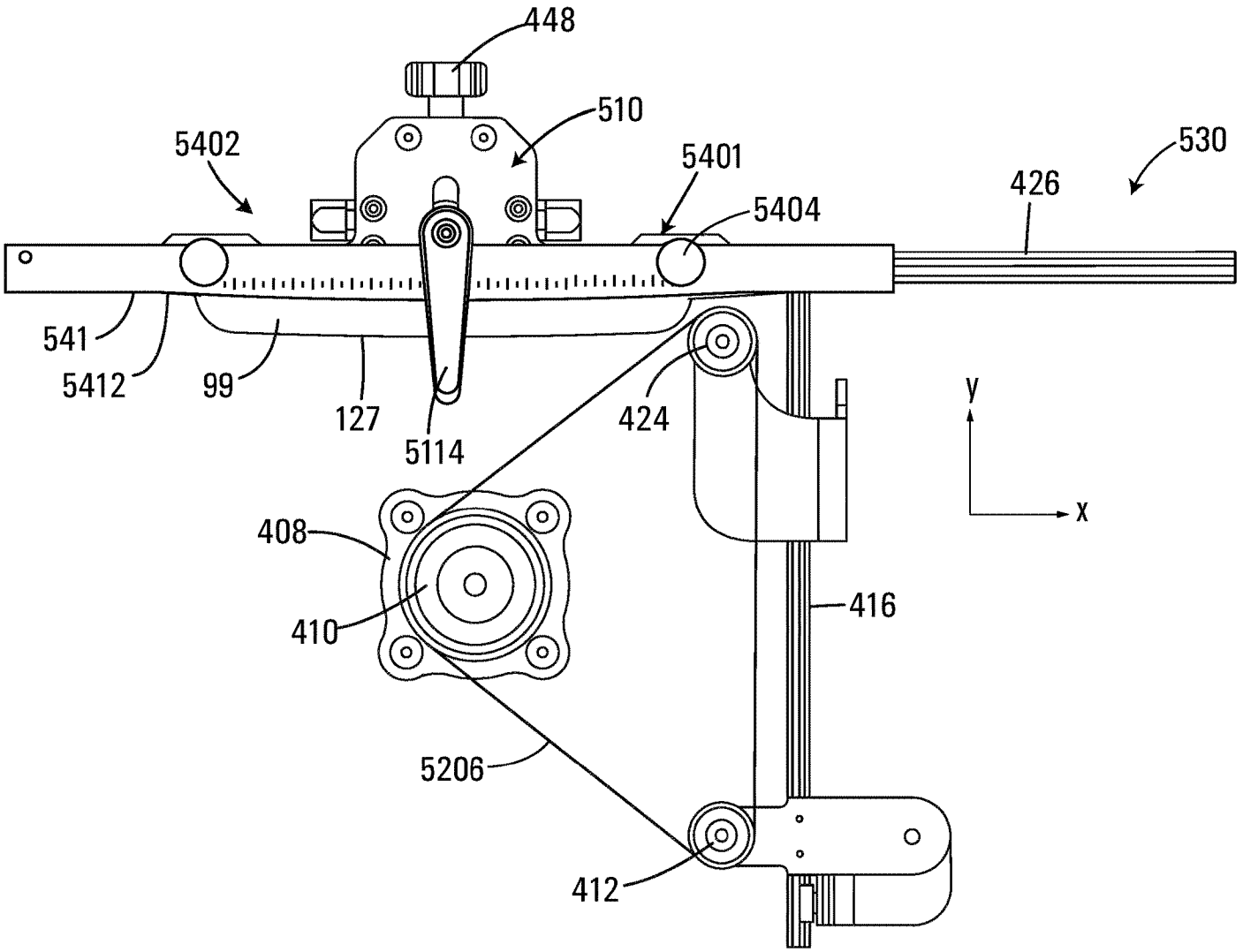
FIGS. 9A, 9B and 9C are side, perspective, and front views of the physical template mounted to a profiling apparatus including a belt-based material removal mechanism in accordance with a non-limiting embodiment of the present disclosure.
Figure 9B:
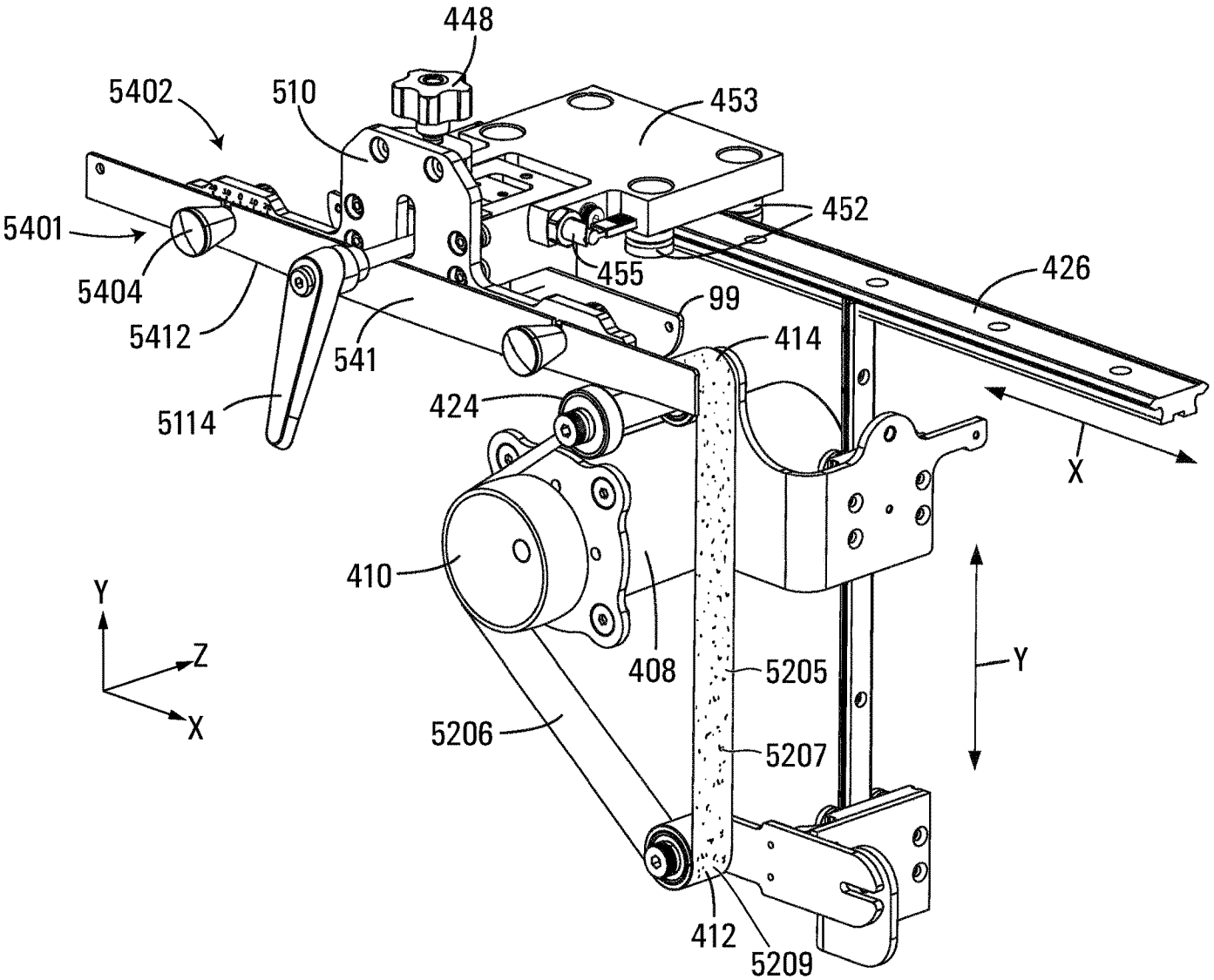

In the present embodiment, the material removal device 5201 is partially fixed within the profiling apparatus 500 and the moving mechanism 530 is configured to translate the holding mechanism 510 and the subject blade 99 when inserted therein. In one example of implementation of this embodiment, as shown in FIGS. 9A and 9B, the moving mechanism 530 may comprise a guide or rail 426 and the holding mechanism 510 is slidably mounted to the guide or rail 426 such that it can be moved back and forth on the rail 426 in the x-direction. In this case, the holding mechanism 510 includes a pair of rollers 452 mounted below a plate 453 and held to the rail 426. The rollers 452 enable the holding mechanism 510 to slide along the rail 426. In this example, the holding mechanism 510 is also tiltable relative to the plate 453 at hinges 455 to an open position to make it easier to set up and mount the subject blade 99. Once the subject blade 99 is secured in the holding mechanism 510, the holding mechanism 510 is tilted back to the closed position and locked in a horizontal profiling position.

The moving mechanism 530 may be configured with any other suitable means or assembly capable of smoothly moving it (e.g., linear bearings, lead screw, feed screw etc.).

Two types of material removal device 5201 for performing the profiling operation of the blade 52 will be discussed in further detail below, namely a grinding wheel 5202 and a grinding belt 5206. It is understood that the material removal mechanism 520 may comprise any other suitable material removal device 5201 (e.g., a milling device, a drilling device, a laser cutting device, a water cutting device, etc.).

Figure 8A:
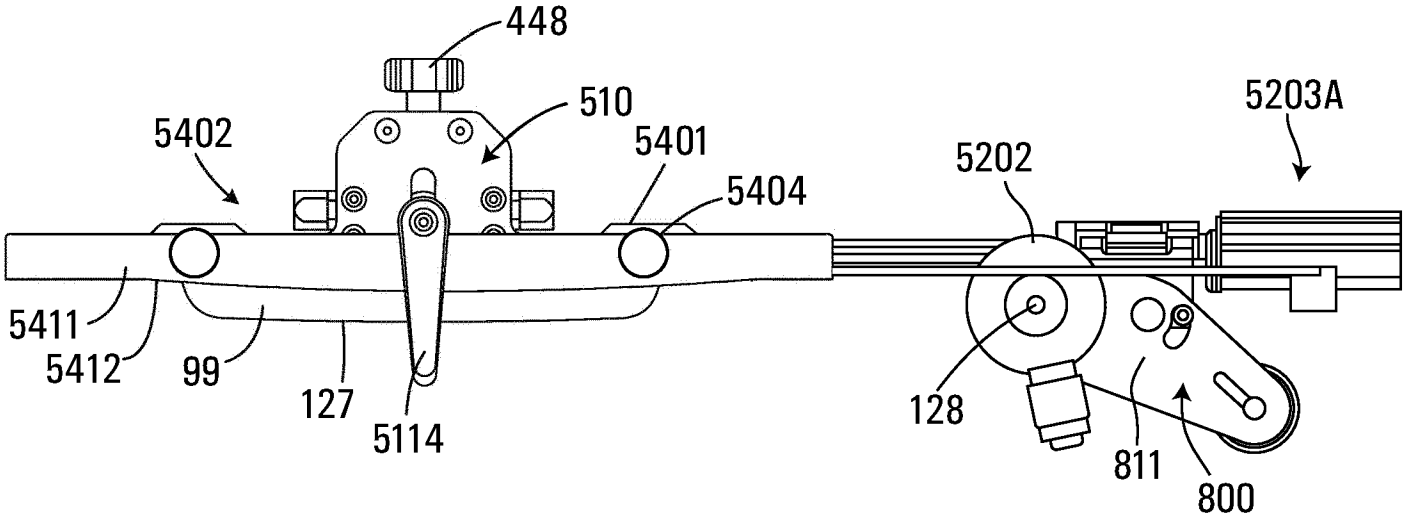
FIG. 8A is a side view of the physical template mounted to a profiling apparatus including a grinding wheel-based material removal mechanism in accordance with a non-limiting embodiment of the present disclosure.

With reference to FIG. 8A, there is shown a portion of a profiling apparatus 800 which includes a material removal mechanism 520A having the grinding wheel 5202 and a drive mechanism 5203A for driving the grinding wheel 5202.

Figure 8C:
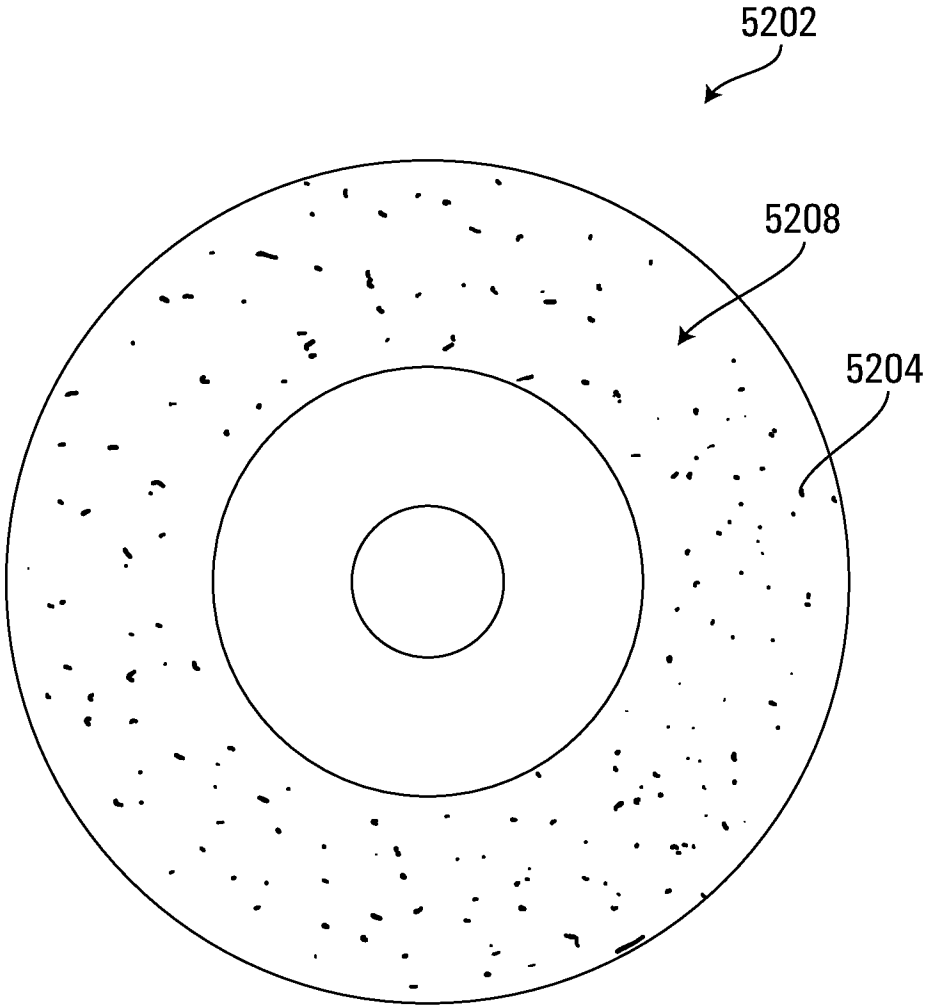
FIGS. 8B and 8C are side and front views of a grinding wheel.

With reference to FIG. 8C, the grinding wheel 5202 may comprise a substrate material 5208 to which an abrasive material 5204 is applied. The abrasive material 5204 is configured to remove the band of excess material 39 from the subject blade 99 upon contact with the ice-contacting surface 127 of the subject blade 99. The substrate material 5208 may comprise carbon steel, a cobalt and nickel alloy, a high nickel alloy, stainless steel, titanium, zirconium or any other suitable material. The abrasive material 5204 may include a ceramic material, cubic boron nitride (CBN), aluminum oxide, a diamond material or any other suitable material. In some cases, the abrasive material 5204 may be applied to the substrate material 5208 using a bonding agent such as resin. In other cases, the abrasive material 5204 may be electroplated. The abrasive material 5204 may be applied to the substrate material 5208 using any suitable techniques known in the art.

In this example, the drive mechanism 5203A includes a rotatable spindle 128 to which the grinding wheel 5202 is mounted and a motor (not visible in FIG. 8A) configured to rotate the spindle 128 to drive the grinding wheel 5202. The drive mechanism 5203A may be configured in any other suitable fashion.

The drive mechanism 5203A rotates the spindle 128 at a given rotation speed. The rotation speed may be constant or variable (i.e., the rotation speed may vary as the grinding wheel 5202 and the subject blade 99 move with respect to each other along a portion or all of the length L of the subject blade 99). In some embodiments, the rotation speed may be selected by the user of the profiling apparatus 800 upon setup of the profiling operation.

As the grinding wheel 5202 profiles the subject blade 99, the grinding wheel 5202 exerts pressure on the subject blade 99. Thus, the profiling apparatus 800 may include a pressure regulating mechanism 810 to ensure that a correct grinding wheel pressure is applied against the subject blade 99 during the profiling operation.

For example, the pressure regulating mechanism 810 comprises a counterweight 811 that by gravity counterweighs the weight of the grinding wheel 5202 The profiling apparatus 800 may also comprise one or more sensors to sense the pressure applied to subject blade 99 by the grinding wheel 5202 during the profiling operation and the controller may be configured to maintain the pressure within a predetermined range. In yet other embodiments, the pressure regulating mechanism 810 may include means to adjust the pressure applied to the subject blade 99 by the grinding wheel 5202. For example, in one example of implementation, the pressure applied to the subject blade 99 by the grinding wheel 5202 may be increased by the user of the profiling apparatus 800. In such cases, the profiling operation may be completed more quickly.

It is understood that the pressure regulating mechanism 810 may be configured in any other suitable fashion, for example by use of gas springs, by monitoring the load on a motor moving the grinding wheel 5202 into contact with the subject blade 99 or any other fashion.

The grinding wheel 5202 often wears from repeated profiling operations and as such, the diameter of the grinding wheel 5202 may decrease after use. Thus, in some embodiments, the position of the grinding wheel 5202 may be adjusted such that proper contact between the grinding wheel 5202 and the subject blade 99 is maintained as the diameter of the grinding wheel 5202 decreases. Adjustment of the position of the grinding wheel 5202 may in some cases increase the usability of the grinding wheel 5202.

Figure 8B:
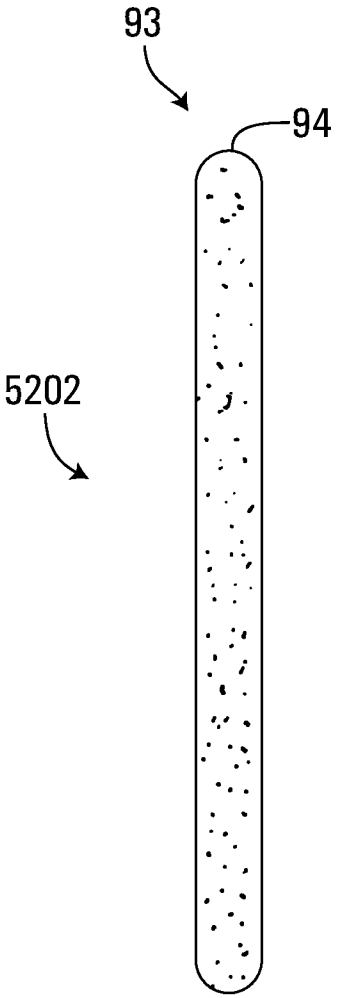
Figure 8D:
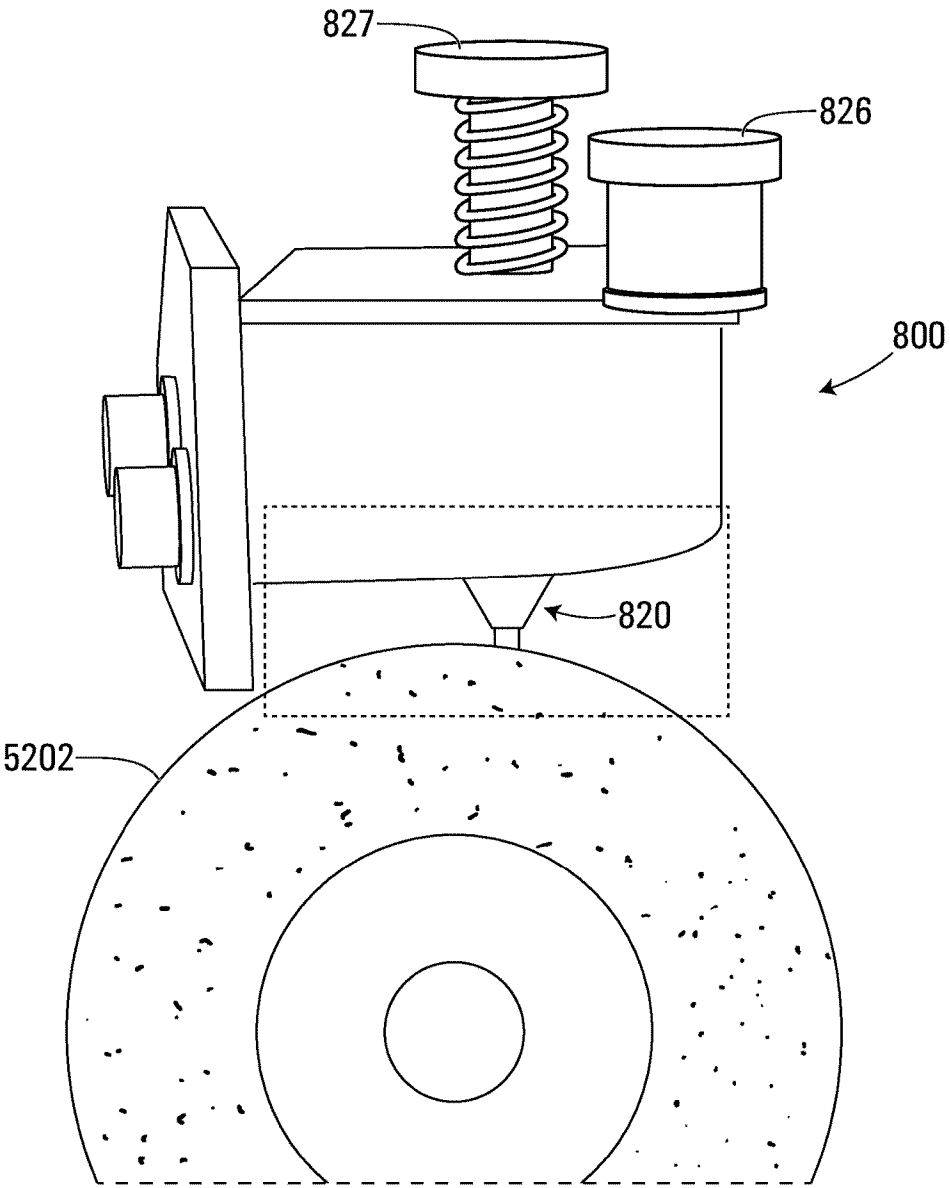
FIG. 8D is a side view of a dressing mechanism of the profiling apparatus of FIG. 8A.

With reference to FIG. 8B, the grinding wheel 5202 has a peripheral surface 94 and the peripheral surface 94 of the grinding wheel 5202 has a pre-made profile 93. The profile 93 may be flat, convex, v-shaped or any other suitable profile. In this embodiment, as shown in FIG. 8D, the profiling apparatus 800 includes a dressing mechanism 820 configured to change the profile 93 of the grinding wheel 5202 in a process known as "dressing" the grinding wheel 5202. For example, prior to profiling the subject-blade 99, the user of the profiling apparatus 800 may dress the grinding wheel 5202 such that it has a flat profile.

Figure 8E:
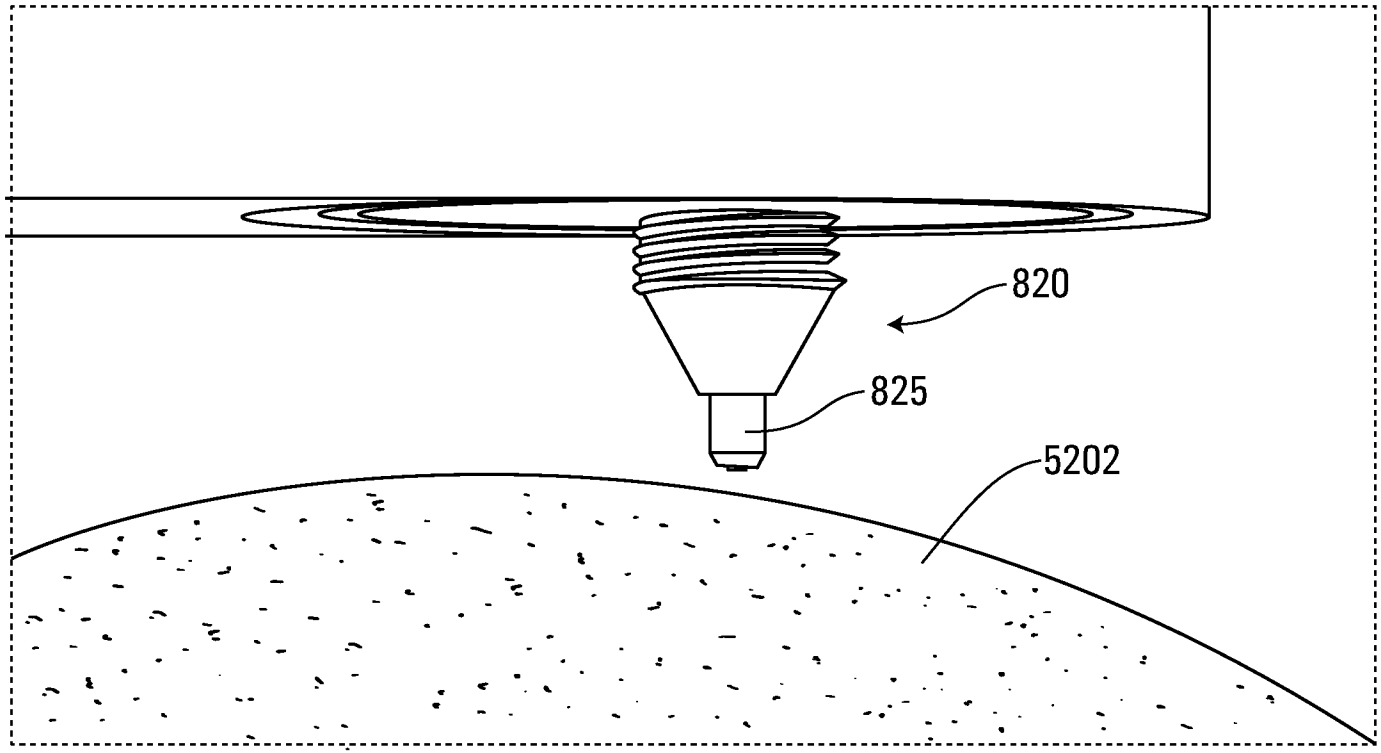
FIG. 8E is an enlarged portion of FIG. 8D.

The dressing mechanism 820 includes a dressing tool 825 as shown in FIG. 8E which shows an enlarged portion of the dressing mechanism 820 of FIG. 8D. The dressing tool 825 may be a diamond-based tool (e.g., diamond point dresser). In this example, the dressing tool 825 is connected to a user-operated component 826 which can be operated by the user of the profiling apparatus 800 to move the dressing tool 825 across the peripheral surface 94 of the grinding wheel 5202 to dress the grinding wheel 5202 according to a desired profile 93. The dressing mechanism 820 may also include an adjustment mechanism 827 to change the position of the dressing tool 825 relative to the grinding wheel 5202 to bring the dressing tool 5203 closer or further away from the grinding wheel 5202.

Additionally, in some embodiments, the profiling apparatus 800 may include a cooling mechanism for cooling the grinding wheel 5202 during the profiling operation. For example, the cooling mechanism may be configured to apply a cooling liquid to the grinding wheel 5202 when profiling the subject blade 99.

Figure 9C:
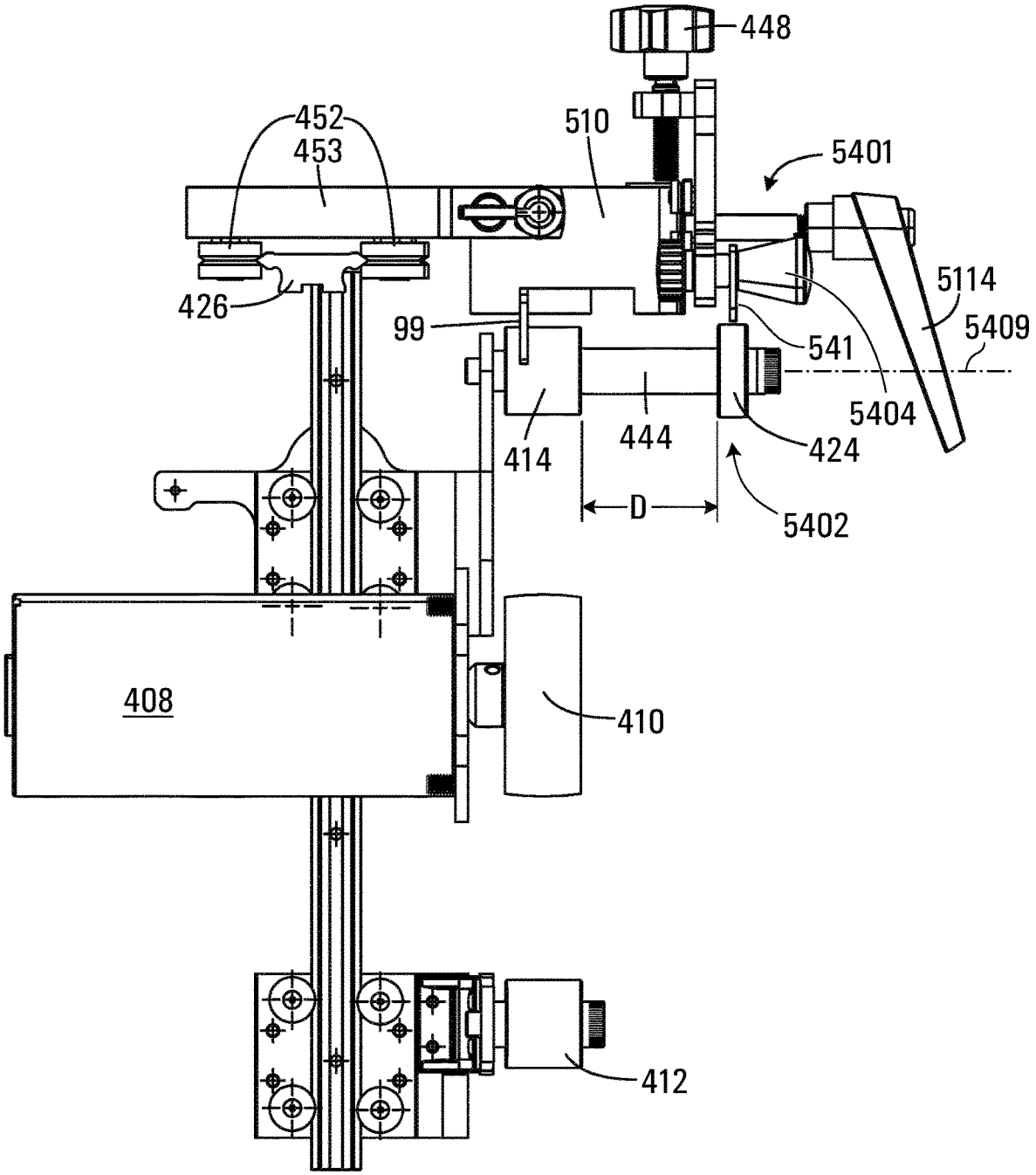

With reference to FIGS. 9A, 9B and 9C, there is shown a portion of a profiling apparatus 900 which includes a material removal mechanism 520B having a grinding belt 5206 and a drive mechanism 5203B for driving the grinding belt 5206. The drive mechanism 5203A may be configured in any other suitable fashion.

The grinding belt 5206 includes a flexible material 5209 covered on its blade-contacting face 5205 with an abrasive material 5207. The flexible material 5209 may comprise a cloth material such as a polyester cloth material. The abrasive material 5207 may comprise aluminum oxide, silicon carbide, zirconia-alumina, ceramic-alumina, etc. The abrasive material 5207 may have any suitable grit. The abrasive material 5207 may be applied to the flexible material 5209 using a bonding agent such as resin. The grinding belt 5206 may have any suitable width such as 30 mm, or in some cases 40 mm, or in some cases 50 mm.

In this example, the drive mechanism 5203B includes three rolls 410, 412 and 414 and a motor 408, the rolls 410, 412, 414 and the motor 408 being in operative engagement with the rotatable grinding belt 5206. The roll 410 is a driving roll and thus the motor 408 drives the driving roll 410 to drive and rotate the grinding belt 5206 about the roll 412, 414. Preferably, the rolls 412, 414 are mounted on a Y-axis linear-guide rail 416, supported by hydraulic gas springs (not shown) for grinding pressure, movement compensation and for maintaining a solid and consistent belt-pressure during the grinding procedure.

In this embodiment, the holding mechanism 510 is configured to be shifted in z-direction such that a non-worn portion of the grinding belt 5206 may be used for subsequent profiling operations. Adjustment of the holding mechanism 510 in this way may increase the usability of the grinding belt 5206 and may also ensure that the grinding belt 5206 profiles the subject blade 99 evenly.

The holding mechanism 510 may be shifted manually in some embodiments. In other embodiments, the holding mechanism 510 may be in communication with the controller, which may be configured to determine the width of the subject blade 99 (or subject blades 99) having been profiled and to shift the holding mechanism 510 by this determined width. It may also be possible to require a shifting of the holding mechanism 510 after a certain time period (such as 500 seconds) or after a certain number of revolutions of the motor 408 that drives the grinding belt 5206. When the full width of the grinding belt 5206 has been used it is time to replace the grinding belt 5206 with a new non-worn belt.

Figure 10A:
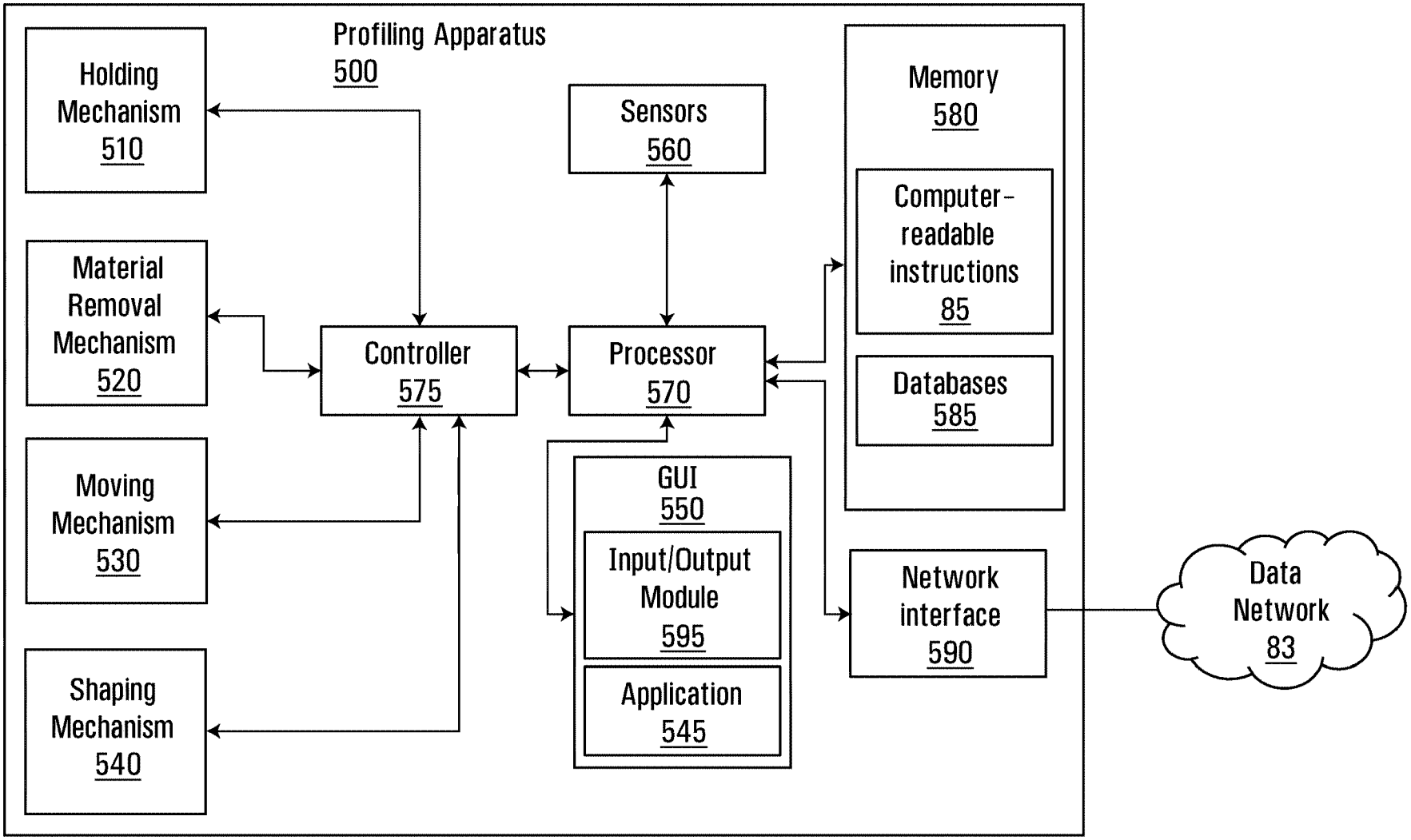
FIG. 10A is a block diagram showing components of a profiling apparatus in accordance with a non-limiting physical template embodiment of the present disclosure.

The behavior of the profiling apparatus 500 may be controlled in part by software. Accordingly, in the non-limiting embodiment shown in FIG. 10A, the profiling apparatus 500 includes a processor 570, a non-transitory memory 580, a controller 575 for controlling various mechanisms of the profiling apparatus 500, sensors 560 for sensing a variety of parameters related to the profiling operation, a graphical user interface (GUI) 550 (which may be implemented by the processor 570) including an input/output module 595 for entering selections and displaying information. Other suitable components that may typically found in a generic profiling apparatus may also be provided but are not shown for simplicity.

The processor 570 may include one or more central processing units (CPUs) having one or more cores. The processor 570 may also include at least one graphics processing unit (GPU) in communication with a video encoder/video codec (coder/decoder, not shown) for causing output data to be supplied to the input/output module 595 for display on a display device 551. The processor 570 may also include at least one audio processing unit in communication with an audio encoder/audio codec (coder/decoder, not shown) for causing output data to be supplied to the input/output module 595 to an auditory device (e.g., a speaker).

The memory 580 may include RAM (Random Access Memory), ROM (Read Only Memory), flash memory, hard disk drive(s), and/or any other suitable memory device, technology or configuration. The memory 580 stores a variety of information including computer-readable instructions 85. The memory 580 may be in communication with the processor 570 which is configured to execute the computer-readable instructions 85 such that the processor 570 is able to perform various kinds of functions related to the processes it encodes.

The controller 575 may be an electronic controller that can include a microprocessor and a plurality of communication ports to communicate with one or more components of the profiling apparatus 500 such as the holding mechanism 510, the moving mechanism 530 and the material removal mechanism 520 including the material removal device 5201.

The sensors 560 (e.g., cameras, optical scanners, photosensors, contact sensors such as depth gauges or micrometers, non-contact sensors such as lasers) are configured to detect the contour 103 of subject blade 99. The sensors 560 are also configured to detect a plurality of other parameters required for the profiling operation as will be discussed in further detail below.

The input/output module 595 of the GUI 550 of the profiling apparatus 500 is configured such that the user of the profiling apparatus 500 may enter selections relating to the profiling operation of the subject blade 99. In some embodiments, the input/output module 595 of may include one or more input devices 554 (e.g., a touchscreen, buttons, a keyboard, a joystick, a touch pad, a keypad, a trackball, and the like) and one or more output devices such as the display device 551 (e.g., a monitor, a screen, a touchscreen, etc.).

The GUI 550 of the profiling apparatus 500 may include one or more indicators 546. The indicators 546 may provide cues or instructions to the user of the profiling apparatus 500. For example, the GUI 550 may include a visual indicator (e.g., lights, icons, images) to guide the user during operation of the profiling apparatus 500. The GUI 550 of the profiling apparatus 500 may include an audible indicator (e.g., a speaker) configured to provide verbal instructions, a tone, a chime, or other suitable audible messages.

Figure 11A:
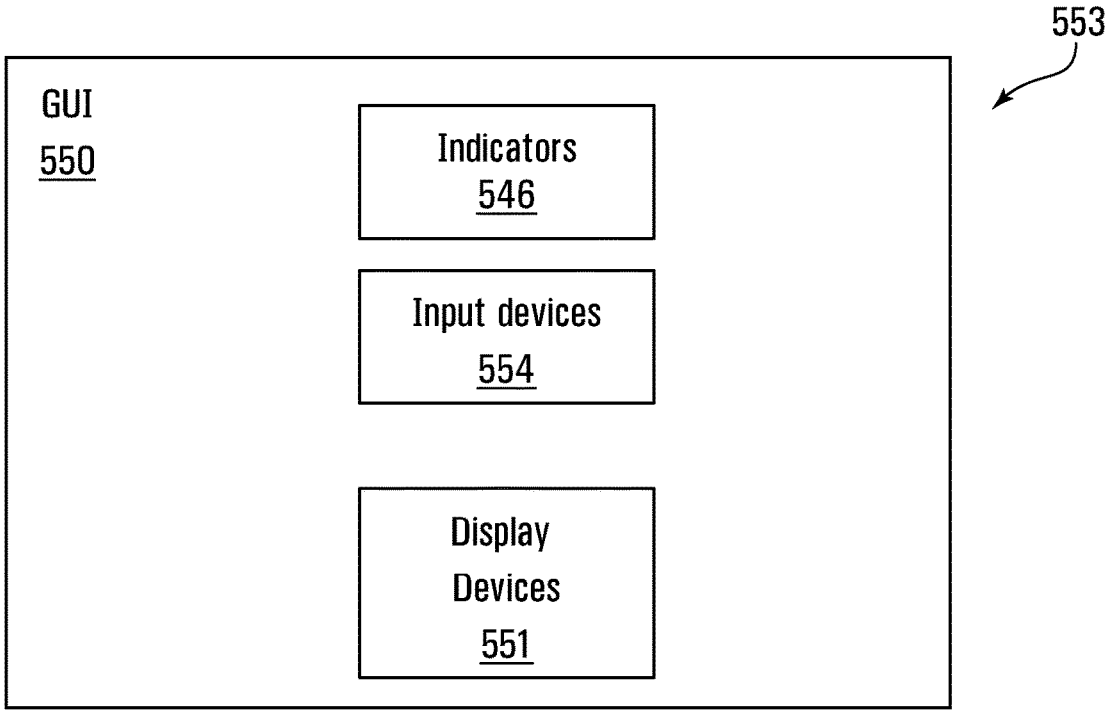
FIG. 11A is block diagram showing components the profiling apparatus of FIG. 10 incorporating a console-type graphical user interface (GUI) in accordance with a non-limiting embodiment of the present disclosure.

In some embodiments, as shown in FIG. 11A, the GUI 550 may be implemented as a console 553 integrated within the profiling apparatus 500 to provide interactive capabilities.

Figure 11B:
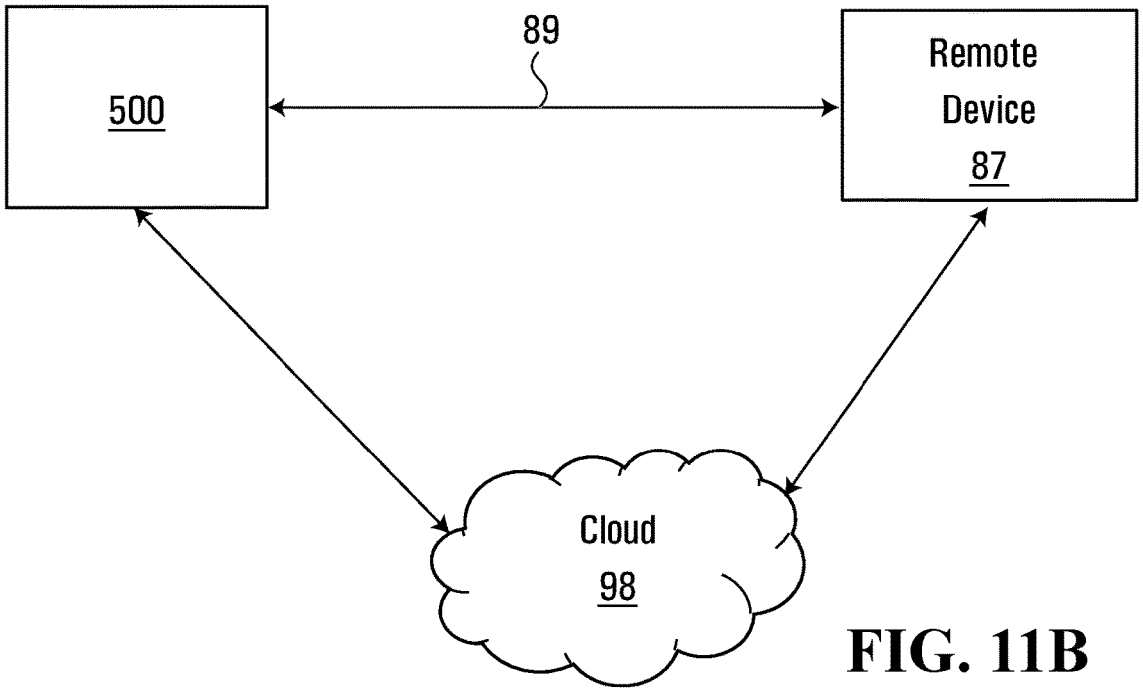
FIG. 11B is block diagram showing components the profiling apparatus of FIG. 10 incorporating a remote-type GUI in accordance with a non-limiting embodiment of the present disclosure.

In other embodiments, as shown in FIG. 11B, the GUI 550 may be implemented remotely. To provide a remote GUI 550, the profiling apparatus 500 may be configured to communicate with a remote device 87 via a network input/output interface 590, permitting data to be sent by the profiling apparatus 500 and received by the remote device 87, and vice versa. Accordingly, the profiling apparatus 500 may be connected to a data network 83 via the network input/output interface 590. Depending on the implementation, the data network 83 may be the Internet, a local area network, a wireless network, a combination of such networks or still other forms of data networks.

Communications between the remote device 87 and the profiling apparatus 500 may be established via a communication link 89. The communication link 89 may be implemented via wireless and/or wireline techniques, including but not limited to one or more of IEEE 802.11 (Wi-Fi), IEEE 80215 (Bluetooth), coaxial cable, Ethernet, etc., and may traverse one or more networks, including private networks and/or the internet, or other known methods. Furthermore, the communication link 89 may be accessible through the cloud 98, as will be appreciated by a person skilled in the art.

It is also contemplated that the databases 585 may be located remote from the profiling apparatus 500, yet accessible to the processor 570 through the network interface 580. For example, the databases 585 may be stored in the cloud 98.

The controller 575 may also be in communication with the data network 83 to send and/or receive commands to/from the profiling apparatus 500 including the GUI 550.

A user-facing application may be provided to facilitate semi-autonomous operation of the profiling apparatus 500 to profile the blade 52. The user-facing application may be configured to assist the user of the profiling apparatus 500 in completing the profiling operation of the subject blade 99. For example, the user-facing application may be configured to provide the user with a recommendation of a template based on information regarding the subject blade 99 (e.g., the type of subject blade 99, the size of the skate, etc.). In yet another example, the user-facing application may be configured to provide the user with information related to the estimated remaining time for profiling the subject blade 99.

The user-facing application can be a software or firmware module that operates as part of the GUI 550, or independently thereof. The behavior of the user-facing application may be defined by a subset of the computer-readable instructions 85 stored in the memory 580 of the profiling apparatus 500, and/or can be accessible for execution from a remote location (e.g., over the data network 83). The user-facing application may be configured to facilitate remote operation of the profiling apparatus 500. In other embodiments, the user-facing application can be a module that operates on (or is associated with) the controller 575.

The profiling operation of the subject blade 99 using the shaping mechanism 540 including the physical template 541 and the profiling apparatus 900 will now be described.

The shaping mechanism 540 of the profiling apparatus 900 includes a copying mechanism 5402 configured to impart the profile 5413 of the physical template 541 to the subject blade 99. As shown in FIGS. 9A, 9B and 9C, the copying mechanism 5402 comprises a guide roll 424 and the above-reference roll 414 of the drive mechanism 5203B which may be referred to as a "grinding roll" 414.

The guide roll 424 is configured to indicate to the user of the profiling apparatus 900 when the ice-contacting material 140 is and is not being removed from the ice-contacting surface 127 of the subject blade 99. During the profiling operation of the subject blade 99, as long as the guide roll 424 does not roll on the profiling side 5412 of the physical template 541, the ice-contacting material 140 is being removed from the region of interest 27 of the subject blade 99. When the guide roll 424 rolls on the profile side 5412 of the physical template 541 then no ice-contacting material 140 is removed from the subject blade 99.

To begin the profiling operation, the user of the profiling apparatus 900 determines which percentage of the length LT of the physical template 541 is to be transferred or copied to the subject blade 99 (often between 50-75%). The physical template 541 is then mounted to the holding mechanism 510 using the previously described retention mechanism 5401. The positioning of the guide roll 424 is adjusted in both the x- and y-directions for exact positioning of the guide roll 424 relative to the profiling side 5412 of the physical template 541. The positioning of the guide roll 424 is adjusted by turning the adjustment knob 448, mounted on the holding mechanism 510 to raise or lower the guide roll 424 that is mounted in the y-direction on the rail 416. It is envisaged that the physical template 541 would be longer than the subject blade 99 so that it is only necessary for the guide roll 424 to follow a portion of the profiling side 5412 the physical template 541 in order to profile the region of interest 127 of the subject blade 99.

In this embodiment, during the profiling operation, the holding mechanism 510 is moved back and forth so that material removal device 5201 profiles the region of interest 27 of the subject blade 99 (i.e., such that grinding belt 5206 removes the excess band of material 39 of the region of interest 27 of the subject blade 99).

In the case of profiling apparatus 900, the grinding belt 5206 mounted on the rotatable rolls 410, 412, profiles the region of interest 27 of the blade 52 while the position of the grinding roll 414 and the grinding belt 5206 is guided by the guide roll 424 that, at the same time, is urged against to follow the profile 5413 of the profiling side 5412 of the physical template 541. This is possible because the grinding roll 414 and the guide roll 424 are mounted to the same axle 444 but there is a distance (D) between the two rolls 414 and 424. The grinding roll 414 is generally wider than the guide roll 424 so that it can support a wider grinding belt 5206 to profile a plurality of subject blades 99 that are mounted next to one another.

The holding mechanism 510 is then moved back and forth a few times in order to set the amount of ice-contacting material 140 to be removed from the subject blade 99. When the physical template 541 is moved back and forth (without having started the driving motor 408 for the material removal device 5201), the guide roll 424 indicates, by looking at the position of the grinding roll 414 relative to the subject blade 99, how much ice-contacting material 140 from the subject blade 99 will be removed once the motor 408 of the driving mechanism 5203B is turned on to engage the material removal device 5201 and the guide roll 424 follows the profiling side 5412 of the physical template 541 so that the material removal device 5201 starts grinding off ice-contacting material 140 from the region of interest 27 of the subject blade 99.

After the position of the physical template 541 is set, the motor 408 is turned on to start the rotation of the grinding belt 5206. The holding mechanism 510 is then moved back and forth on the rail 426 and the back-and-forth movement of the holding mechanism 510 is repeated until the profiling operation is finished i.e. when no more ice-contacting material 140 from the ice-contacting surface 127 of the region of interest 27 is removed from subject the blade 99 even though the holding mechanism 510 is moved back and forth while the guide roll 424 rolls against the profiling side 5412 of the physical template 541. The profiling operation is done when the guide roll 424 can be rolled against the entire length LT of the physical template 541 without ice-contacting material 140 from the ice-contacting surface 127 of the region of interest 27 of the subject blade 99.

The motor 408 is then stopped and the profiled blade (i.e., the blade 52) is removed from the holding mechanism 510.

In some cases, in order to make a complete finish of the ice-contacting surface 127 of the blade 52, a final sweep against the grinding belt 5206 is often carried out without using the physical template 541 in what is referred to as a "blending step". This blending step is to even out the finish of the profiled area of the blade 52.

In some embodiments, portions of the profiling operation may be conducted manually. For example, the user-operated element 5114 of the holding mechanism 510 may be operated by the user to manually move the one or more retaining elements 5110 into clamping position (wherein the subject blade 99 is secured between the retaining elements 5110. Additionally, in some embodiments, the holding mechanism 510 may be translated manually by the user of the profiling apparatus 900 until such time as the guide roll 424 rolls freely against the profiling side 5412 of the physical template 541.

In other embodiments, the profiling operation may be conducted semi-autonomously.

In one example of implementation of this embodiment, securing the subject blade 99 in the holding mechanism 510 may be conducted semi-autonomously. In this case, the user of the profiling apparatus 900 may insert the subject blade 99 into the holding mechanism 510 and the subject blade 99 is secured by the retaining elements 5110 semi-autonomously. For instance, a clamping feature may be provided via the GUI 550 and the user may select the clamping feature via the GUI 550 (e.g., by pressing a button) which causes the retaining elements 5110 to move into a clamping position to secure the subject blade 99. In yet other embodiments, the sensors 560 (e.g., the camera, laser, photoreceptor, infrared sensor, inductive sensor, magnetic sensor, capacitive sensor, photoelectric sensor, ultrasonic sensor) may be configured to sense the presence of the subject blade 99 within the slot 5112 and the retaining elements 5110 may be configured to move into clamping position upon detecting the presence of the subject blade 99 in the slot 5112. In this case, the controller 575 is in communication with the holding mechanism 510 to semi-autonomously secure the subject blade 99 in the holding mechanism 510.

In another example of implementation of this embodiment, translation of the holding mechanism 510 may be conducted semi-autonomously. In this case, the moving mechanism 530 includes a translating mechanism (not shown) configured to translate the holding mechanism 510 autonomously. The translating mechanism may be configured in any suitable fashion. For example, the translating mechanism may include a motor operatively connected to a lead screw configured to move the holding mechanism 510 in the x-direction as the motor rotates the lead screw. In this case, the controller 575 is in communication with the translating mechanism of the moving mechanism 530 and is configured to move the holding mechanism 510 accordingly.

In this embodiment, a profiling cycle may be defined as the holding mechanism 510 having translated across a portion or the entirety of the length $L_R$ of the region of interest 27 along a first x-direction and subsequently moving in the opposite x-direction to return to its starting position. The profiling operation may include one or more profiling cycles. The number or profiling cycles may be selected by the user of the profiling apparatus 900 via the GUI 550. For example, the user may make a selection via the GUI 550 which may cause one profiling cycle to be completed. In yet other embodiments, this single selection may cause more than one cycle to completed. In yet other embodiments, this single selection may cause a cycle to be completed over less than the entirety of the length $L_R$ of the region of interest 27. The profiling operation may be configured to automatically complete as many profiling cycles as required to remove the band of excess material 39 from the ice-contacting surface 127 of the subject blade 99.

It is to be understood that in other embodiments, a profiling cycle may be defined as the material removal device 5201 having translated across a portion or the entirety of the Length $L_R$ of the region of interest 27 along a first x-direction and subsequently moving in the opposite x-direction to return to its starting position.

Digital Template Option

Figure 10B:
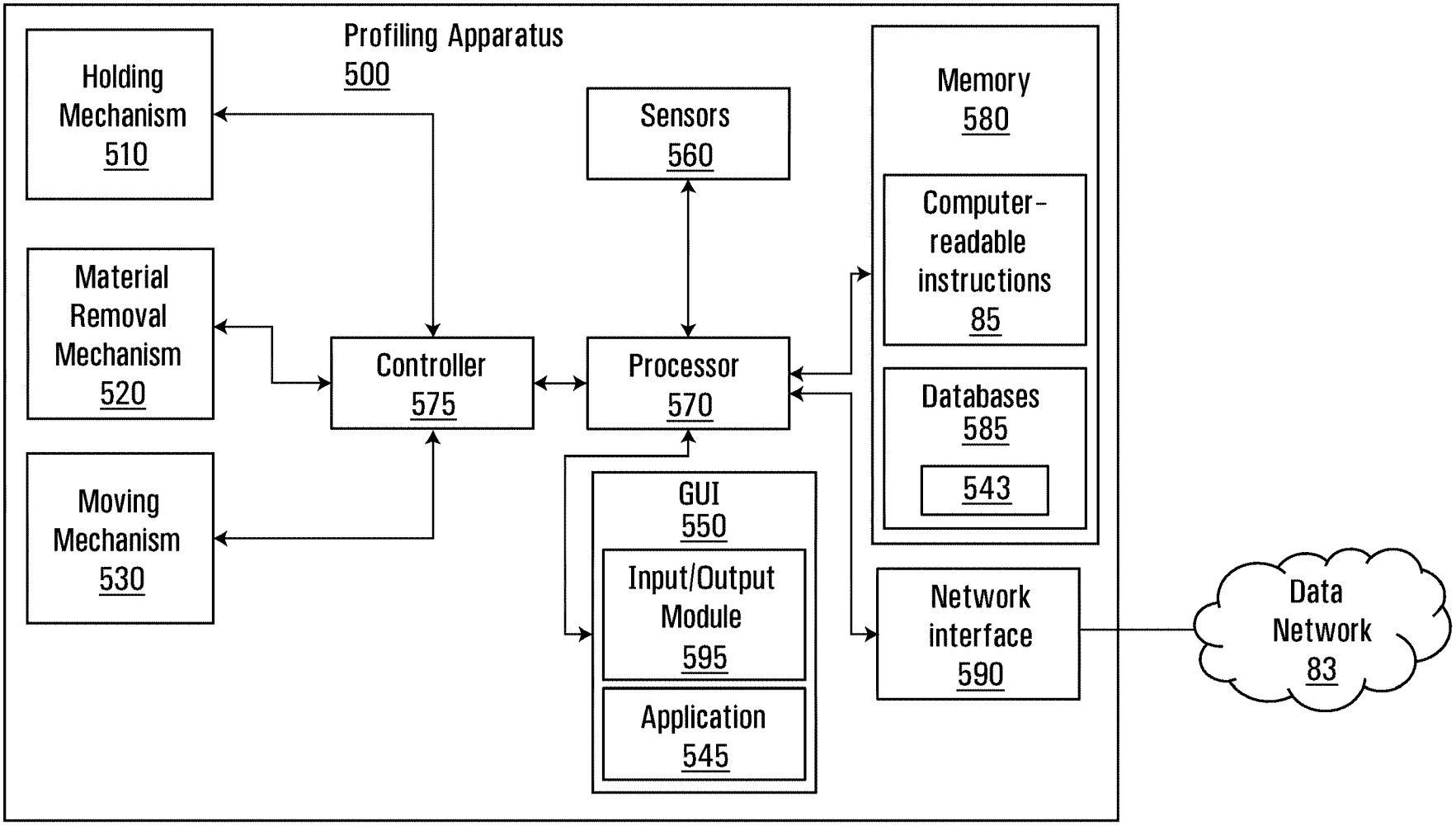
FIG. 10B is a block diagram showing components of a profiling apparatus in accordance with a non-limiting digital template embodiment of the present disclosure.

The digital template option is now described, with reference to FIG. 10B and FIG. 5C. It should be noted that FIG. 10B is identical to FIG. 10A, with the exception that one of the databases 585 in the memory 580 is shown as storing a set of digital templates 543. Each of the digital templates 543 includes digital information that encodes a given longitudinal profile, e.g., in terms or its shape or in terms of parameters that characterize its shape. One of the digital templates 543 may thus encode the desired longitudinal profile LP.

Figure 12A:
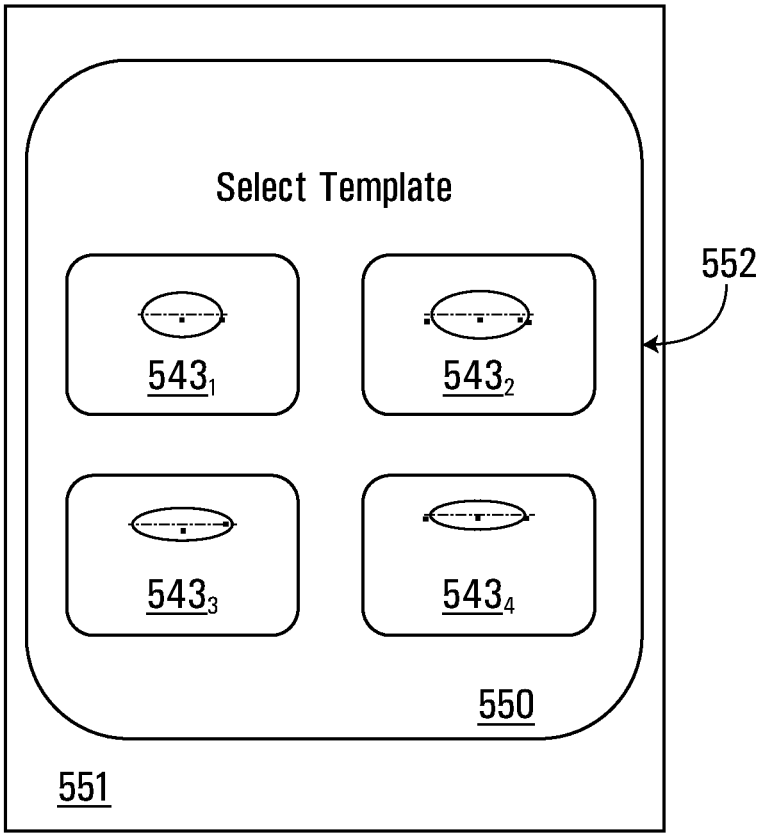
FIG. 12A is a representation of a menu of the GUI showing a selection of digital templates in accordance with a non-limiting embodiment of the present disclosure.
Figure 12B:
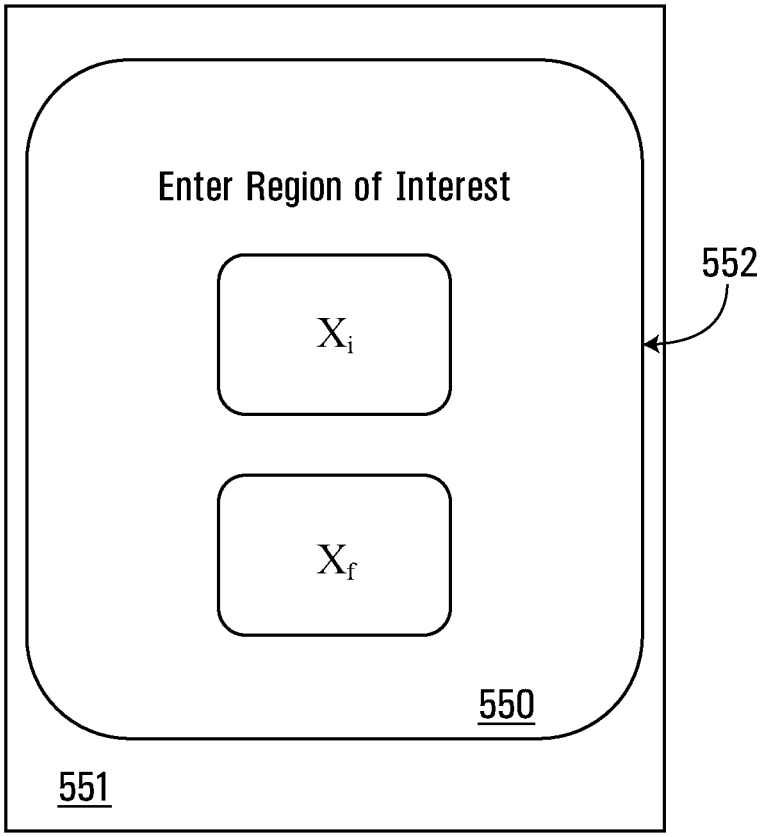
FIG. 12B is a representation of a menu of the GUI for selection of the region of interest of the subject blade in accordance with a non-limiting embodiment of the present disclosure.

In this embodiment, the GUI 550 could be used for the purposes of selecting a desired digital template. Referring to FIG. 12A, there are four digital templates 543 (denoted $\mathbf{543}_1$, $\mathbf{543}_2$, $\mathbf{543}_3$, $\mathbf{543}_4$) which may be displayed on a menu 552 presented by the GUI 550, and the GUI 550 is configured to provide the user with the ability to select a digital template via the menu 552. Referring to FIG. 12B, the GUI 550 may also be configured to provide the user with the ability to define the region of interest 27 (i.e., the values $X_i$ and $X_f$, or equivalent) of the subject blade 99 where the user of the profiling apparatus 500 would like to apply the selected digital template.

The display device 551 may display a prompt for the user to "Select a Template" or other prompts. The indicators 546 of the GUI 550 may also prompt the user to select a digital template or other parameters.

Figure 12C:
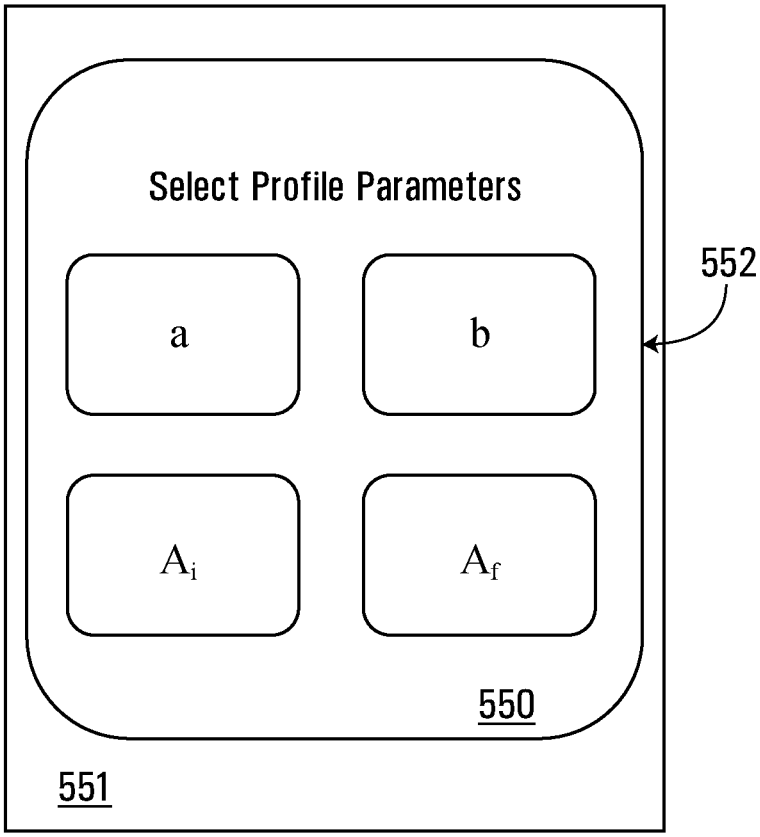
FIG. 12C is a representation of a menu of the GUI providing the user with a selection of profile parameters in accordance with a non-limiting embodiment of the present disclosure.

In an alternative embodiment, as shown in FIG. 12C, instead of explicitly selecting a digital template, the user selects profile parameters via the GUI 550. For example, in the case of an elliptical arc 37, such profile parameters may include the "a" of the major axis, the "b" of the minor axis, as well as $A_i$ (and/or $A_f$, with the constraint that $X_f-X_i=A_f-A_i=L_R$). Selection of the profile parameters is equivalent to implicit selection of a digital template.

Figure 13A:
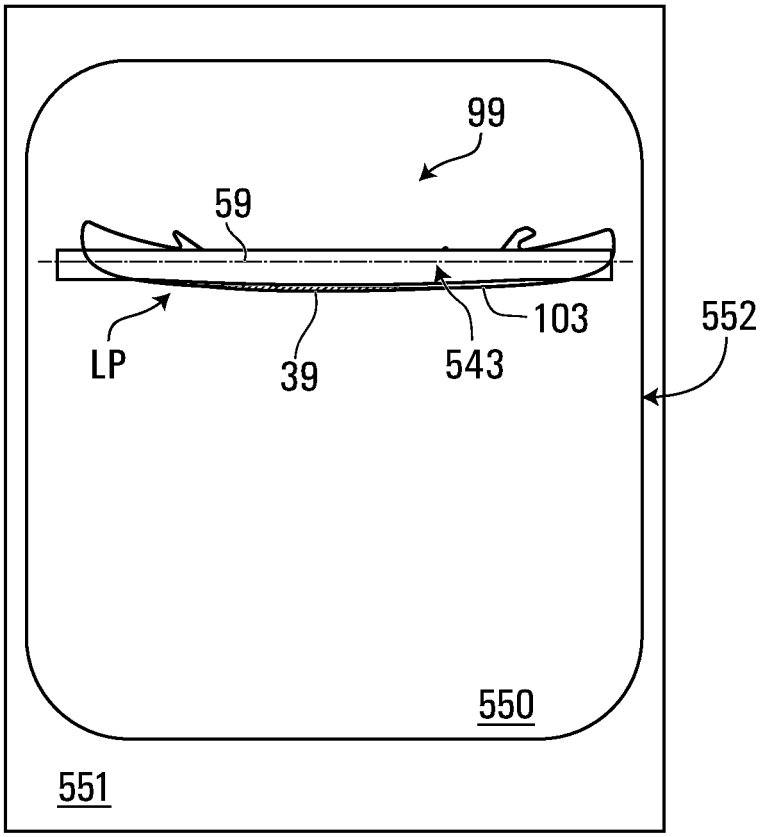
FIG. 13A is a representation of a menu of the GUI showing an overlay of a digital template over the blade to be profiled.
Figure 13B:
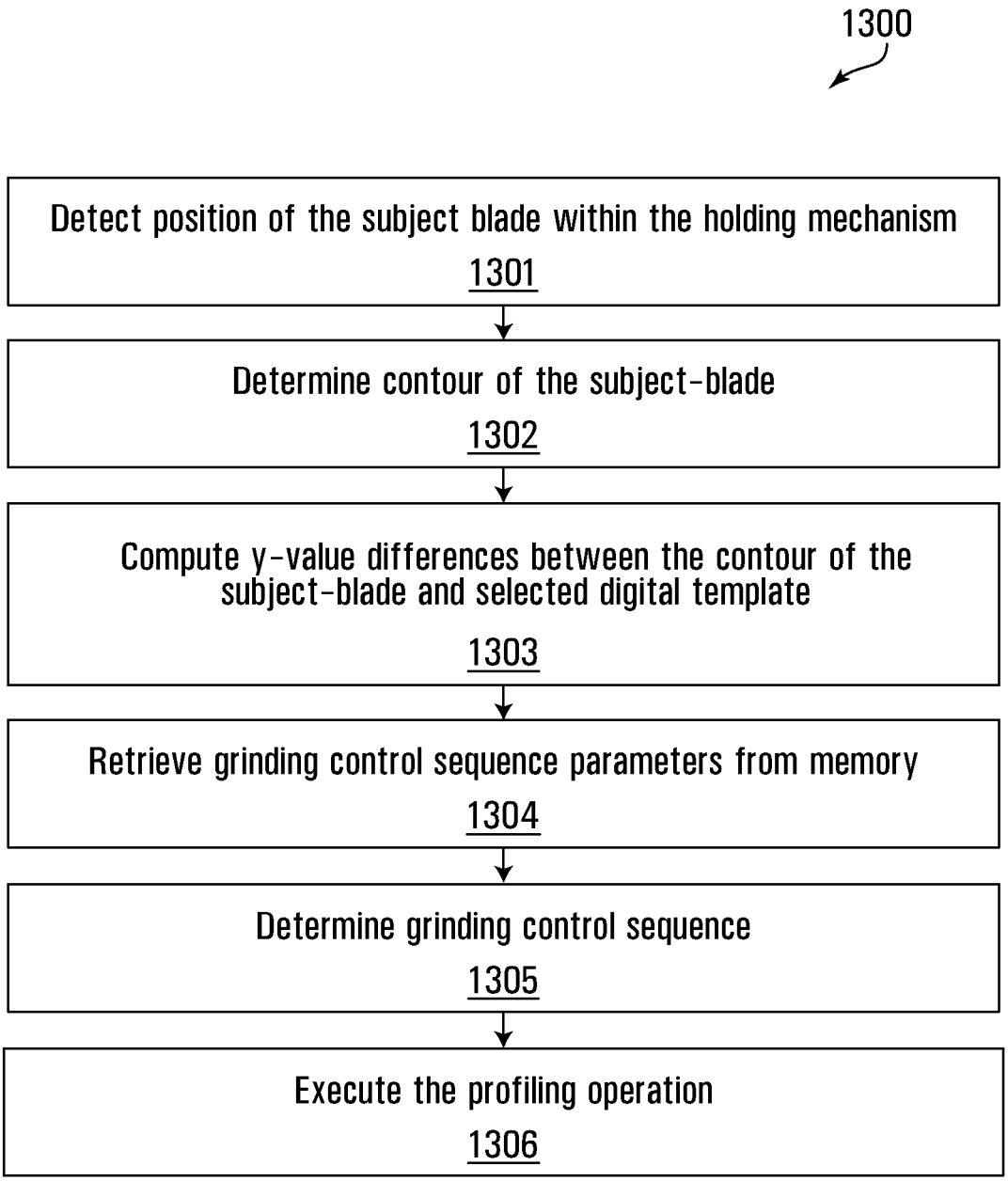
FIG. 13B is a flowchart showing steps in a process for determining amounts of material to remove from the subject blade as a function of position and for computing a "grinding control sequence"

Referring now to FIG. 13A, the GUI 550 can also be configured to display a preview on a screen 551 of the profiling apparatus 500, showing an overlay of the subject blade 99 and the selected digital template (whether selected explicitly or implicitly via selected profile parameters), in the region of interest 27, and may give the user the opportunity to make modifications to the selected digital template before proceeding to impart the corresponding longitudinal profile LP to the subject blade 99.

With the GUI user having informed the profiling apparatus 500 of the selected digital template, the profiling apparatus 500 then controls the moving mechanism 530 and the material removal mechanism 520 to apply the desired longitudinal profile LP to the subject blade 99. This may involve a regulating operation based on feedback obtained by laser or camera.

Specifically, upon selection of a digital template and a region of interest 27, a process 1300 run by the processor 570 determines the amount of material to remove from the subject blade 99 as a function of position (along the X-axis, such as a longitudinal axis 104 of the subject blade 99), and then computes a "grinding control sequence" for controlling the moving mechanism 530 and the material removal mechanism 520 so as to cause the contour of the selected digital template to be imparted to the subject blade 99. With reference to FIG. 13C, the process 1300 includes steps 1301 to 1306, which are now described in a certain order, but it is to be understood that the steps may be carried out in a different order or, in some cases, concurrently, At step 1301, the position of the subject blade 99 within the holding mechanism 510 is detected by the sensors 560. The position of the blade 99 within the holding mechanism 510 is measured with respect to one or more reference points (e.g., one or more points within the housing 501).

At step 1302, the sensors 560 are configured to determine the contour 103 of the subject blade 99 and this information is stored in the memory 580 of the profiling apparatus 500. The current contour 103 of the subject blade 99 may be stored as an array of horizontal and vertical position values (i.e., x and y values) with respect to the one or more reference point(s).

At step 1303, the y-displacement of the material removal device 5201 at each point X along the longitudinal axis 104 of the subject blade 99 is determined based on the selected digital template, the selected region of interest 27 and the information regarding the subject blade 99 determined in steps 1301 and 1302.

The selected digital template may be stored as an array of x and y position values. In this step, for each point X along the longitudinal axis 104 of the subject blade 99 within the region of interest 27, the difference between the y-values of the selected digital template and the subject-blade 99 is determined. This difference between the measured contour 103 of the subject blade 99 and the selected digital template at each point X along the longitudinal axis 104 of the subject blade 99 within the selected region of interest 27 corresponds to the band of excess material 39 to be removed from the subject blade 99. It is understood that this difference is computed upon establishing one or more shared reference points between the subject blade 99 and the selected digital template to accurately position the subject blade 99 with respect to the selected digital template.

At step 1304, parameters of the grinding control sequence are determined or retrieved from the memory 580 of the profiling apparatus 500. These parameters are described below with respect to an embodiment in which the holding mechanism 510 translates in the x-direction and the material removal device 5201 translates in the y-direction. It is to be understood that in other embodiments, other parameters may be utilized in the grinding control sequence.

Range of Translation of the Holding Mechanism

During a profiling cycle, the initial point of contact between the subject blade 99 and the holding mechanism 510 occurs at one of the beginning 29 or the end 30 of the region of interest 27 and the final point of contact occurs at the other of the beginning 29 or the end 30 of the region of interest 27. Accordingly, translation of the holding mechanism 510 occurs within this range. This range is stored in the memory 580. This range establishes where grinding of the subject blade 99 will and will not occur.

Grinding Pressure

The pressure to be applied to the subject blade 99 by the material removal device 5201 is also a parameter stored in the memory 580 of the profiling apparatus 500. In some embodiments, this pressure is constant along the length $L_R$ of the region of interest 27 during a profiling cycle. In other embodiments, this pressure is variable along the length $L_R$ of the region of interest 27 during a profiling cycle. The pressure applied to the subject blade 99 during the profiling cycle may be sensed by a pressure sensor. The pressure applied to the subject blade 99 during the profiling cycle may be regulated by the controller 575 of the profiling apparatus 500 such that if the pressure applied to the subject blade 99 is above or below a threshold level (set by a manufacturer of the profiling apparatus 500, in accordance with a non-limiting example), the pressure may be adjusted. For instance, the pressure may be adjusted by adjusting the vertical position of the material removal device 5201 with respect to the subject blade 99.

Speed of Translation of the Holding Mechanism in the x-Direction

Yet another parameter is the speed of translation of the holding mechanism 510 in the x-direction. The speed of the holding mechanism 510 may be defined in inches per second or centimeters per second or feet per second. This parameter is stored in the memory 580 and may be regulated by one or more of the sensors 560 configured to measure the speed of the holding mechanism 510 and by the controller 575 configured to control the speed of the holding mechanism 510 to maintain the speed of the holding mechanism 510 within an optimal range (set by the manufacturer of the profiling apparatus 500, in accordance with a non-limiting example).

Speed of Translation of the Material Removal Device in the y-Direction

In this embodiment, the material removal mechanism 5201 is configured to move in the y-direction. The speed of translation of the material removal device 5201 may be defined in inches per second or centimeters per second or feet per second. This parameter is stored in the memory 580 and may be regulated by one or more of the sensors 560 configured to measure the speed of the material removal device 5201 and by the controller 575 configured to control the speed of the holding mechanism 510 to maintain the speed of the holding mechanism 510 within optimal range (set by the manufacturer of the profiling apparatus 500, in accordance with a non-limiting example).

Speed of Rotation of the Material Removal Device

The speed of rotation of the material removal device 5201 may be defined in revolutions per minute. This parameter is stored in the memory 580 and may be regulated by one or more of the sensors 560 configured to measure the speed of rotation of the material removal device 5201 and by the controller 575 configured to control the speed of rotation of the material removal device 5201 to maintain the speed within optimal range (set by the manufacturer of the profiling apparatus 500, in accordance with a non-limiting example).

Acceleration Time of the Holding Mechanism

Acceleration time of the holding mechanism 510 is a parameter that defines the time required for the holding mechanism 510 to achieve the translation speed of the holding mechanism 510 from a stationary position. The acceleration time of the holding mechanism 510 may be defined in seconds. In the present embodiment, this parameter is stored in the memory 580 of the profiling apparatus 500.

Acceleration Time of the Material Removal Device

Acceleration time of the material removal device 5201 is a parameter that defines the amount of time required for the material removal device 5201 to reach its optimal rotation speed. The acceleration time of the material removal device 5201 may be defined in seconds. In the present embodiment, this parameter is stored in the memory 580 of the profiling apparatus 500.

At step 1305, the grinding control sequence is determined based on the above-described parameters. The grinding control sequence includes a set of x-y positions of the material removal device 5201 relative to the subject blade 99, and associated with each such x-y position is a value for the parameters described above. This information may be stored in the memory 580 and is shown in FIG. 13C in the form of table 1306A.

At step 1306, the profiling operation is executed. In this step, the position of the material removal device 5201 and the holding mechanism 510 are coordinated to cause the subject blade 99 to be profiled according to the selected digital template in accordance with the grinding control sequence determined in step 1305. Once the profile of the selected digital template has been imparted to the subject blade 99 such that the subject blade 99 yields the blade 52 having a longitudinal profile LP consistent with the selected digital template, the profiling operation is completed. At this stage, the material removal device 5201 and the holding mechanism 510 are returned to their starting positions marking the conclusion of the profiling operation.

Additional Features of Profiling Apparatus

Figure 13D:
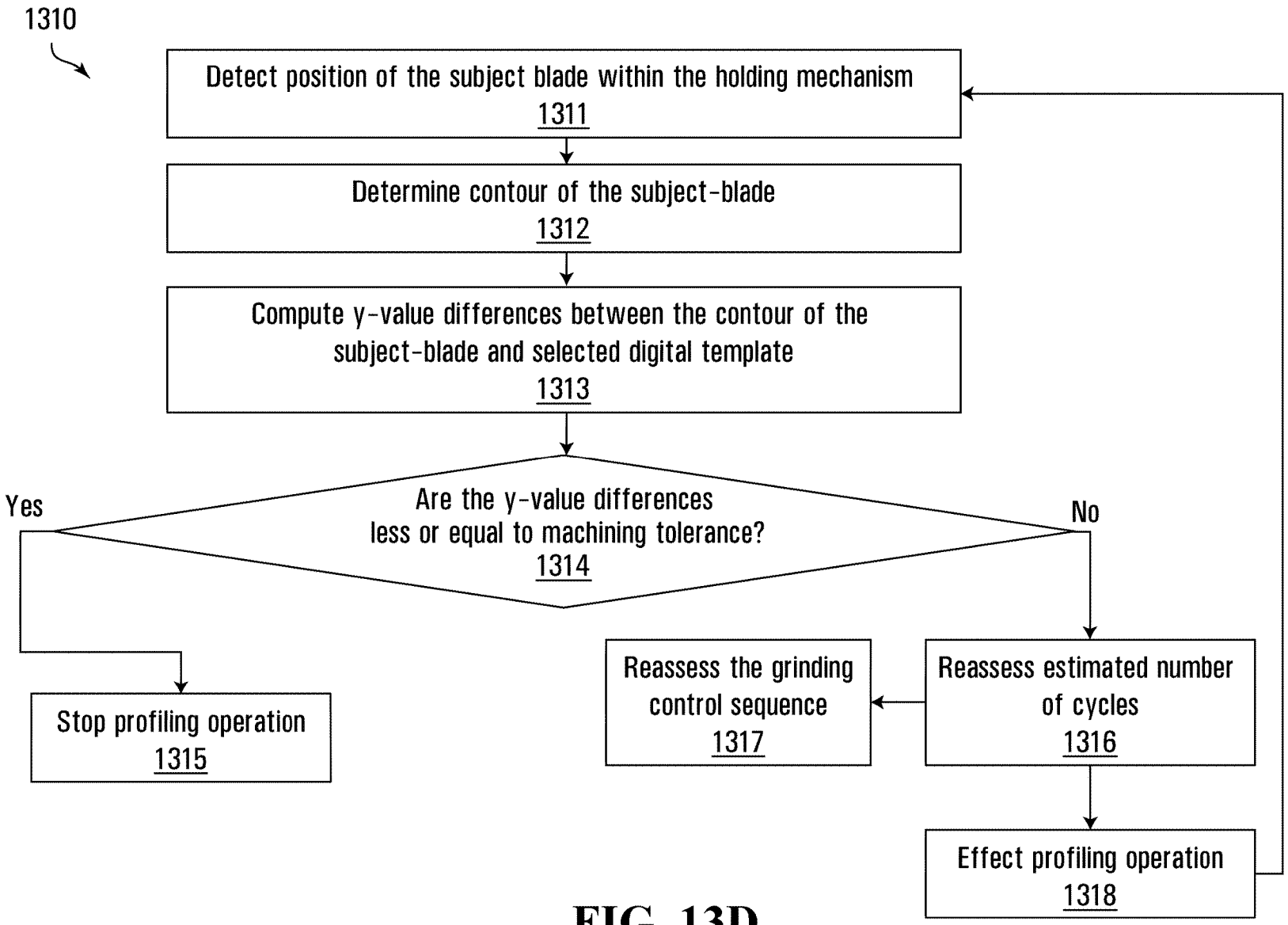
FIG. 13D is a flowchart showing steps in a process for refining the grinding control sequence.

During operation of the profiling apparatus 500, an additional process 1310 executed by the processor 570 of the profiling apparatus 500 can be configured to continually sense (e.g., via a camera or non-contact sensor or contact sensor) the contour 103 of the subject blade 99 as it is being profiled and to compare the sensed shape to the selected digital template (whether explicitly selected, or derived from selected profile parameters). Such feedback may be used to re-assess or refine the grinding control sequence. With reference to FIG. 13D, the process 1310 includes steps 1311 to 1318, which are now described in a certain order, but it is to be understood that the steps may be carried out in a different order or, in some cases, concurrently, In step 1311, similarly to step 1301 described above, the position of the subject blade 99 within the holding mechanism 510 is detected by one or more of the sensors 560. The position of the blade 99 within the holding mechanism 510 is measured with respect to one or more reference points (e.g., one or more points within the housing 501).

In step 1312, similarly to step 1302 described above, one or more of the sensors 560 are configured to determine the contour 103 of the subject blade 99 and this information is stored in the memory 580 of the profiling apparatus 500. The current contour 103 of the subject blade 99 may be stored as an array of horizontal and vertical position values (i.e., x-y values) with respect to the reference point(s).

In step 1313, for each point X along the longitudinal axis 104 of the subject blade 99 within the region of interest 27, the difference between the y-value associated with the selected digital template at a given point X and the y-value associated with the subject-blade 99 at the given point X is determined. This difference between the measured contour 103 of the subject blade 99 and the selected digital template at each point X along the longitudinal axis 104 of the subject blade 99 within the selected region of interest 27 corresponds to the band of excess material 39 to be removed from the subject blade 99. It is understood that this difference is computed upon establishing one or more shared reference points between the subject blade 99 and the selected digital template to accurately position the subject blade 99 with respect to the selected digital template.

In step 1314, the difference between these y-values is compared to a threshold tolerance value associated with the selected digital template which may be referred to as a "machining tolerance". The machining tolerance may be stored in the memory 580 of the profiling apparatus 500 and may be set by the manufacturer of the profiling apparatus 500, in accordance with a non-limiting example.

If the difference between these y-values is equal to or less than the machining tolerance, the next step is step 1315 wherein the profiling operation of the subject blade 99 is stopped.

For example, if the difference between these y-values is equal to or less than the machining tolerance over a threshold portion of the length $L_R$ of the region of interest 27, then the profiling operation is the profiling operation of the subject blade 99 is stopped. In some cases, the threshold portion of the length $L_R$ of the region of interest 27 may be anywhere between 95% and 100% of the length $L_R$ of the region of interest 127. Of course, the threshold portion of the length $L_R$ of the region of interest 27 may comprise any other suitable range.

However, if the difference between these y-values is more than the machining tolerance, the next step is step 1316.

For example, if the difference between these y-values is more than the machining tolerance over a threshold portion of the length $L_R$ of the region of interest 27, then the profiling operation is effected over the entire length $L_R$ of the region of interest 27 of the subject blade 99. In some cases, the threshold portion of the length $L_R$ of the region of interest 27 may be anywhere between 40% and 94.9% of the length $L_R$ of the region of interest 127. Of course, the threshold portion of the length $L_R$ of the region of interest 27 may comprise any other suitable range. Conversely, should the difference between these y-values be more than the machining tolerance over less than the threshold portion of the length $L_R$ of the region of interest 27 of the subject blade 99, the profiling operation may be limited to a portion of the region of interest 27.

In step 1316, the estimated number of profiling cycles is reassessed. Calculation of the estimated number of profiling cycles is discussed further below.

In step 1317, the grinding control sequence is reassessed. For example, the set of x-y positions associated with the grinding control sequence may be changed (i.e., the set of x-y positions of the material removal device 5201 relative to the subject blade 99 may be changed). For instance, the set of x-y positions may be changed to reflect a change in the portion of the region of interest 27 to be profiled. Additionally or alternatively, the values of the parameters associated with the set of x-y positions of the grinding control sequence may be changed.

In step 1318, the profiling operation of the subject blade 99 is effected until the estimated number of profiling cycles is completed. The process 1310 returns to step 1311 until such time as step 1314 yields a difference in y-values that is equal to or less than the machining tolerance.

Figure 13E:
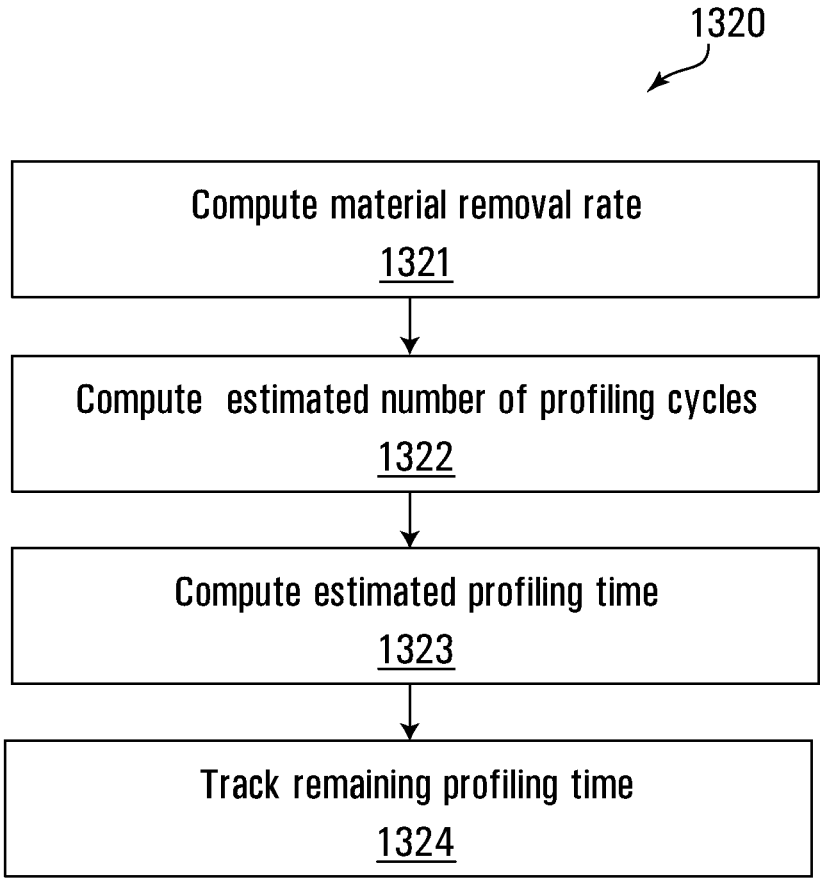
FIG. 13E is a flowchart showing steps in a process for determining the amount of time to complete a profiling operation on the subject blade.

A process 1320 executed by the processor 570 of the profiling apparatus 500 can be configured to determine the amount of time it will take to effect the complete profiling operation, and therefore such process may be configured to output, e.g., via the GUI 550, an estimate of the amount of profiling time required/remaining, which could be helpful to the user who may want to perform other tasks in the meantime. With reference to FIG. 13E, the process 1320 includes steps 1321 to 1324, which are now described in a certain order, but it is to be understood that the steps may be carried out in a different order or, in some cases, concurrently.

In step 1321, the processor 570 is configured to compute a material removal rate which is a value that defines the amount of material removed in one profiling cycle. The material removal rate may be defined in any suitable fashion, for example in fractions of an inch per cycle, fractions of a centimeter per cycle, millimeters per cycle or in units of volume per cycle, a cycle being related to the length $L_R$ of the selected region of interest 127 (for example, a cycle corresponding to $2L_R$). It is understood that the material removal rate is sensitive to the grinding pressure applied by the material removal device 5201 to the subject blade 99.

In step 1322, the processor 570 is configured to compute an estimated number of profiling cycles to complete the profiling operation. The estimated number of cycles is the estimated number of cycles required remove the band of excess material 39 from the region of interest 27 of the subject blade 99. The estimated number of cycles is computed based on the material removal rate and the maximum thickness to of the band of excess material 39.

In step 1323, the processor 570 is configured to compute an estimated profiling time. The estimated profiling time is the amount of time it will take to effect the complete profiling operation (i.e., the amount of time it will take to remove the band of excess material 39 from the region of interest 27 of the subject blade 99). The estimated profiling time is computed based on the estimated number of profiling cycles as well as the speeds and acceleration times defined above.

In step 1324, once the profiling operation is initiated, the process 570 is configured to continuously track a remaining profiling time. The remaining profiling time may be displayed to the user via the GUI 550 described above.

A further additional process 1330 executed by the processor 570 of the profiling apparatus 500 can be configured to detect an error or anomaly between the sensed longitudinal profile LP of the subject blade 99 and the selected digital template (whether explicitly selected, or derived from selected profile parameters). For example, the process 1330 may be configured to determine that profiling based on the selected digital template would take longer than a certain threshold duration or would lead to material loss above a threshold volume or overheating above a threshold temperature. Such parameters may generally be referred to as "suitability standards". It should be appreciated that other suitability standards may be defined for the profiling operation.

Figure 13F:
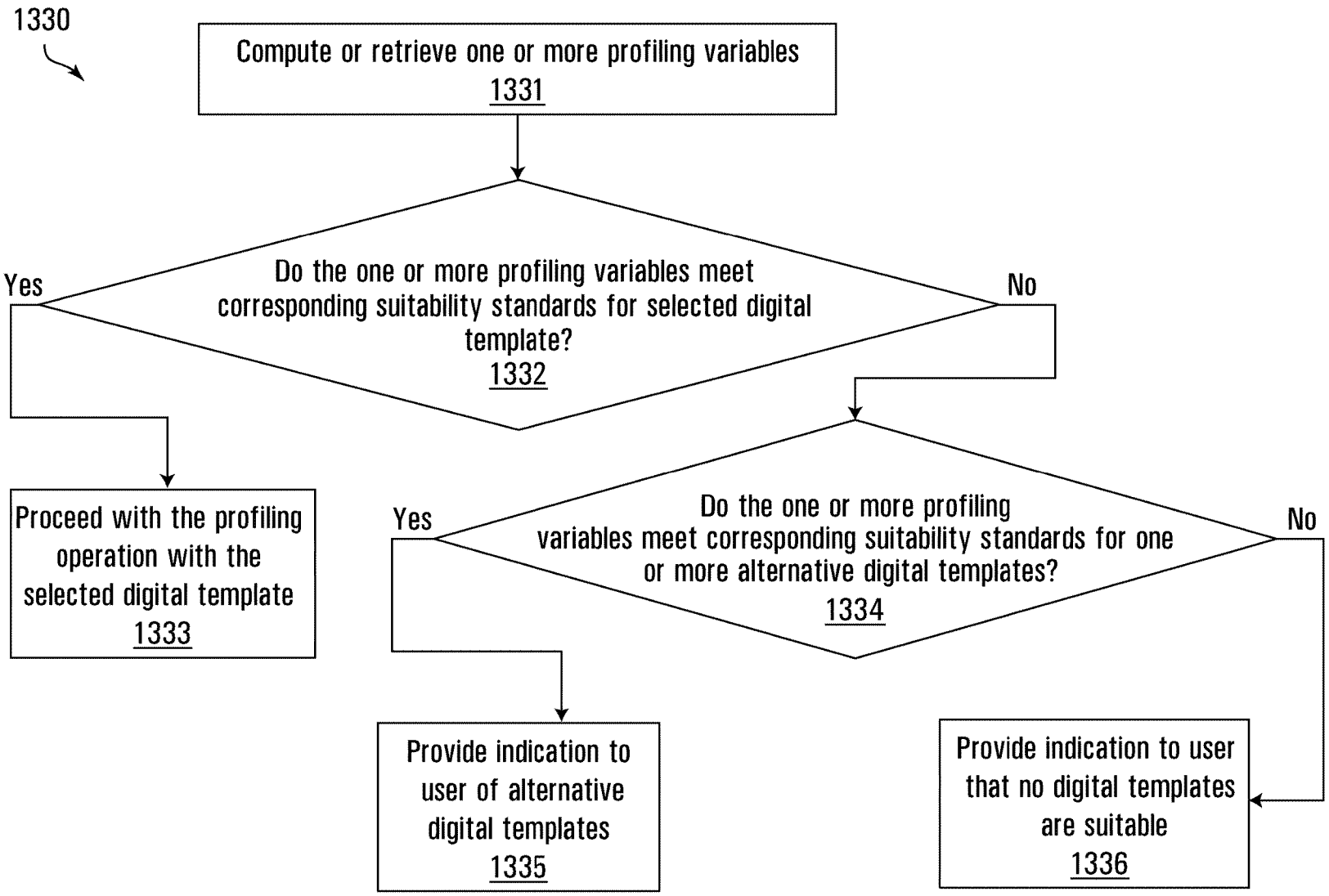
FIG. 13F is a flowchart showing steps in a process for detecting an error or anomaly between a sensed longitudinal profile of the subject blade and a selected digital template.
Figures 14A, 14B, 14C, 14D, 14E:
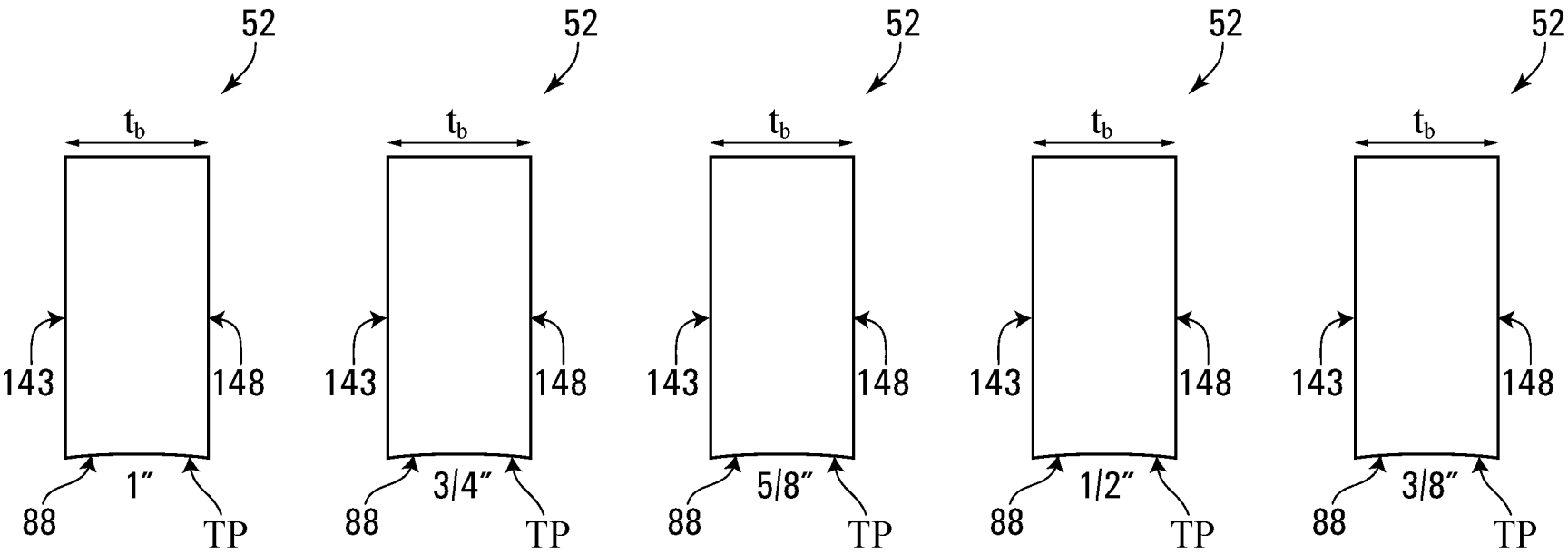
FIGS. 14A to 14E show blades with a variety of radii of curvature.

In such a case, the process 1330 may be configured to suggest an alternative digital template (or associated suitability standards) to the user that would not lead to an error or anomaly, or to request that the user select a new digital template (or select new profile parameters). With reference to FIG. 13F, the process 1330 includes steps 1331 to 1336, which are now described in a certain order, but it is to be understood that the steps may be carried out in a different order or, in some cases, concurrently.

In step 1331, the processor 570 is configured to compute or retrieve one or more profiling variables based on the selected digital template and the subject blade 99. The profiling variables are defined below.

Estimated Material Loss

The estimated material loss is a variable that defines the amount of material to be removed from the subject 99. The estimated material loss may be computed by the processor 570 based on the maximum thickness to of the band of excess material 39 and the widthwise thickness $t_b$ of the subject blade 99.

Estimated Profiling Time

The estimated profiling time is the amount of time it will take to effect the complete profiling operation. The estimated profiling time may be obtained using the process 1320 described above.

Estimated Peak Operative Temperature

The estimated peak operative temperature is the estimated maximum temperature of the subject blade 99 during the profiling operation (i.e., the estimated maximum temperature of the ice-contacting material 140 of the subject blade 99). The estimated peak operative temperature may be determined, for example, based on the estimated profiling time and temperature data associated with a range of estimated profiling times stored in memory 580. This temperature data may be obtained based on testing or other available data.

In step 1332, the profiling variables retrieved or computed in step 1331 are compared to their corresponding suitability standards. These suitability standards may be stored in the memory 580 of the profiling apparatus 500 and may be set by the manufacturer of the profiling apparatus 500 for the selected digital template, in accordance with a non-limiting example.

For example, the estimated material loss is compared to the threshold volume for the profiling operation, the estimated profiling time is compared to the threshold duration set for the profiling operation, and the peak operative temperature is compared to the threshold temperature set for the profiling operation.

If the values of the profiling variables meet these suitability standards, the next step is step 1333 in which the profiling operation proceeds with the selected digital template. For example, if the estimated material loss is less than the threshold volume, and if the estimated profiling time is less than the threshold duration, and if the peak operative temperature is less than the threshold temperature, the profiling operation may proceed with the selected digital template.

If the values of the profiling variables do not meet one or more of these suitability standards, the next step is step 1334. In step 1334, the values of the profiling variables are compared to suitability standards for one or more alternative digital templates.

If the values of the profiling variables meet the suitability standards of one or more alternative digital templates, the next step is step 1335 in which the user of the profiling apparatus 500 is provided an indication of digital templates which may be suitable given the values of the profiling variables. The one or more alternative digital templates may be presented to the user of the profiling apparatus 500 via the GUI 550, in accordance with a non-limiting example.

If the values of the profiling variables do not meet the suitability standards of any alternative digital templates, the next step is step 1336 in which the user of the profiling apparatus 500 is provided an indication that there are no digital templates suitable to profile the subject blade 99. For example, the user may be alerted via the GUI 550 that the subject blade 99 cannot be profiled by any of the digital templates entered in the profiling apparatus 500.

Sharpening

In addition to being profiled longitudinally, the subject blade 99 may be sharpened with a sharpening apparatus 1600. Referring to FIG. 2B, sharpening the subject blade 99 with a sharpening apparatus causes the subject blade 99 to become shaped in the widthwise direction (perpendicularly to the longitudinal direction) with a "transverse profile" TP. The transverse profile TP may have the shape of an arc (convex or concave) with a radius referred to as a "radius of hollow" 88. By way of non-limiting examples, as shown in FIGS. 14A to 14E, the radius of hollow 88 may vary from ⅜" to 1" (shown in this case for a 0.12" thick blade 52, wherein a thickness $t_b$ of the blade 52 is defined as the distance between the lateral surfaces 148, 143). Other radii of hollow 88 and blade thicknesses $t_b$ are of course possible. In some cases, the average radius of curvature of the transverse profile may be vary from ¼" to 2".

Figure 15A:
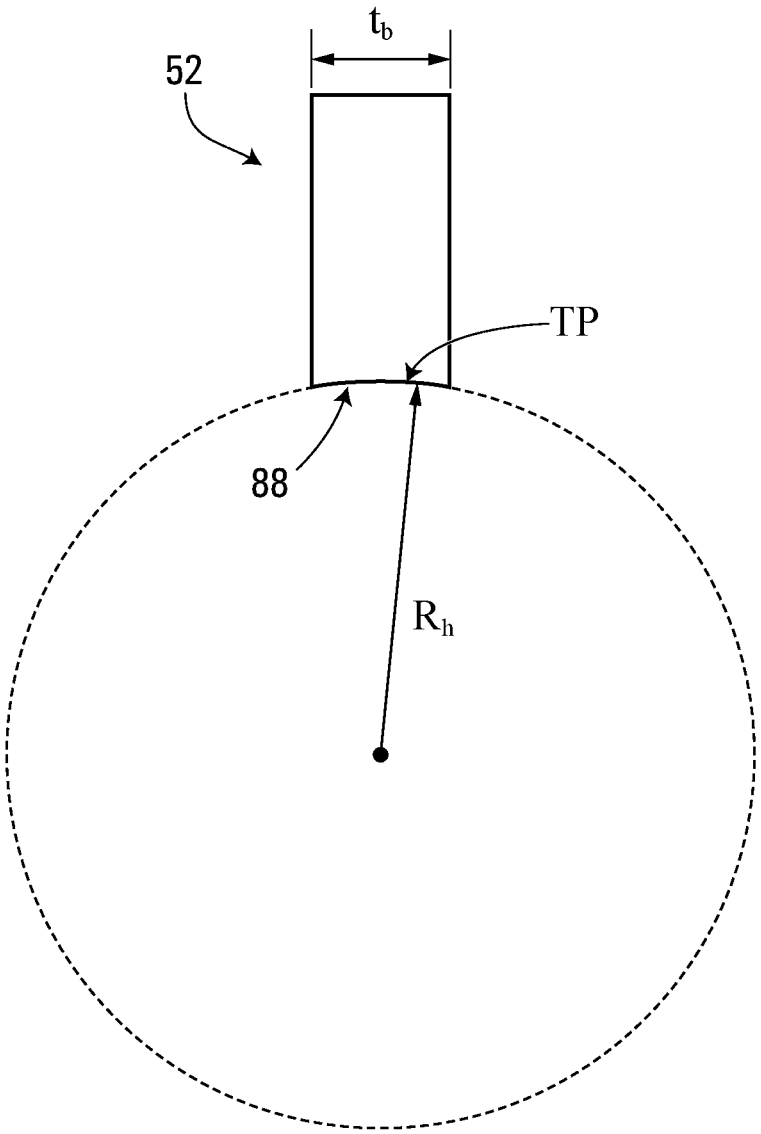
FIG. 15A is a representation of the radius of hollow of a blade as a portion of an arc of a circle.
Figure 15B:
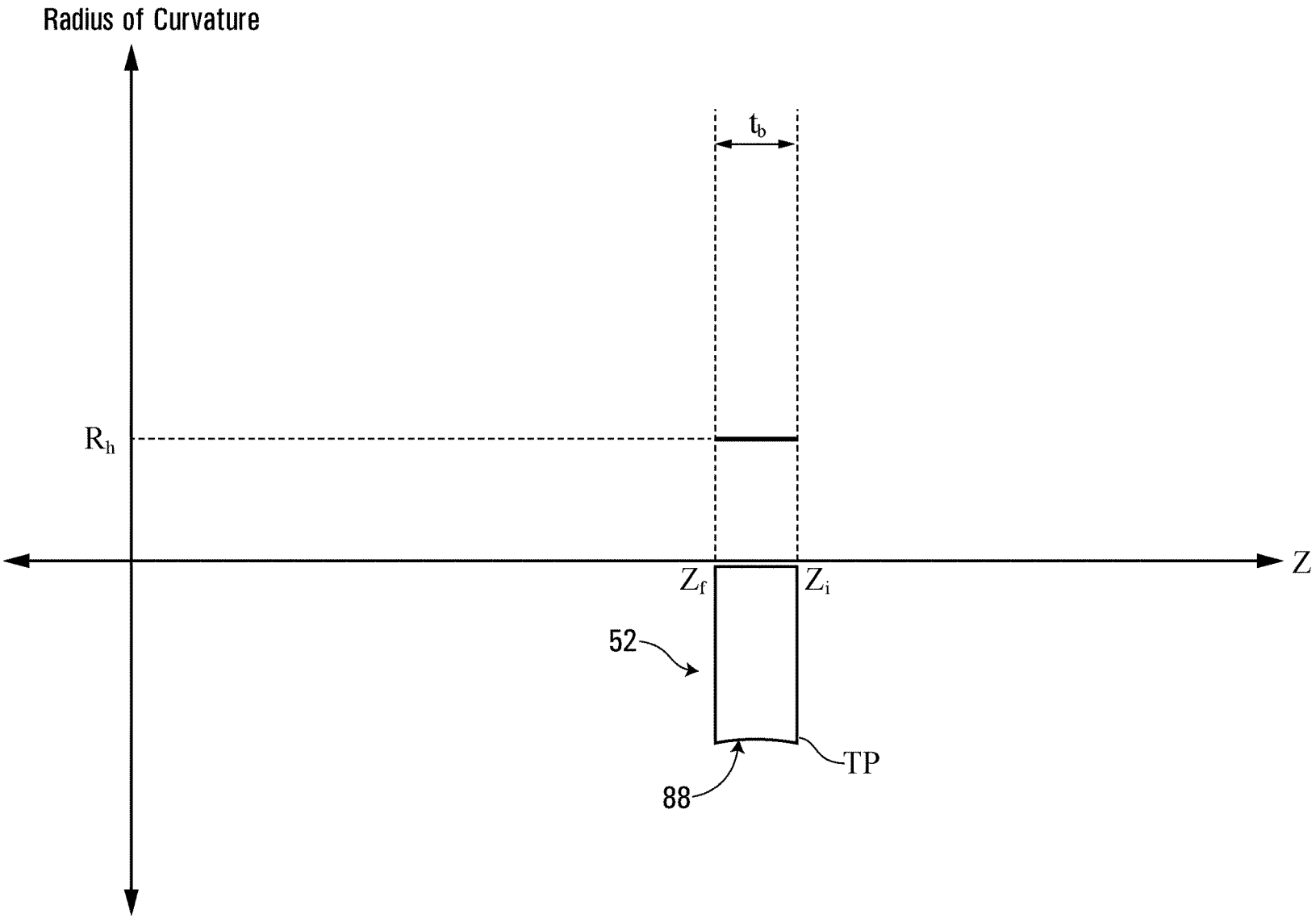
FIG. 15B is a plot of the radius of curvature of a transverse profile of the blade of FIG. 15A at each point along a cross-section of the longitudinal mid-point of the blade.

Referring now to FIG. 15A, there is shown the blade 52 of whose radius of hollow 88 is of arbitrary value $R_h$. As can be seen from FIG. 15A, the radius $R_h$ is the radius of a circular arc which best approximates the radius of curvature of the transverse profile TP. Referring now to FIG. 15B, there is shown a plot of the radius of curvature of the transverse profile TP at each point along the cross-section of the mid-point 49 (longitudinally) of the blade 52 in the Z-direction, between an initial value $Z_i$ and a final value $Z_f$, where $Z_f-Z_i$ corresponds to the thickness of the blade 52. It is seen that the radius of curvature is constant and equals the radius of hollow 88 (namely $R_h$ in this example).

Figure 15C:
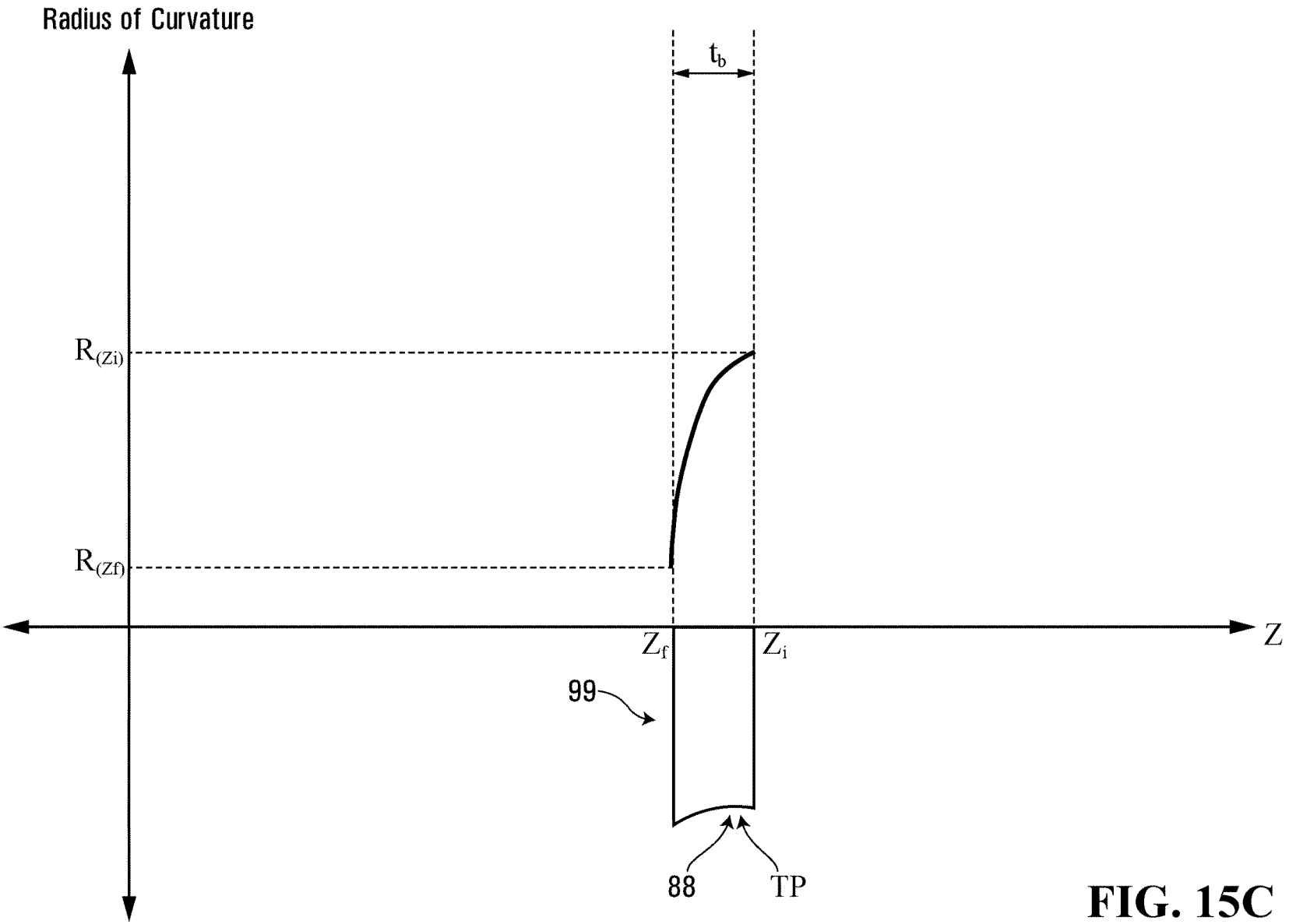
FIG. 15C is a plot of the radius of curvature of a transverse profile of a worn blade at each point along a cross-section of the longitudinal mid-point of the blade.

As the skate 10 is used, the wear of the blade 52 causes gradual blunting of the edges near $Z_i$ and $Z_f$, (albeit unevenly, depending on the skate leg) leading to a plot of the radius of curvature that may look more like the one shown in FIG. 15C. It is seen that there is a wide fluctuation in the resulting radius of curvature, which is on the order of 2 times, or 5 times, or 10 times or more. In contrast, FIG. 15B shows that the radius of curvature stays relatively constant and deviates by no more than 10% over the entire cross-sectional thickness of the blade 52. A newly machined transverse profile TP might have a deviation in the radius of curvature of no more than 5% or even 1% over the entire cross-section of the blade 52 at the midpoint in the lengthwise direction.

To machine the transverse profile TP of the subject blade 99 (e.g., to sharpen the subject blade 99) and apply the radius of hollow, the sharpening apparatus 1600 may be used.

In order to impart a suitable transverse profile TP to the skate blade 99, a sharpening apparatus 1600 may be used. Accordingly, the skate blade 99 may be machined by the sharpening apparatus 1600 to have a desired transverse profile TP with the aforementioned features in a region of interest 27 of the blade 52.

Figure 16A:
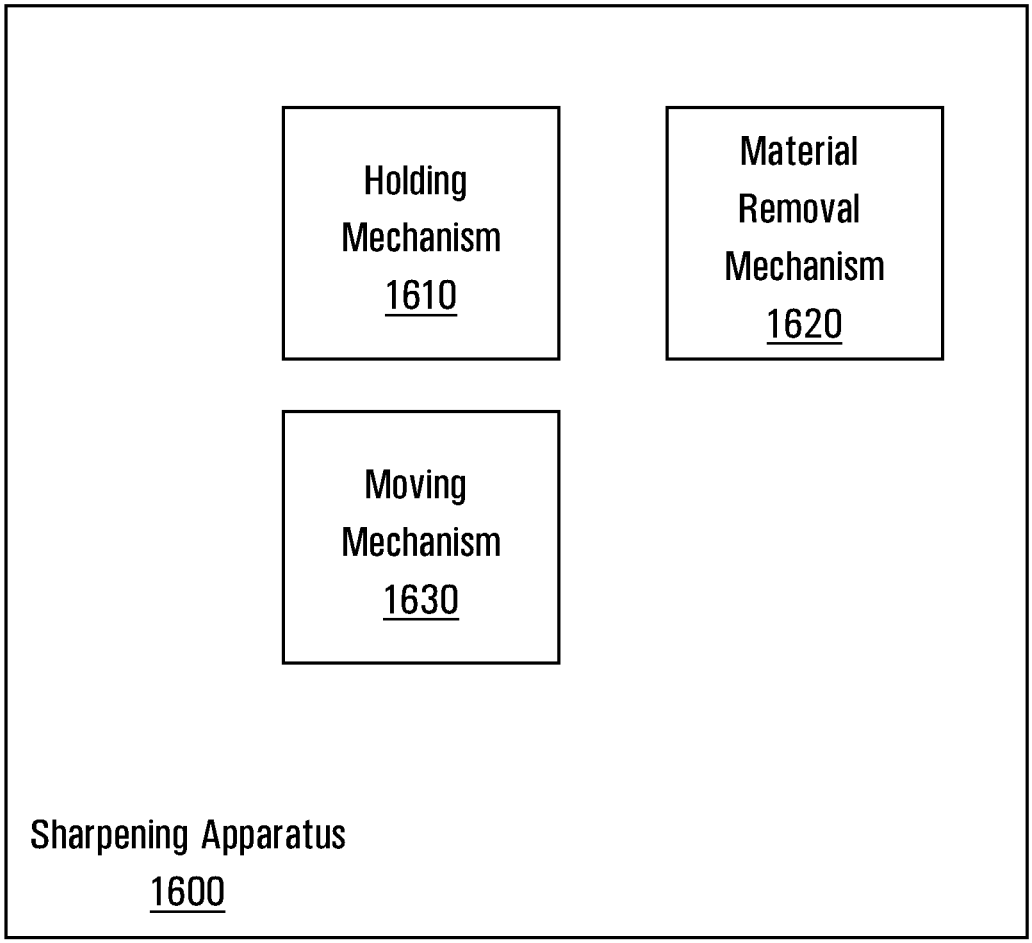
FIGS. 16A and 16B are block diagrams of various components of a sharpening apparatus in accordance with a non-limiting embodiment of the present disclosure.

Referring to FIG. 16A, there is shown a block diagram including various functional components of a sharpening apparatus 1600 for machining one or more subject blades 99 simultaneously. The sharpening apparatus 1600 includes a holding mechanism 1610 for holding one or more subject blades 99 and a material removal mechanism 1620, which can be wheel- or belt-based. Removal of ice-contacting material 140 from the subject blade 99 is achieved when the material removal mechanism 1620 contacts the ice-contacting surface 127 of the subject blade 99. As such, the sharpening apparatus 1600 includes a moving mechanism 1630 for allowing relative movement between the holding mechanism 1610 (which holds the one or more subject blades 99) and the material removal mechanism 1620.

The sharpening apparatus 1600 may be configured similarly to the above-described profiling apparatuses 500, 800, 900.

To remove the ice-contacting material 140, the subject blade 99 is inserted in a blade receiving portion 1613 of the holding mechanism 1610 and brought into contact with a material removal device 1601 of the material removal mechanism 1620 such that the subject blade 99 contacts a material removal device 1621 and such that the material removal device 1621 removes material from the ice-contacting surface 127 of the subject blade 99.

In some embodiments, the blade-receiving portion 1613 of the holding mechanism 1610 is configured as a slot 1612 which provides access to the material removal mechanism 1620 and the subject blade 99 is received in the slot 1612 of the holding mechanism 1610.

The blade-receiving portion 1613 of the holding mechanism 1610 may be configured such that it reduces access to the moving parts of the sharpening apparatus 1600 and, thus, reduces incidences of injury to a user of the sharpening apparatus 1600. The blade-receiving portion 1613 may be covered by a protective element (e.g., covers, shield) to block dust and/or debris generated during the sharpening operation from hitting the user or to prevent the user from reaching into the sharpening apparatus 1600 through the blade-receiving portion 1613 with their hands during certain sequences in the operation of the sharpening apparatus 1600.

In this embodiment, the holding mechanism 1610 comprises retaining elements 1611 configured to contact the lateral surfaces 148, 143 of the subject blade 99 to secure the subject blade 99 (or subject blades 99) within the holding mechanism 1610. Additionally or alternatively, in other embodiments, the retaining elements 1610 may be configured to contact the front and rear ends 57, 55 of the subject blade 99 to secure the blade within the holding mechanism 1610.

The retaining elements 1611 are configured to longitudinally and/or laterally center the subject blade 99 within the holding mechanism 1610 with respect to the blade-receiving portion 1613 of the holding mechanism 1610.

The holding mechanism 1610 and the retaining elements 1611 may be configured as described above with respect to the holding mechanism 510 and the retaining elements 5110 of the profiling apparatus 500.

The sharpening operation of the subject blade 99 involves relative movement of the material removal device 1621 and the subject blade 99.

In one embodiment, the material removal device 1621 is fixed within the housing 1601 of the sharpening apparatus 1600 and the moving mechanism 1630 is configured to translate the subject blade 99 longitudinally (in the x-direction of FIGS. 16C and 16D) as the material removal device 1621 is operative to remove excess material from the subject blade 99. In this example of implementation, the moving mechanism 1630 is configured to translate the holding mechanism 1610.

In other embodiments, the holding mechanism 1610 is fixed with respect to the sharpening apparatus 1600 such that the subject blade 99 is fixed with respect to the sharpening apparatus 1600. In this example, the moving mechanism 1630 is configured to translate the material removal device 1621 longitudinally (in the x-direction of FIGS. 16C and 16D) as the material removal device 1621 is operative to remove of excess material from the subject blade 99.

In yet other embodiments, the moving mechanism 1630 is configured to translate both the holding mechanism 1610 and the material removal device 1621 such that the excess material is removed from the ice-contacting surface 127 of the subject blade 99. In this example of implementation, the moving mechanism 1630 is configured to translate the subject blade 99.

The moving mechanism 1630 may be configured in any suitable fashion.

Figure 16B:
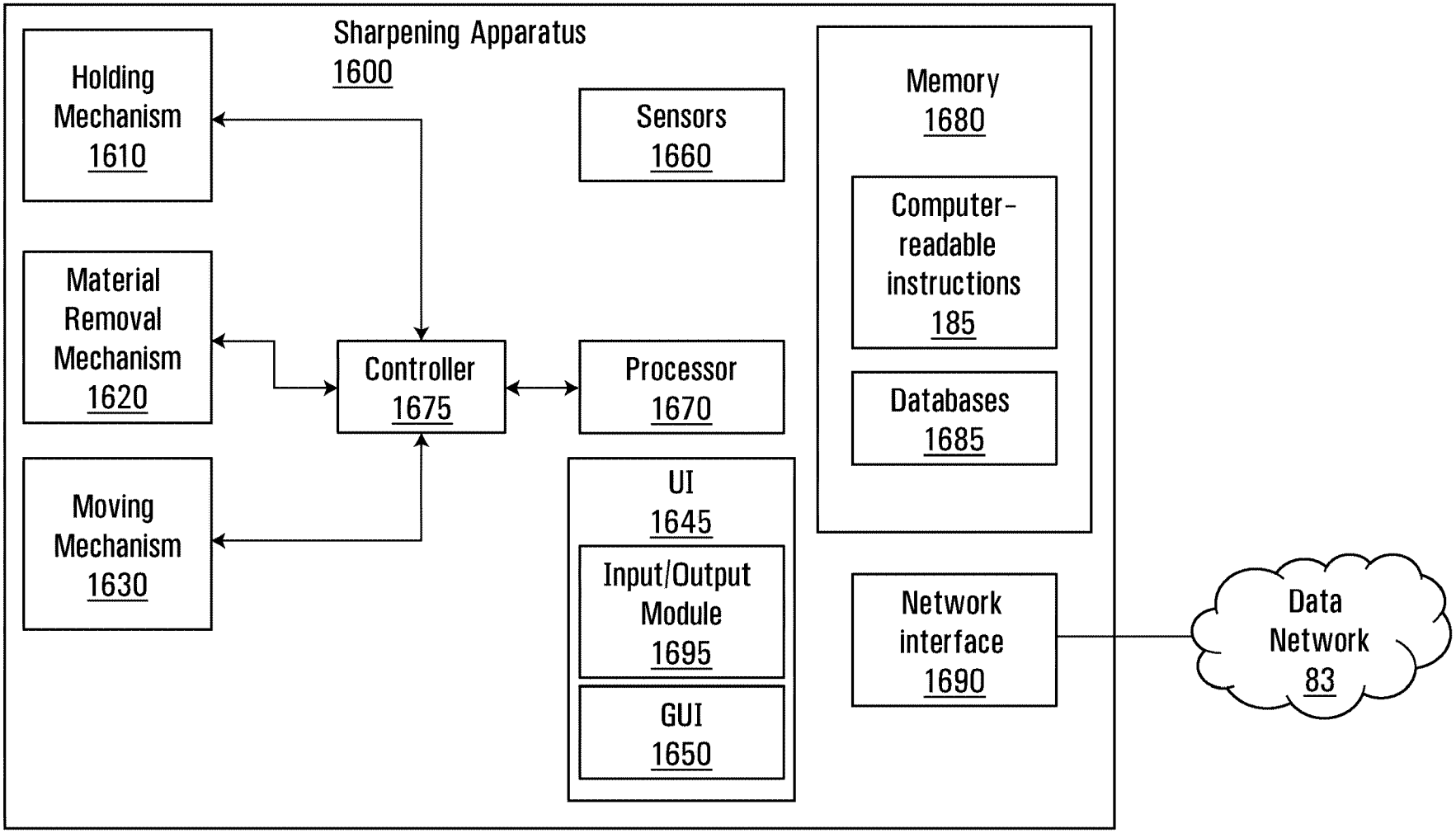
Figure 16C:
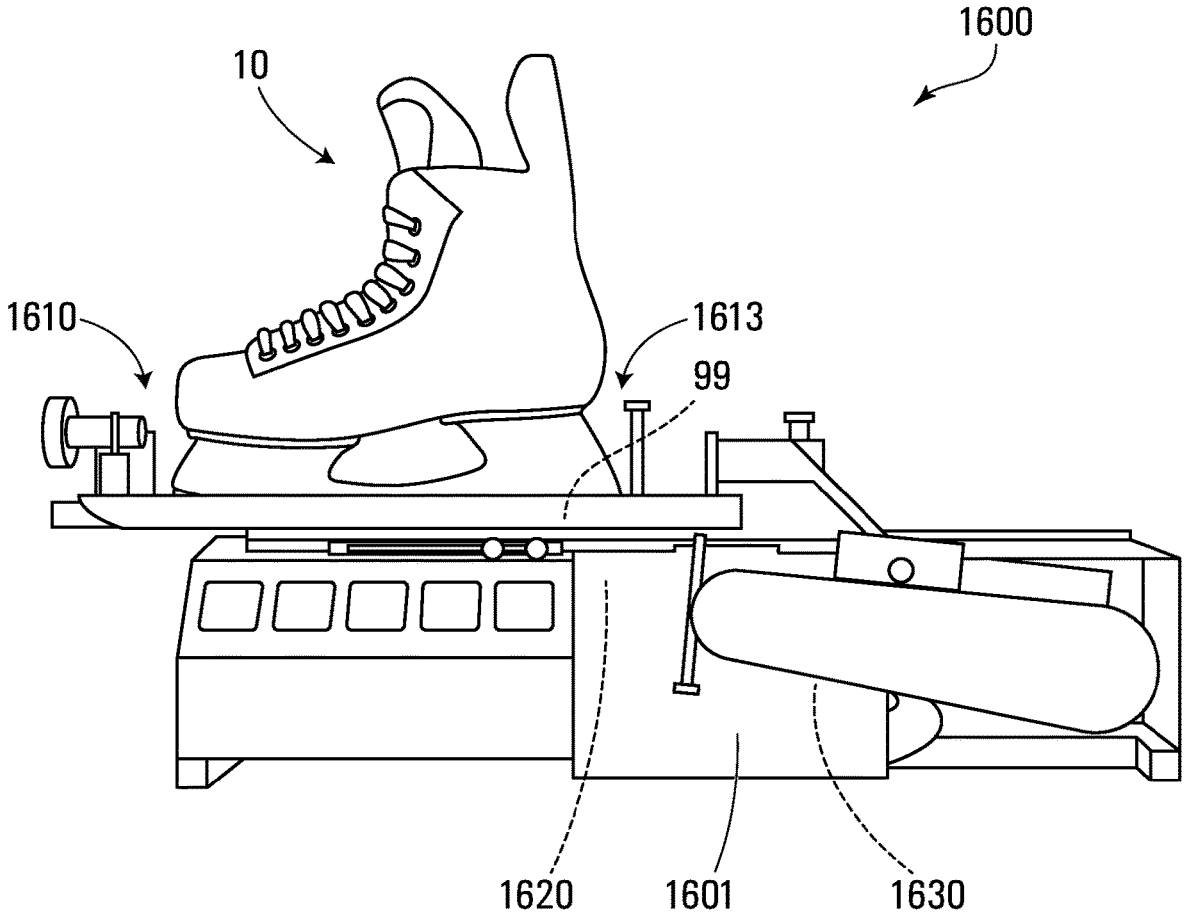
FIGS. 16C and 16D are side and perspective views of a non-limiting embodiment of a sharpening apparatus.
Figure 16D:
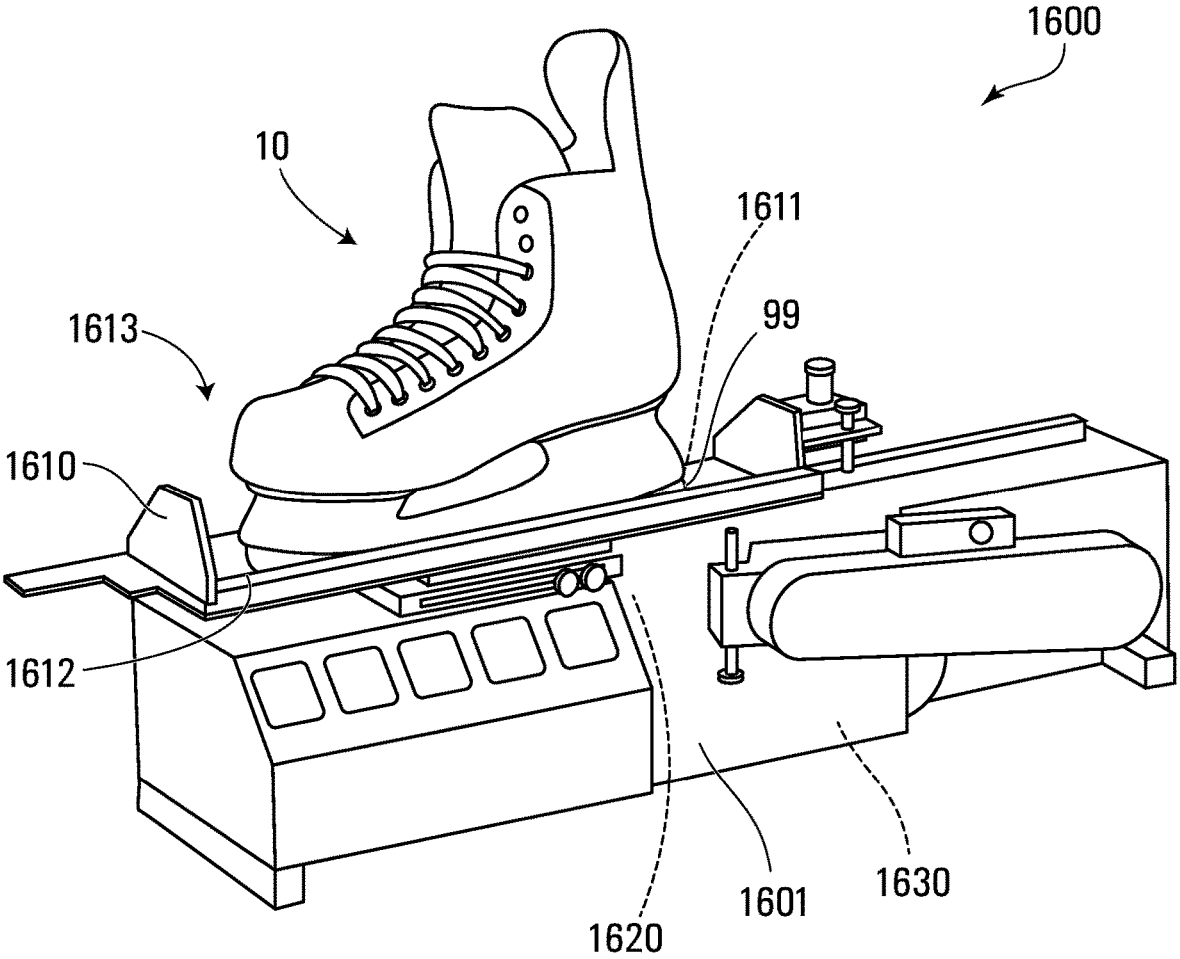

In the illustrated embodiment as shown in FIG. 16B, the sharpening apparatus 1600 comprises a processor 1670, a non-transitory memory 1680 including various databases 1685 for storing information used by processes, a controller 1675 for controlling processes of the profiling operation, sensors 1660 for sensing a variety of parameters related to the profiling operation, a GUI 1650 including an input/output module 1695 for entering selections and displaying information, and may include any other suitable components typically found in a sharpening apparatus 1600. Each of these components maybe configured similarly as the analogous components described above with respect to the profiling apparatus 500.

As a result of profiling and sharpening in accordance with embodiments of the present disclosure, a blade 52 with the above-described characteristics in the longitudinal direction (e.g., longitudinal profile LP) and in the transverse direction (e.g., transverse profile TP) is produced.

Those skilled in the art will appreciate that in some cases, the same apparatus may be used for profiling and for sharpening.

Variants and Alternatives

Although the ice-contacting material 140 of the blade 52 has been referred to as metallic, in some variants the blade 52 may be made of different materials or combinations of materials. These include metal-and-polymer hybrid (where the polymer may be purely polymeric or fiber-reinforced) and coated metal where the coating may include a carbide, nitride, oxide, etc.

Figure 19:
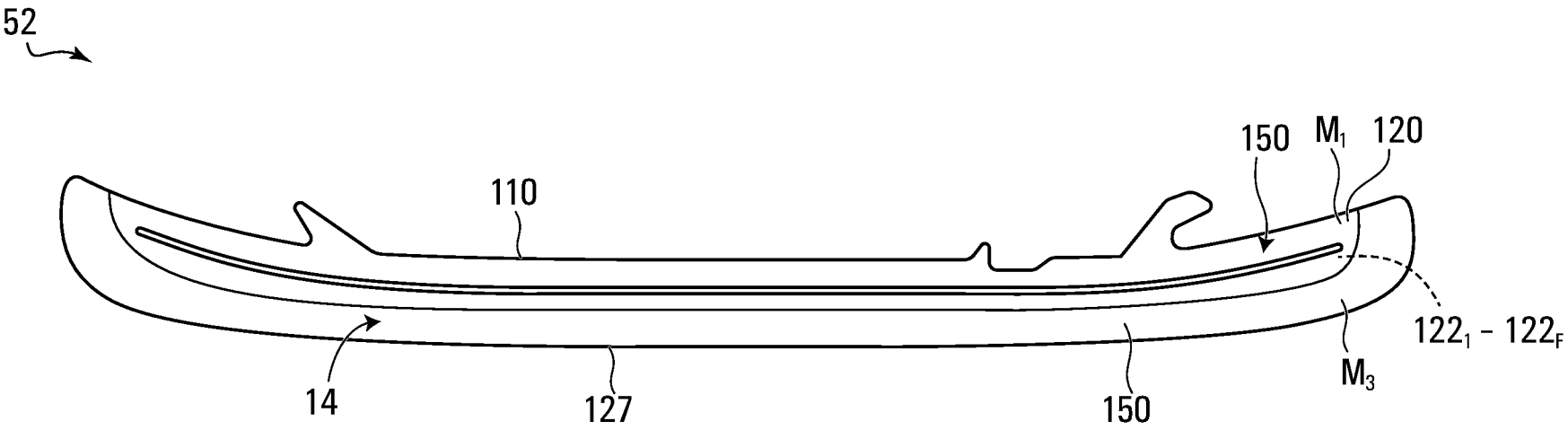
FIG. 19 is a variant of the blade including a plurality of materials.

For example, the blade 52 may include a plurality of different materials $M_1$-$M_3$ disposed in different areas of the blade 52 and connected to each other, as shown in FIG. 19. For example, the material M may be disposed in a first portion 110 of the blade, the materials $M_2$ and $M_3$ may be disposed in a second portion 114 of the blade 52 secured to the first portion 110 of the blade 52. In the illustrated embodiment, the material $M_1$ is a polymeric material 151 and the materials $M_2$, $M_3$ are metallic materials 150. For instance, the material $M_1$ may be a composite material comprising a polymeric matrix 120 and fibers 1221-122F disposed in the polymeric matrix 120.

The polymeric matrix 120 may include any suitable substance (e.g., resin). For instance, in some examples, the polymeric matrix 120 may include a thermoplastic or thermosetting resin, such as epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin. In this embodiment, the polymeric matrix 120 includes an epoxy resin.

The fibers 1221-122F may be made of any suitable material such as carbon fiber, polymeric fibers such as aramid fibers (e.g., Kevlar fibers), boron fibers, silicon carbide fibers, metallic fibers, glass fibers, ceramic fibers, etc. The fibers 1221-122F may be oriented in any suitable fashion and may have a continuous configuration.

In the case of a coated blade 52, the coating may comprise a thin film coating of any suitable thickness. The thin film may be deposited using techniques know in the art such as physical vapor deposition (PVD) or plasma assisted chemical vapor deposition (PACVD) for example.

The thin film coating comprises a carbon-based top layer. A number of underlayers may be provided, between the substrate and the carbon-based top layer. The underlayers may be in metals, such as Cr, Ti, TiAl, Ni and W for example; nitrides, such as CrN, TiN and TiAlN for example; oxides; carbides; or they can be siliceous or carbon based layers for example (a-C:H (DLC), ta-C, WCC, . . . ). Other materials having a low friction coefficient may be contemplated, such as solid film lubricants or polymers such as PTFE for example.

The above-described profiling apparatuses 500, 800, 900 and sharpening apparatus 1600 may also include additional features in other embodiments.

For example, a particle management system 1900 may be included to collect debris generated from the profiling and/or sharpening operations. The particle collection system 1900 may include one or more components including a vacuum device (e.g., a vacuum cleaner, vacuum pump), an exhaust device (e.g., an exhaust fan), a filter connected to a negative pressure source, a particle collection container etc. The controller 575 may be in communication with the particle management system 1900 to operate automatically during the profiling operation and/or sharpening operations to minimize the debris from these operations.

The housing 501 or a portion of the housing 501 may be configured to be removable to provide access to the material removal device 5201 for replacement of the material removal device 5201. Similarly, the housing 501 or a portion of the housing 501 can be removable to provide access to one or more of the components of the profiling apparatus 500 for servicing, maintenance, and/or replacement. The housing 501 may comprise any suitable shape or material.

Details Regarding the Skate Boot

Figure 17A:
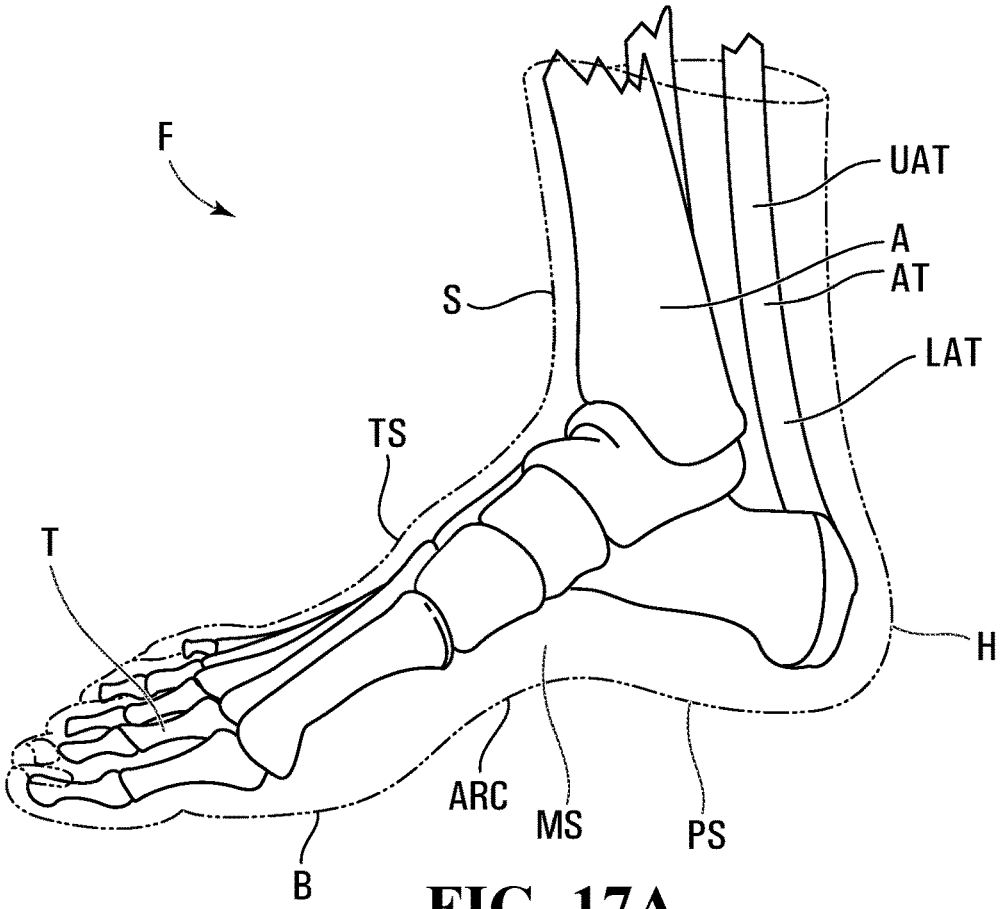
FIGS. 17A and 17B are side and front views of a right foot of the user with an integument of the foot shown in dotted lines and bones shown in solid lines.
Figure 17B:
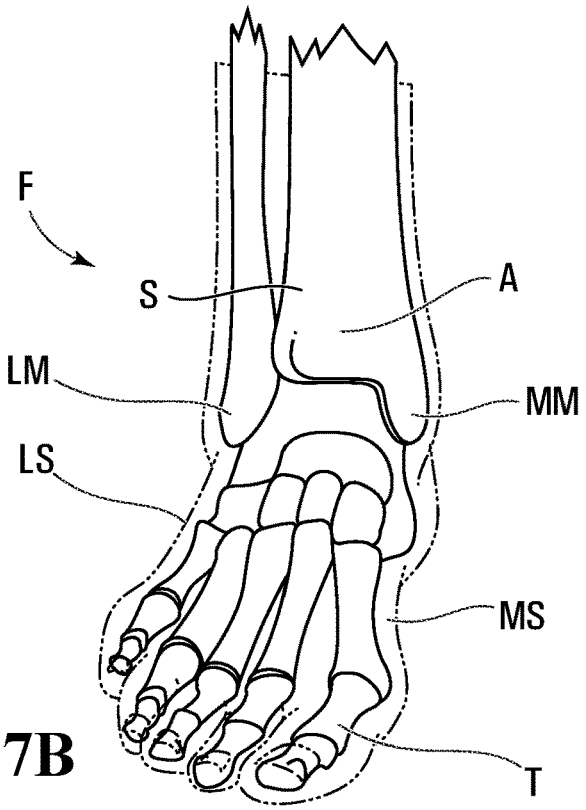

With reference to FIGS. 1A and 1B, the skate boot 11 defines a cavity 26 for receiving the user's foot F. With additional reference to FIGS. 17A and 17B, the user's foot includes toes T, a ball B, an arch ARC, a plantar surface PS, a top surface TS, a medial side MS and a lateral side LS. The top surface TS of the user's foot F is continuous with a lower portion of the user's shin S. In addition, the user has a heel H, an Achilles tendon AT, and an ankle A having a medial malleolus MM and a lateral malleolus LM that is at a lower position than the medial malleolus MM. The Achilles tendon AT has an upper part UP and a lower part LAT projecting outwardly with relation to the upper part UAT and merging with the heel H. A forefoot of the user includes the toes T and the ball B, a hindfoot of the user includes the heel H, and a midfoot of the user is between the forefoot and hindfoot.

In this embodiment, the skate boot 11 comprises a front portion 17 for receiving the toes T of the user's foot, a rear portion 19 for receiving the heel H of the user's foot, and an intermediate portion 21 between the front portion 17 and the rear portion 19.

More particularly, in this embodiment, the skate boot 11 comprises a body 12, a toe cap 14 for facing the toes T, a tongue 16 extending upwardly and rearwardly from the toe cap 14 for covering the top surface TS of the user's foot, a tendon guard 43, a rigid insert 18 for providing more rigidity around the ankle A and the heel H of the user's foot, a liner 20, a footbed 22, and an insole 24. The skate boot 11 also comprises lace members 38 (sometimes referred to as "facings") and eyelets 42 extending through (e.g., punched into) the lace members 38, the body 12 and the liner 20 vis-a-vis apertures 40 in order to receive a lace for tying the skate 10. In some embodiments, the skate boot 11 may not comprise any lace members and the eyelets 42 may extend directly through the body 12 and the liner 20 via the apertures 40.

The body 12 of the skate boot 11 imparts strength and structural integrity to the skate 10 to support the user's foot F. More particularly, in this embodiment, the body 12 of the skate boot 12, which will be referred to as a "shell", comprises a heel portion 44 for receiving the heel H, an ankle portion 46 for receiving the ankle A, and medial and lateral side portions 50, 60 for facing the medial and lateral sides MS, LS of the skater's foot, respectively, and a sole portion 69 for facing the plantar surface PS of the user's foot F. The shell 12 thus includes a quarter 48 which comprises a medial quarter part 77, a lateral quarter part 79, and a heel counter 81. The medial and lateral side portions 50, 60 include upper edges 51, 61 which, in this embodiment, constitute upper edges of the lace members 38. The heel portion 44 may be formed such that it is substantially cup-shaped for following the contour of the heel H of the user. The ankle portion 46 comprises medial and lateral ankle sides 52, 54. The medial ankle side 53 has a medial depression 56 for receiving the medial malleolus MM and the lateral ankle side 54 has a lateral depression 58 for receiving the lateral malleolus LM of the skater. The lateral depression 58 is located slightly lower than the medial depression 56 for conforming to the morphology of the skater's foot. The ankle portion 46 further comprises a rear portion 47 facing the lower part LP of the Achilles tendon AT of the user.

The liner 20 of the skate boot 11 is affixed to an inner surface 15 of the shell 12 and comprises an inner surface 32 intended for contact with the heel H and medial and lateral sides MS, LS of the user's foot and the user's ankle A in use. Fort instance, the liner 20 may be made of a soft material (e.g., a fabric made of NYLON® fibers or any other suitable fabric). The rigid insert 18 is sandwiched between the shell 12 and the liner 20 and may be affixed in any suitable way (e.g., glued to the inner surface of the shell 12 and stitched along its periphery to the shell 12). The footbed 22 is mounted inside the shell 12 and comprises an upper surface 34 for receiving the plantar surface PS of the user's foot and a wall 36 projecting upwardly from the upper surface 34 to partially cup the heel H and extend up to a medial line of the user's foot. The insole 24 has an upper surface 25 for facing the plantar surface PS of the user's foot and a lower surface 23 on which the shell 12 may be affixed.

The toe cap 14 of the skate boot 11 is configured to face and protect the toes T of the user's foot F. In some embodiments, the toe cap 14 may be manufactured separately from and fastened to the shell 12. In other embodiments, at least part (i.e., part or all) of the toe cap 14 may be formed integrally with the shell 12 and can thus be referred to as a toe portion of the shell 12.

Figure 1H:
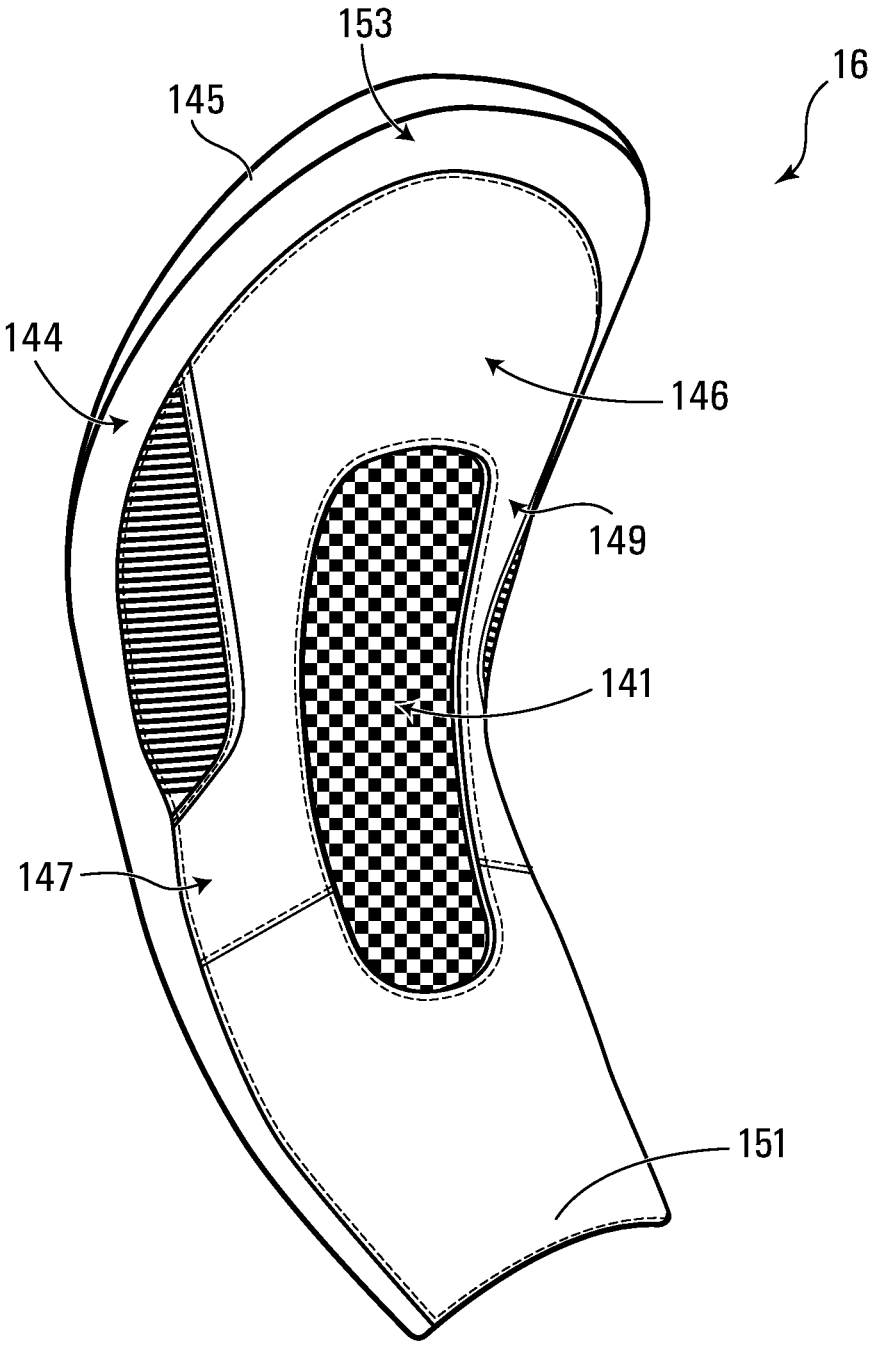
FIG. 1H is a view of a tongue of the blade in accordance with a non-limiting embodiment of the present disclosure.

The tongue 16 extends upwardly and rearwardly from the toe cap 14 for overlapping the top surface TS of the user's foot F. In this embodiment, as shown in FIG. 1H, the tongue 16 comprises a core 141 defining a section of the tongue 16 with increased rigidity, a padding member (not shown) for absorbing impacts to the tongue 16, a peripheral member 144 for at least partially defining a periphery 145 of the tongue 16, and a cover member 146 configured to at least partially define a front surface of the tongue 16. The tongue 16 defines a lateral portion 147 overlying a lateral portion of the user's foot F and a medial portion 149 overlying a medial portion of the user's foot F. The tongue 16 also defines a distal end portion 151 for affixing to the toe cap 14 (e.g., via stitching) and a proximal end portion 153 that is nearest to the user's shin S.

The tendon guard 43 extends upwardly from the rear portion 47 of the ankle portion 46 of the shell 12 in order to protect the user's Achilles tendon AT. In some embodiments, the tendon guard 43 may be a separate component from the shell 12 such that the tendon guard 43 is fastened to the shell 12 via a mechanical fastener (e.g., via stitching, stapling, a screw, etc.) or in any other suitable way. In other embodiments, at least part (i.e., part or all) of the tendon guard 43 may be integrally formed with the shell 12 of the skate boot 11.

The skate boot 11 may be constructed in any other suitable way in other embodiments. For example, in other embodiments, various components of the skate boot 11 mentioned above may be configured differently or omitted and/or the skate boot 11 may comprise any other components that may be made of any other suitable materials and/or using any other suitable processes.

The blade-retaining base 80 of the blade holder 28 is elongated in the longitudinal direction of the blade holder 28 and is configured to retain the blade 52 such that the blade 52 extends along a bottom portion 73 of the blade-retaining base 80 to contact the ice 13. To that end, the blade-retaining base 80 comprises a blade-retention portion 75 to face and retain the blade 52. In this embodiment, the blade-retention portion 75 comprises a recess 76, which can be referred to as a "blade-receiving slot", extending from the front portion 66 to the rear portion 68 of the blade holder 28 in which an upper portion of the blade 52 is disposed. The blade-retaining base 80 may be configured in any other suitable way in other embodiments.

The support 82 of the blade holder 28 is configured for supporting the skate boot 11 above the blade-retaining base 80 and transmit forces to and from the blade-retaining base 80 during skating. In this embodiment, the support 82 comprises a front pillar 84 and a rear pillar 86 which are spaced from one another in the longitudinal direction of the blade holder 28 and which extend upwardly from the blade-retaining base 80 towards the skate boot 11. The front pillar 84, which can be referred to as a front "pedestal" or "post", extends towards the front portion 17 of the skate boot 11 and the rear pillar 86 which can be referred to as a rear "pedestal" or "post", extends towards the rear portion 19 of the skate boot 11. The blade-retaining base 80 extends from the front pillar 84 to the rear pillar 86. More particularly, in this embodiment, the blade-retaining base 80 comprises a bridge 88 interconnecting the front and rear pillars 84, 86.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Those skilled in the art will appreciate that the description and drawings merely illustrate certain principles and that various arrangements may be devised which, although not explicitly described or shown herein, embody such principles. Furthermore, the examples and conditions recited herein are mainly intended to aid the reader in understanding such principles and are to be construed as being without limitation to such specifically recited examples and conditions.

It should be noted that references to relative positions (e.g., "top" and "bottom") in this description are merely used to identify various elements as are oriented in the Figures. It should be recognized that the orientation of particular components may vary greatly depending on the application in which they are used.

Some embodiments are also intended to cover program storage devices, e.g., digital data storage media, which are, machine or computer-readable and encode machine-executable or computer-executable programs of instructions, wherein said instructions perform some or all of the steps of the above-described methods. The embodiments are also intended to cover computers programmed to perform said steps of the above-described methods.

Those skilled in the art will appreciate that when a processor is described as being "configured" to carry out an action or process, this can mean that the processor carries out the action or process by virtue of executing computer-readable instructions that are read from device memory where these computer-readable instructions are stored.

Those skilled in the art should appreciate that any feature of any embodiment disclosed herein may combined with (e.g., used instead of or in addition to) any feature of any other embodiment disclosed herein in some examples of implementation. Certain additional elements that may be needed for operation of some embodiments have not been described or illustrated as they are assumed to be within a purview of those ordinarily skilled in the art. Moreover, certain embodiments may be free of, may lack and/or may function without any element that is not specifically disclosed herein.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A blade for a skate for skating on ice, the skate comprising a skate boot configured to receive a foot of a user, the skate further comprising a blade holder disposed below the skate boot and configured to hold the blade, the blade being elongate and having a length, the blade comprising:

ice-contacting material with an ice-contacting surface for contacting the ice, the ice-contacting surface having a machined longitudinal profile with a radius of curvature that varies smoothly over a region of interest of the blade, the region of interest occupying a majority of the length of the blade.

2. The blade defined in claim 1, wherein the radius of curvature of the machined longitudinal profile has an effective slope of at least 1.18 units of radius per unit of blade length within the region of interest.

3. The blade defined in claim 2, wherein the radius of curvature of the machined longitudinal profile has a maximum slope of no more than 17.14 units of radius per unit of blade length within the region of interest.

4. The blade defined in claim 2, wherein the machined longitudinal profile comprises N consecutive arcs, each having a radius of curvature, wherein a ratio of the radius of curvature of each of the segments in the region of interest to the radius of curvature of each adjacent one of the segments is between 0.9 and 1.1, and wherein N is at least as great as 8.

5. The blade defined in claim 1, wherein the region of interest occupies between 50% and 75% of the length if the blade.

6. The blade defined in claim 1, wherein the region of interest occupies at least 75% of the length of the blade.

7. The blade defined in claim 1, wherein the ice-contacting surface has a machined transverse profile along a cross-section of the blade taken at a length-wise midpoint of the blade, the transverse profile being characterized by a radius of curvature that varies by no more than X % over the entire cross-section of the blade, where X is no greater than 10%.

8. The blade defined in claim 7, wherein the transverse profile is symmetric about a thickness-wise midpoint of said cross-section of the blade.

9. The blade defined in claim 7, wherein the transverse profile has an average radius of curvature that is no greater than 2 inches.

10. The blade defined in claim 9, wherein the transverse profile has an average radius of curvature that is no less than one-quarter inch.

11. The blade defined in claim 7, wherein one of the longitudinal profile and the transverse profile is convex and the other is concave.

12. The blade defined in claim 7, wherein X is no greater than 1%.

13. The blade defined in claim 1, wherein the longitudinal profile corresponds to an elliptical arc in the region of interest.

14. The blade defined in claim 13, wherein a radius of curvature of the elliptical arc is monotonically increasing from a first point in the region of interest closest to a front of the blade to a second point in the region of interest closest to a rear of the blade.

15. The blade defined in claim 13, wherein a radius of curvature of the elliptical arc passes through a maximum at an intermediate point that is intermediate a first point in the region of interest closest to a front of the blade and a second point in the region of interest closest to a rear of the blade.

16. The blade defined in claim 15, wherein the intermediate point is located at the lengthwise midpoint of the blade.

17. The blade defined in claim 15, wherein the intermediate point is shifted relative to the lengthwise midpoint of the blade by an amount that does not exceed 20 mm.

18. The blade defined in claim 15, wherein a mid-point of the region of interest along the length of the blade is located at the lengthwise midpoint of the blade.

19. A skate, comprising:

a skate boot configured to receive a foot of a user;

a blade holder disposed below the skate boot and configured to hold the blade defined in claim 1.

20. A blade for a skate for skating on ice, comprising:

ice-contacting material with an ice-contacting surface for contacting the ice, the ice-contacting surface defining a longitudinal profile along a length of the blade and a transverse profile along a cross-section of the blade taken at a lengthwise midpoint of the blade;

wherein the longitudinal profile has a radius of curvature that varies smoothly over a majority of the length of the blade;

wherein the transverse profile has a radius of curvature that varies by no more than 10% over the entire cross-section of the blade.

21. A blade for a skate for skating on ice, the skate comprising a skate boot configured to receive a foot of a user, the skate further comprising a blade holder disposed below the skate boot and configured to hold the blade, the blade being elongate and having a length that is divisible into five fifths of equal size, the blade comprising:

ice-contacting material with an ice-contacting surface for contacting the ice, the ice-contacting surface being longitudinally profiled to have a first radius of curvature at a first point in the second fifth of the blade and a second radius of curvature at a second point in the fourth fifth of the blade, with the second radius of curvature being greater than the first radius of curvature by at least 10%, and with the blade being transition-zone-free between the first point and the second point.

* * * * *